US006780579B2

(12) United States Patent
Sasaki et al.

(10) Patent No.: US 6,780,579 B2
(45) Date of Patent: Aug. 24, 2004

(54) SILVER HALIDE EMULSION AND IMAGE-FORMING METHOD USING SILVER HALIDE COLOR PHOTOGRAPHIC LIGHT-SENSITIVE MATERIAL CONTAINING THE SAME

(75) Inventors: Hirotomo Sasaki, Kanagawa (JP); Hiroyuki Suzuki, Kanagawa (JP); Tomoki Tasaka, Kanagawa (JP); Masafumi Mizuno, Kanagawa (JP); Hiroyuki Mifune, Kanagawa (JP); Atsushi Matsunaga, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/395,276

(22) Filed: Mar. 25, 2003

(65) Prior Publication Data

US 2004/0002026 A1 Jan. 1, 2004

(30) Foreign Application Priority Data

| | | |
|---|---|---|
| Mar. 26, 2002 | (JP) | P.2002-087025 |
| Apr. 15, 2002 | (JP) | P.2002-112081 |
| Jun. 28, 2002 | (JP) | P.2002-190820 |
| Sep. 9, 2002 | (JP) | P.2002-262704 |
| Sep. 19, 2002 | (JP) | P.2002-273289 |
| Sep. 25, 2002 | (JP) | P.2002-279333 |
| Sep. 25, 2002 | (JP) | P.2002-279379 |

(51) Int. Cl.[7] ..... G03C 1/09
(52) U.S. Cl. ..... 430/603; 430/605
(58) Field of Search ..... 430/603, 605

(56) References Cited

U.S. PATENT DOCUMENTS

| | | | | | |
|---|---|---|---|---|---|
| 5,620,841 | A | * | 4/1997 | Lok et al. | 430/600 |
| 6,083,679 | A | * | 7/2000 | Klingman et al. | 430/569 |
| 6,346,372 | B1 | | 2/2002 | Yoshikawa et al. | |
| 6,638,705 | B1 | * | 10/2003 | Suzuki et al. | 430/603 |

FOREIGN PATENT DOCUMENTS

| | | |
|---|---|---|
| GB | 1184138 | 10/1968 |
| JP | 8-69075 | 3/1996 |

* cited by examiner

*Primary Examiner*—Hoa Van Le
(74) *Attorney, Agent, or Firm*—Sughrue Mion, PLLC

(57) ABSTRACT

A silver halide emulsion having a silver chloride content of 90 mol % or more which has been chemically sensitized with a compound capable of releasing an $Au^{I}Ch^{-}$ ion is described, wherein grains of the silver halide contain in the shell portion thereof 0.01 to 0.50 mol % of silver iodide per mol of the total silver, with Ch representing S, Se or Te.

13 Claims, No Drawings

SILVER HALIDE EMULSION AND IMAGE-FORMING METHOD USING SILVER HALIDE COLOR PHOTOGRAPHIC LIGHT-SENSITIVE MATERIAL CONTAINING THE SAME

FIELD OF THE INVENTION

The present invention relates to a silver halide emulsion, more particularly, to a silver halide emulsion which causes less fog, which is highly sensitive and contrasty, which shows excellent reciprocity law properties at high-intensity exposure, which undergoes less change in sensitivity under different humidity conditions upon exposure, and which shows excellent humid abrasion resistance, and to a silver halide color photographic light-sensitive material using the same and an image-forming method using the light-sensitive material.

BACKGROUND OF THE INVENTION

In recent years, there has been an increased demand for performance of color photographic paper, such as high sensitivity, high image quality and toughness during processing. Thus, there has been a demand for an emulsion which causes less fog and which is highly sensitive and contrasty, an emulsion which suffers less change in sensitivity during storage, an emulsion which suffers less change in photographic properties under different temperature and humidity conditions upon exposure or an emulsion which shows excellent humid abrasion resistance. On the other hand, with the spread of laser scan-exposing apparatuses, adaptability for short-time and high-intensity exposure has become one of important performances of color photographic papers. The laser scanning exposure's great characteristics are its high-speed exposure and improved resolution. In applying this to color photographic papers, however, adaptability for an extremely short-time (specifically $10^{-6}$ second) and high-intensity exposure not having so far been required is anew required.

For such requirement, the chemically sensitizing method has been considered to play an important role, and various noble metal-sensitizing methods and chalcogen-sensitizing methods have been proposed. However, many of them use a noble metal sensitizer and a chalcogen sensitizer in combination. Improvement of the noble metal sensitizers have been continued until quite recently as shown below with respect to gold sensitizers.

(Regarding Gold Sensitizers)

The gold sensitizing method is a means effective for attaining high sensitivity and adaptability for high-intensity exposure. It has been known from old to use Au(III) compounds such as chloroauric acid. Chloroauric acid is fully stable in an aqueous solution but, on the other hand, it is insufficient with such photographic properties as sensitivity, gradation, adaptability for high-intensity exposure, change in sensitivity during storage, humid abrasion resistance and toughness against temperature and humidity environment upon exposure, thus having been required to improve.

As gold compounds to be used for gold sensitization, there have been known gold (I) compounds containing meso-ionic ligand (hereinafter referred to as "meso-ionic gold (I) compounds"), and JP-A-4-267249 [patent document 1] discloses that such compounds are useful for producing highly sensitive, contrasty emulsions. (The term "JP-A" as used herein means an "unexamined published Japanese patent application".) JP-A-11-218870 [patent document 2] proposes a method of utilizing a gold (I) complex of a mercapto compound.

However, they are insufficient with such photographic properties as sensitivity, adaptability for high-intensity exposure, change in sensitivity during storage, humid abrasion resistance and toughness against temperature and humidity environment upon exposure, thus having been required to improve.

(Regarding Chalcogen Sensitizers)

As to chalcogen sensitizers, too, development of selenium sensitizers (for example, JP-A-5-40324 [patent document 3], JP-A-4-25832 [patent document 4], JP-A-271341 [patent document 5], JP-A-4-109240 [patent document 6], JP-A-5-224332 [patent document 7], JP-A-6-43576 [patent document 8], and JP-A-6-175258 [patent document 9]), tellurium sensitizers (for example, JP-A-4-333043 [patent document 10], JP-A-5-303157 [patent document 11], and JP-A-4-204640 [patent document 12]) has been continued as well as sulfur sensitization.

(Regarding Combined Use of Gold Sensitization and Chalcogen Sensitization (=Gold-chalcogen Sensitization)

This technique is an improvement of the gold sensitizer and the chalcogen sensitizer, and it has been intended to attain gold-chalcogen sensitization (for example, gold-sulfur sensitization and gold-selenium sensitization) by combining the two.

That is, gold sensitization is effected by the release of gold atom from a gold sensitizer, and chalcogen sensitization is effected by the release of chalcogen atom from a chalcogen sensitizer, and gold-chalcogen sensitization is attained by the two.

Various examples are known as chemically sensitizing methods using a compound containing a chalcogen atom and a metal atom, and there have been proposed, as gold sensitizers, gold complexes and gold salts with which sulfur atom coordinate (for example, JP-A-8-69075).

However, many of the compounds used in these proposals fail to effect gold-sulfur sensitization through a single compound because they do not substantially release sulfur atom, though they function as a gold sensitizer. One example thereof is the aforesaid gold (I) compound containing meso-ionic ligand (hereinafter referred to as "meso-ionic gold (I) compound") and is disclosed in JP-A-4-267249 [patent document 13]. Another example thereof is a gold (I) complex of a mercapto compound described in JP-A-11-218870 [patent document 14].

As an example of a single compound capable of effecting gold-sulfur sensitization, $Na_3Au(S_2O_3)_2$ (Hypo gold) has long been known. However, since thiosulfate ion therefrom functions as a sulfur sensitizer, it is disadvantageous for conducting chemical sensitization wherein gold/sulfur ratio is more than 1/2, e.g., 1/1, though it is advantageous for conducting chemical sensitization wherein the gold/sulfur ratio is 1/2.

As an example similar to $Na_3Au(S_2O_3)_2$, JP-A-2001-75215 [patent document 16] discloses an Au (I) complex having two molecules of thiourea compound. However, since the two molecules of the thiourea compound can function as a sulfur sensitizer, it involves the same disadvantage as $Na_3Au(S_2O_3)_2$. On the other hand, in consideration of these circumstances, JP-A-2001-75216 [patent document 17] discloses an Au (I) complex not having two molecules but having one molecule of the thiourea compound as a ligand. Here, examples having one reactive labile sulfur group and one Au(I) atom are described, which do not involve the above-described problem with $Na_3Au(S_2O_3)_2$ and the compounds described in JP-A-2001-75215 [patent document 16]. However, their photographic properties are insufficient with respect to adaptability for high-intensity exposure, toughness against temperature humidity environment upon exposure, and latent image stability, and hence they have been desired to improve.

As a further example of a compound which can effect gold-sulfur sensitization as a single compound, JP-B-45-29274 [patent document 18] describes a gold-sensitizing method using an aurous mercaptoglucose ((1-thioglucopyranosato) gold). (The term "JP-B" as used herein means an "examined Japanese patent publication".) The compound has the Au-to-sulfur atom ratio of 1:1. However, this is not a proposal of conducting chemical sensitization by releasing chalcogen-gold pair, and is insufficient with respect to sensitivity, change in sensitivity under different environmental conditions upon exposure, latent image stability, and reciprocity law properties at a high intensity exposure, thus having been desired to improve.

Also, nothing has been described therein with respect to an emulsion of silver halide grains containing silver iodide in their shell portions.

(Regarding Emulsion of Silver Halide Grains Containing Silver Iodide in Their Shell Portions)

U.S. Pat. Nos. 5,726,005 and 5,736,310 disclose that an emulsion having a high sensitivity and suffering less reciprocity law failure at high illumination can be obtained from a high silver chloride emulsion having a sub-surface shell that contains a maximum I concentration. European Patent No. 0928988A discloses in Examples that an emulsion being excellent in reciprocity law failure, dependence upon temperature upon exposure, and pressure properties can be obtained by incorporating a specific compound in grains which are formed by forming I band at a stage where 93% grains are formed. JP-A-2000-250178 discloses in Examples that adaptability for rapid processing, removal of color remaining and sharpness are improved by subjecting a silver halide light-sensitive material obtained by incorporating an ion of the group VIII of the periodic table in a high silver chloride emulsion to thereby reduce the amount of coated gelatin to short-time color development.

However, nothing is described therein as to a chemically sensitizing method using a compound capable of releasing an $Au^{I}Ch^{-}$ ion as in the invention.

In recent years, as color printing systems, techniques such as an ink jet system, a sublimation system and a color xerography have made progress, and are being accepted as a color printing system with excellent photographic image-level quality of these, a digital exposure system using a color photographic paper is characterized by its high image quality, high productivity and high fastness of image, and it has been desired to more enhance the excellent characteristics to provide photographs having a better image quality with more ease at a lower cost. In particular, one-stop service of color print, that is, a service wherein a recording medium of a digital camera is received at a storefront, and a high-image-quality print is produced within a short time of about a few minutes and is delivered there, would much more increase predominance of color prints using color photographic papers. Also, to enhance rapid processability of the color photographic papers enable one to use a small-sized and inexpensive printing apparatus having a high productivity, which is expected to more spread the one-stop service of color print. From these standpoints, it is of particular importance to enhance rapid processability of color photographic papers.

In order to realize the one-stop service of color print using color photographic papers, investigations are necessary from various viewpoints such as shortening of an exposure time, shortening of a so-called latent image time of from exposure to initiation of processing, and shortening of the period of from the processing to drying, and conventional proposals have been made from these viewpoints. Of these, the time required for exposing a single print is extremely shorter than the time required for others, and hence there arises almost no problems with a printer commonly employed at a shopfront. As to the latent image time, a design of a printer capable of shortening the exposure time as short as possible has been investigated. It has also been conducted to shorten the time from processing to drying. Rapid processing by selecting formulation of a processing solution, a processing temperature and conditions for stirring the processing solution or by working out a method of squeezing or drying light-sensitive materials has been proposed.

Also, quality stability of color prints is of importance as well as improvement of productivity. In general, as the processing speed becomes rapid, quality of prints changes, and hence it is important to design color photographic papers adapted for rapid processing.

In the aforesaid digital exposure system, exposure period per pixel is so short and exposure intensity is so high that improvement of properties of silver halide emulsions containing silver chloride in a high content under high-intensity exposure is important. It has been known to dope an Ir complex in order to improve high intensity reciprocity law failure of a silver chloride emulsion and obtain a contrasty gradation even under a high illumination. For example, JP-B-7-34103 discloses a technique of removing problems with latent image sensitization by providing a localized phase containing silver bromide in a high content. U.S. Pat. Nos. 5,360,712, 5,457,021 and 5,462,849 disclose that reciprocity law failure can be reduced by incorporating a metal complex having a specific organic ligand as a ligand. U.S. Pat. Nos. 5,372,926, 5,255,630, 5,255,451, 5,597,686, 5,480,771, 5,474,888, 5,500,335, 5,783,373 and 5,783,378 discloses that properties of high silver chloride emulsions such as reciprocity law properties can be improved by a combination of an Ir complex and a metal complex containing NO as a ligand. JP-A-2000-250156, JP-A-2001-92066 and JP-A-2002-31866 disclose techniques of using an Ir complex and a Rh complex in combination to obtain emulsions having excellent latent image stability after exposure.

As a result of investigations for the above-described objects on processing conventional color photographic papers with a short-time latent image period after scanning exposure, the inventor has newly found that there arises a problem of formation of stream-like unevenness. The inventor has found that formation of the stream-like unevenness can be prevented by reducing the emulsion grain size. On the other hand, it has been found that there arises another new problem that unevenness of image density of a resulting print increases. This new problem of unevenness of image density of the print is caused by a slight contamination of a color developing solution with a bleach-fixing solution. Such contamination can take place in an actual color print labo, and some improvement must be made to prevent it. Also, investigation on conducting a shorter color development processing in combination with the above-processing has revealed that there arises a problem of reduction in color density.

In the aforesaid known prior art, improvement on photographic properties in the case of processing a color photographic paper with a short-time latent image period and conducting color development in a short time has not been specifically discussed.

SUMMARY OF THE INVENTION

An object of the invention is to provide a silver halide emulsion which causes less fog, which is highly sensitive and contrasty, which suffers less change in sensitivity under different environmental conditions upon exposure, and which has an excellent latent image stability, an excellent humid abrasion resistance and excellent reciprocity law properties at high-intensity exposure, a silver halide color photographic light-sensitive material using the same, and an image-forming method.

It is another object of the invention to provide a silver halide color photographic light-sensitive material particularly adapted for color prints, which provides a high quality and a stable performance even when subjected to a super-rapid processing.

As a result of intensive investigations, the inventor has successfully attained the above-described objects by the techniques described below.

(1) A silver halide emulsion having a silver chloride content of 90 mol % or more which has been chemically sensitized with a compound capable of releasing an $Au^{I}Ch^{-}$ ion, wherein grains of the silver halide contain in the shell portion thereof 0.01 to 0.50 mol % of silver iodochloride phase per mol of the total silver, with Ch representing S, Se or Te.

(2) The silver halide emulsion as described in (1), wherein Ch represents S.

(3) The silver halide emulsion as described in (1), wherein Ch represents Se.

(4) A silver halide emulsion having a silver chloride content of 90 mol % or more which has been chemically sensitized with at least one compound selected from the group consisting of the gold-chalcogen compounds represented by the following general formula (PF1), (PF2), (PF3) or (PF4), wherein grains of the silver halide contain in the shell portion thereof 0.01 to 0.50 mol % of silver iodide per mol of the total silver:

(PF1)

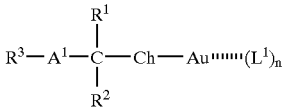

(PF2)

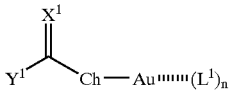

(PF3)

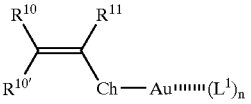

(PF4)

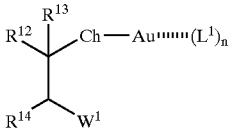

wherein Ch represents an S atom, an Se atom or a Te atom, $L^1$ represents a compound capable of coordinating with gold via an N atom, an S atom, an Se atom or a Te atom, n represents 0 or 1, $A^1$ represents O, S or $NR^4$, $R^1$ to $R^4$ each represents a hydrogen atom or a substituent, or $R^3$ may form a 5- to 7-membered ring together with $R^1$ or $R^2$, $X^1$ represents O, S or $NR^5$, $Y^1$ represents an alkyl group, an alkenyl group, an alkynyl group, an aryl group, a hetero ring group, $OR^6$, $SR^7$, or $N(R^8)R^9$, $R^5$ to $R^9$ each represents a hydrogen atom, an alkyl group, an alkenyl group, an alkynyl group, an aryl group or a hetero ring group, $X^1$ and $Y^1$ may be bound to each other to form a ring, $R^{10}$, $R^{10'}$ and $R^{11}$ each independently represents a hydrogen atom or a substituent, with at least one of $R^{10}$ and $R^{10'}$ representing an electron attractive group, $W^1$ represents an electron attractive group, and $R^{12}$ to $R^{14}$ each represents a hydrogen atom or a substituent, with $W^1$ and $R^{12}$ optionally being bound to each other to form a cyclic structure.

(5) The silver halide emulsion as described in any one of (1) to (3), wherein the compound capable of releasing $Au^{I}Ch^{-}$ ion is a compound selected from the group consisting of the compounds represented by the above general formula (PF1), (PF2), (PF3) or (PF4).

(6) The silver halide emulsion as described in any one of (1) to (4), which is chemically sensitized with at least one compound selected from the group consisting of the gold-chalcogen compounds represented by the general formula (PF1), (PF2) or (PF3).

(7) The silver halide emulsion as described in any one of (1) to (4), which is chemically sensitized with at least one compound selected from the group consisting of the gold-chalcogen compounds represented by the general formula (PF1) or (PF3).

(8) The silver halide emulsion as described in any one of (1) to (4), which is chemically sensitized with at least one compound selected from the group consisting of the gold-chalcogen compounds represented by the general formula (PF1).

(9) The silver halide emulsion as described in (1) or (4), wherein the compound capable of releasing $Au^{I}Ch^{-}$ ion is aurothioglucose ((1-thioglucopyranosato) gold).

(10) The silver halide emulsion as described in (1) or (4), wherein the compound capable of releasing $Au^{I}Ch^{-}$ ion is auro-α-thioglucose ((1-thio-α-glucopyranosato) gold).

(11) The silver halide emulsion as described in any one of (1) to (10), which contains a complex represented by the following general formula (I):

$$[IrX^{I}_{n}L^{I}_{(6-n)}]^{m} \quad \text{(I)}$$

wherein $X^{I}$ represents a halide ion or a pseudo-halide ion, $L^{I}$ represents an arbitrary ligand different from $X^{I}$, n represents 3, 4 or 5, and m represents an integer of from −5 to +1.

(12) The silver halide emulsion as described in (11), wherein the compound represented by the foregoing general formula (I) is a compound represented by the following general formula (IA):

$$[IrX^{IA}_{n}L^{IA}_{(6-n)}]^{m} \quad \text{(IA)}$$

wherein $X^{IA}$ represents a halide ion or a pseudo-halide ion, $L^{IA}$ represents an arbitrary inorganic ligand different from $X^{IA}$, n represents 3, 4 or 5, and m represents an integer of from −5 to +1.

(13) The silver halide emulsion as described in (11), wherein the metal complex represented by the foregoing general formula (I) is a compound represented by the following general formula (IB):

$$[IrX^{IB}_{n}L^{IB}_{(6-n)}]^{m} \quad \text{(IB)}$$

wherein $X^{IB}$ represents a halide ion or a pseudo-halide ion, $L^{IB}$ represents a ligand having a mother structure of a chained or cyclic hydrocarbon or a mother structure wherein part of the carbon atoms or hydrogen atoms of the hydrocarbon structure are replaced by other atom or atoms, n represents 3, 4 or 5, and m represents an integer of from −5 to +1.

(14) The silver halide emulsion as described in (11), wherein the metal complex represented by the foregoing general formula (I) is a compound represented by the following general formula (IC):

$$[IrX^{IC}_{n}L^{IC}_{(6-n)}]^{m} \quad (IC)$$

wherein $X^{IC}$ represents a halide ion or a pseudo-halide ion, $L^{IC}$ represents a 5-membered ligand having at least one nitrogen atom and at least one sulfur atom in the cyclic skeleton, with an arbitrary substituent optionally existing on the carbon atoms constituting the cyclic skeleton of the ligand, n represents 3, 4 or 5, and m represents an integer of from −5 to +1.

(15) The silver halide emulsion as described in (11), wherein the metal complex represented by the foregoing general formula (I) is a compound represented by the following general formula (ID):

$$[IrX^{ID}_{n}L^{ID}_{(6-n)}]^{m} \quad (ID)$$

wherein $X^{ID}$ represents a halide ion or a pseudo-halide ion, $L^{ID}$ represents a 5-membered ligand having at least two nitrogen atoms and at least one sulfur atom in the cyclic skeleton, with an arbitrary substituent optionally existing on the carbon atoms constituting the cyclic skeleton of the ligand, n represents 3, 4 or 5, and m represents an integer of from −5 to +1.

(16) The silver halide emulsion as described in any one of (1) to (15), which contains a complex represented by the following general formula (II):

$$[MX^{II}_{n}L^{II}_{(6-n)}]^{m} \quad (II)$$

wherein M represents Cr, Mo, Re, Fe, Ru, Os, Co, Rh, Pd or Pt, $X^{II}$ represents a halide ion, $L^{II}$ represents an arbitrary ligand different from $X^{II}$, n represents 3, 4, 5 or 6, and m represents an integer of from −4 to +1.

(17) The silver halide emulsion as described in (16), wherein in the general formula (II) representing the complex, M represents Rh and X represents Br.

(18) The silver halide emulsion as described in any one of (1) to (16), which is chemically sensitized with a selenium compound.

(19) A silver halide photographic light-sensitive material, which contains one of the silver halide emulsions described in any one of (1) to (18) above.

(20) The silver halide photographic light-sensitive material as described in (19), which is a silver halide color photographic light-sensitive material comprising a support having provided thereon photograph-constituting layers containing at least one yellow image-forming silver halide emulsion layer, at least one magenta image-forming silver halide emulsion layer, at least one cyan image-forming silver halide emulsion layer and at least one light-insensitive hydrophilic colloid layer.

(21) The silver halide color photographic light-sensitive material as described in (20), wherein grains of the silver halide in the yellow image-forming silver halide emulsion layer has an average equivalent-sphere diameter of 0.70 to 0.20 μm.

(22) The silver halide color photographic light-sensitive material as described in (20) or (21), wherein grains of the silver halide in the magenta image-forming silver halide emulsion layer and the cyan image-forming silver halide emulsion have an average equivalent-sphere diameter of 0.40 to 0.20 μm.

(23) The silver halide color photographic light-sensitive material as described in any one of (20) to (22), wherein the total amount of coated gelatin of the silver halide color photographic light-sensitive material is 6.0 to 3.0 g/m$^2$.

(24) The silver halide color photographic light-sensitive material as described in any one of (20) to (23), wherein the total amount of coated silver of the silver halide color photographic light-sensitive material is 0.50 to 0.20 g/m$^2$.

DETAILED DESCRIPTION OF THE INVENTION

We have found that gold atom and chalcogen atom in the compound to be used in the invention capable of releasing $Au^{I}Ch^{-}$ ion are strongly bound to each other and, upon preparation of an emulsion, the ion is released in a state wherein the gold atom and the chalcogen atom are strongly bound to each other, thereby photographic properties much more excellent than that attained by conventional chemical sensitization being obtained. Also, we have found that problems with photographic properties which have conventionally been difficult to solve can be solved by applying this sensitizing technique to a silver halide emulsion mainly containing silver chloride grains having silver iodide in the shell portions thereof.

Since gold atom and chalcogen atom are released upon preparation of an emulsion in a pair state wherein they are strongly bound to each other, the compound to be used in the invention which is capable of releasing $Au^{I}Ch^{-}$ ion preferably has the following structural feature. That is, the compound to be used in the invention capable of releasing $Au^{I}Ch^{-}$ is preferably a compound having "carbon atom-chalcogen atom-gold atom" bonds. The bond between the carbon atom and the chalcogen atom is a single bond, and the bond between the chalcogen atom and the gold atom is an ion bond and/or a covalent bond, thus being strong and difficultly dissociating.

On the other hand, even when gold atom and chalcogen atom are contained in one and the same molecule, the gold atom and the chalcogen atom are not necessarily released as a pair wherein they are strongly bound to each other. In case where the bond between the gold atom and the chalcogen atom is weak, the bond is liable to dissociate, and they might not possibly be released in a pair state.

A method for judging whether a particular compound is the compound capable of releasing $Au^{I}Ch^{-}$ ion or not is described below. In the invention, the term "compound capable of releasing $Au^{I}Ch^{-}$ ion" as used herein in the invention means a compound which releases $Au^{I}Ch^{-}$ ion when heated in a suitable solvent at 70° C. for 2 hours.

(A) Method for Judging Whether a Sample Compound is the Compound Capable of Releasing an Ion Having $AuS^{-}$ Structure:

A sample compound is dissolved in a proper solvent and, after adding thereto a largely excess amount of a silver nitrate solution of the compound to be judged, the resulting mixture is heated to 70° C. to react for 2 hours. Where the sample compound is a compound capable of releasing $Au^{I}Ch^{-}$ ion, a precipitate is formed. The resultant precipitate is collected by filtration. This precipitate is analyzed through powder X ray diffractiometry to confirm that the compound is AgAuS. Further, the compound is subjected to elemental analysis using ICP technique to confirm that the compound is AgAuS.

Subsequently, the amount and yield of the thus-obtained precipitate are determined. A compound which gives AgAuS in a yield of 50% or more based on reactive Ch in the substrate is judged as "the compound capable of releasing $AuS^{-}$ ion".

Additionally, in some cases, a silver complex of a sample compound is precipitated instead of forming a precipitate of AgAuS in a yield of more than 50%. Such compound is not the compound capable of releasing an ion having the $AuS^-$ structure.

In some cases, AgAuS is precipitated in a yield of more than 50% and other compound is precipitated as well. In this case, such compound is the compound to be used in the invention capable of releasing an ion having the $AuS^-$ structure.

Additionally, general-purpose gelatin to be added to an emulsion may be added to the reaction system. Also, pH of the reaction system is 12 or less, preferably 10 or less, more preferably 8 or less, most preferably 3 to 7.

(B) Additionally, Judgment of Whether a Sample Compound is the Compound Capable of Releasing an Ion Having $AuSe^-$ Structure or the Compound Capable of Releasing an Ion Having $AuTe^-$ Structure is Conducted in the Same Manner as (A) Described Above.

Here, the proper solvent is a common solvent capable of dissolving both the sample compound and silver nitrate, and is specifically water, acetonitrile, methanol, ethanol, 1,4-dioxane or a mixture thereof.

Additionally, when release of $AuS^-$ ion from a compound of the invention to be described hereinafter (aurothiomannose) was actually examined by the above-described method, a black powder of AgAuS was obtained in a yield of 95%, thus the compound being confirmed to be the compound capable of releasing an ion having $AuS^-$ structure. Also, when release of $AuSe^-$ ion from a compound of the invention of auro(peracetyl (D)-β-selenoglucose) was actually examined by the above-described method, a powder of AgAuSe was obtained in a yield of 97%, thus the compound being confirmed to be the compound capable of releasing an ion having AuSe structure.

Our way of thinking to find the above-described judging method is described below.

In the first place, $AuS^-$ ion is a chemical species which can cause a reaction of dissociating into $Au^+$ and $S^{2-}$, a reaction of binding with another $S^{2-}$ ion or $HS^-$ ion, and a reaction of forming $Au_2S$ to form a colloidal dispersion. Thus, it is difficult to purely take out $AuS^-$ ion. However, it is possible to indirectly judge release of $AuS^-$ by converting $AuS^-$ ion to a different stable chemical species. It becomes possible to examine whether $AuS^-$ ion is released or not by capturing $AuS^-$ ion with silver ion to thereby convert to stable AgAuS.

Next, the gold-chalcogen compounds to be used in the invention are described below.

The gold-chalcogen compounds to be used in the invention are represented by the general formula (PF1), (PF2), (PF3) or (PF4).

The compound in the invention capable of releasing $Au^{I}Ch^-$ is preferably selected from the group consisting of these compounds.

(PF1)

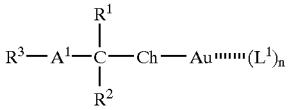

(PF2)

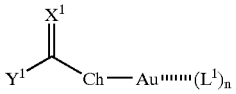

-continued (PF3)

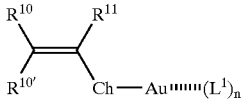

(PF4)

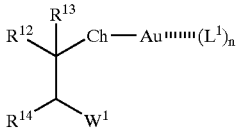

wherein Ch represents an S atom, an Se atom or a Te atom, $L^1$ represents a compound capable of coordinating with gold via an N atom, an S atom, an Se atom or a Te atom, n represents 0 or 1, $A^1$ represents O, S or $NR^4$, $R^1$ to $R^4$ each represents a hydrogen atom or a substituent, or $R^3$ may form a 5- to 7-membered ring together with $R^1$ or $R^2$, $X^1$ represents O, S or $NR^5$, $Y^1$ represents an alkyl group, an alkenyl group, an alkynyl group, an aryl group, a hetero ring group, $OR^6$, $SR^7$, or $N(R^8)R^9$, $R^5$ to $R^9$ each represents a hydrogen atom, an alkyl group, an alkenyl group, an alkynyl group, an aryl group or a hetero ring group, $X^1$ and $Y^1$ may be bound to each other to form a ring, $R^{10}$, $R^{10'}$ and $R^{11}$ each independently represents a hydrogen atom or a substituent, with at least one of $R^{10}$ and $R^{10'}$ representing an electron attractive group, $W^1$ represents an electron attractive group, and $R^{12}$ to $R^{14}$ each represents a hydrogen atom or a substituent, with $W^1$ and $R^{12}$ optionally being bound to each other to form a cyclic structure.

In the description of individual groups in the formulae (PF1) to (PF4), examples of the substituent include a halogen atom (a fluorine atom, a chlorine atom, a bromine atom or an iodine atom), an alkyl group (substituted or unsubstituted, straight, branched or cyclic alkyl group, including a bicycloalkyl group, a tricyclostructure and active methane), an alkenyl group, an alkynyl group, an aryl group, a hetero ring group (a substituted or unsubstituted, 5- to 7-membered, saturated or unsaturated hetero ring group containing at least one of N atom, O atom and S atom which may be of a single ring structure or may form a fused ring together with other aryl or hetero ring, and which is exemplified by a pyrrolyl group, a pyrrolidinyl group, a pyridyl group, a piperidyl group, a piperazinyl group, an imidazolyl group, a pyrazolyl group, a pyrazinyl group, a pyrimidinyl group, a triazinyl group, a triazolyl group, a tetrazolyl group, a quinolyl group, an isoquinolyl group, an indolyl group, an indazolyl group, a benzimidazolyl group, a pyranyl group, a chromenyl group, a thienyl group, an oxazolyl group, an oxadiazolyl group, a thiazolyl group, a thiadiazolyl group, a benzoxazolyl group, a benzothiazolyl group, a morpholino group and a morpholinyl group, with the substituting position not being limited), an acyl group, an alkoxycarbonyl group, an aryloxycarbonyl group, a hetero ring oxycarbonyl group, a carbamoyl group, an N-hydroxycarbamoyl group, an N-acylcarbamoyl group, an N-sulfonylcarbamoyl group, an N-carbamoylcarbamoyl group, a thiocarbamoyl group, an N-sulfamoylcarbamoyl group, a carbazoyl group, a carboxy group (including its salt), an oxalyl group, an oxamoyl group, a cyano group, a formyl group, a hydroxyl group, an alkoxy group (including groups repeatedly containing an ethylene oxy group unit or an propylene oxy group unit), an aryloxy group, a hetero ring oxy group, an acyloxy group, an alkoxycarbonyloxy group, an aryloxycarbonyloxy group, a carbamoyloxy group, a sulfonyloxy group, a silyloxy group, a nitro group, an amino group, an (alkyl, aryl or heterocyclic) amino group, an acylamino group, a sulfonamido group, a ureido group, a thioureido group, an N-hydroxyureido group, an imido group, an alkoxycarbonylamino group, an aryloxycarbonylamino group, a sulfamoylamino group, a semicarbazido group, a thiosemicarbazido group, a hydrazino group, an ammonio group, an oxamoylamino group, an N-(alkyl or aryl)sulfonylureido group, an N-acylureido group, an N-acylsulfamoylamino group, a hydroxyamino group, a quaternised nitrogen atom-containing hetero ring group (for example, a pyridinio group, an imidazolio group, a quinolinio group or an isoquinolinio group), an isocyano group, an imino group, a mercapto group (including its salt), an alkylthio group, an arylthio group, a hetero ring thio group, an (alkyl, aryl or heterocyclic) dithio group, an (alkyl or aryl)sulfonyl group, an (alkyl or aryl)sulfinyl group, a sulfo group (including its salt), a sulfamoyl group, an N-acylsulfamoyl group, an N-sulfonylsulfamoyl group (including its salt), a phosphino group, a phosphinyl group, a phosphinyloxy group, a phosphinylamino group and a silyl group. Additionally, the term "salt" as used herein means a salt with a cation such as an alkali metal, an alkaline earth metal or a heavy metal or an organic cation such as an ammonium ion or a phosphonium ion.

These substituents may further be substituted by these substituents.

In the formulae (PF1) to (PF4), Ch represents S atom, Se atom or Te atom and, in the invention, Ch preferably represents S atom or Se atom, with S atom being more preferred.

In formula (PF1) to (PF4), $L^1$ represents a compound capable of coordinating with gold via N atom, S atom, Se atom or Te atom. Specifically, $L^1$ represents a substituted or unsubstituted amine (preferably, a primary, secondary or tertiary alkylamine containing 1 to 30 carbon atoms or an arylamine), a 5- to 6-membered nitrogen-containing hetero ring (which means a 5- to 6-membered hetero ring composed of a combination of N, O, S and C, which may be substituted, which may coordinate with gold via N atom in the ring or via a substituent, and which is exemplified by benzotriazole, triazole, tetrazole, indazole, benzimidazole, imidazole, benzothiazole, thiazole, thiazoline, benzoxazole, benzoxazoline, oxazole, thiadiazole, oxadiazole, triazine, pyrrole, pyrrolidine, imidazolidine and morpholine), a thiol (preferably, an alkylthiol containing 1 to 30 carbon atoms, an arylthiol containing 6 to 30 carbon atoms or a 5- to 7-membered hetero ring thiol containing at least one of N atom, O atom and S atom), a thioether (preferably, a compound wherein an alkyl group containing 1 to 30 carbon atoms, an aryl group or a 5- to 7-membered hetero ring group containing at least one of N atom, O atom and S atom is bound to S atom, which may be symmetrical or non-symmetrical, and which is exemplified by a dialkylthioether, a diarylthioether, a dihetero ring thioether, an alkyl aryl thioether, an alkyl hetero ring thioether and an aryl hetero ring thioether), a disulfide (preferably, a disulfide compound wherein an alkyl group containing 1 to 30 carbon atoms, an aryl group or a hetero ring group is bound to S atom, which may be symmetrical or non-symmetrical, and which is exemplified by a dialkyldisulfide, a diaryldisulfide, a dihetero ring disulfide, an alkyl-aryl disulfide, an alkyl-hetero ring disulfide and an aryl-hetero ring disulfide, with a dialkyldisulofide, a diaryldisulfide and an alkyl-aryl disulfide being more preferred), a thioamide (wherein thioamide may be a part of a ring structure, which may be a non-cyclic thioamide, useful examples of which may be selected from those described in, for example, U.S. Pat. Nos. 4,030,925, 4,031,127, 4,080,207, 4,245,037, 4,255,511, 4,266,031 and 4,276,364, and Research Disclosure, vol. 151, November 1976, item 15162, and ibid., vol. 176, December 1978, item 17626, and which is exemplified by thiourea, thiourethane, dithiocarbamate, 4-thiazoline-2-thione, thiazolidine-2-thione, 4-oxazoline-2-thione, oxazolidine-2-thione, 2-pyrazoline-5-thione, 4-imidazoline-2-thione, 2-thiohydantoin, rhodanine, isorhodanine, 2-thio-2,4-oxazolinedione, thiobarbituric acid, tetrazolin-5-thione, 1,2,4-triazine-3-thione, 1,3,4-thiadiazoline-2-thione, 1,3,4-oxadiazoline-2-thione, benzimidazoline-2-thione, benzoxazoline-2-thione and benzothiazoline-2-thione which may be substituted), a selenol (preferably, an alkylselenol containing 1 to 30 carbon atoms, an arylselenol or a 5- to 7-membered hetero ring selenol containing at least one of N atom, O atom and S atom in the ring), a selenoether (preferably, a selenoether compound wherein an alkyl group containing 1 to 30 carbon atoms, an aryl group or a heterocyclic group is bound to Se atom, which may be symmetrical or non-symmetrical with respect to Se atom, and which is exemplified by a dialkyl selenoether, a diaryl selenoether, a diheterocyclic selenoether, alkyl aryl selenoether, an alkyl hetero ring selenoether and an aryl hetero ring selenoether, with a dialkyl selenoether, a diaryl selenoether and an alkyl aryl selenoether being preferred), a diselenide (preferably, a diselenide compound wherein an alkyl group containing 1 to 30 carbon atoms, an aryl group or a hetero ring group is boud to Se atom, which may be symmetrical or non-symmetrical with respect to diselenide group, and which is exemplified by a dialkyldiselenide, a diaryldiselenide, a dihetero ring diselenide, an alkyl-aryl diselenide, an alkyl-hetero ring diselenide and an aryl-hetero ring diselenide, with an dialkyldiseloenide, a diaryldiselenide and an alkyl-aryl diselenide being preferred), a selenoamide (exemplified by those of the aforesaid thioamide compounds wherein S atom is replaced by Se atom), a tellulol (exemplified by those of the aforesaid selenol compounds wherein Se atom is replaced by Te atom), a telluloether (exemplified by those of the selenoether compounds wherein Se atom is replaced by Te atom), a ditellulide (exemplified by those of the aforesaid diselenide compounds wherein Se atom is replaced by Te atom), or a telluloamide (exemplified by those of the aforesaid thioamide compounds wherein Se atom is replaced by Te atom).

$L^1$ is preferably a 5- to 6-membered, nitrogen-containing hetero ring, a thiol, a thioether, a thioamide, a selenoether or a selenoamide, more preferably, a 5- to 6-membered, nitrogen-containing hetero ring, a thiol, a thioether or a thioamide, most preferably, a thiol, a thioether or a thioamide.

n represents 0 or 1, preferably 0.

$R^1$ and $R^2$ each preferably represents a hydrogen atom, an alkyl group, an aryl group, a hetero ring group, a hydroxyl group, an alkoxy group, an aryloxy group, a hetero ring oxy group, an amino group, a mercapto group, an alkylthio group, an arylthio group or a hetero ring thio group, more preferably a hydrogen atom, an alkyl group, an aryl group or a hetero ring group, most preferably a hydrogen atom or an alkyl group.

$R^3$ preferably represents a hydrogen atom, an alkyl group or a hetero ring group, more preferably an alkyl group, an aryl group or a hetero ring group, most preferably an alkyl group or an aryl group. $R^4$ preferably represents a hydrogen atom, an alkyl group, an alkenyl group, an alkynyl group, an aryl group, a hetero ring group, an amino group, an acylamino group, an alkyl or arylsulfonylamino group, an alkyl or arylsulfonyl group, an acyl group, an aryloxycarbonyl group, an alkoxycarbonyl group or a carbamoyl group, more preferably a hydrogen atom, an alkyl group or a hetero ring group.

$R^3$ may form a 5- to 7-membered ring structure together with $R^1$ or $R^2$. The ring structure to be formed is a non-aromatic, oxygen-, sulfur- or nitrogen-containing hetero ring. Also, this ring structure may form a fused ring together with an aromatic or non-aromatic carbon ring or a hetero ring. In the invention, it is more preferred for $R^3$ to form the 5- to 7-membered ring structure together with $R^1$ or $R^2$.

In the invention, among the compounds represented by the formula (PF1), preferred are those wherein Ch represents S or Se, $A^1$ represents O, S or $NR^4$, $R^1$ and $R^2$ each represents a hydrogen atom, an alkyl group, an aryl group, a hetero ring group, an alkoxy group, an aryloxy group, a hetero ring oxy group, an alkylthio group, an arylthio group or a hetero ring thio group, $R^3$ represents a hydrogen atom, an alkyl group, an aryl group or a hetero ring group, $R^4$ represents a hydrogen atom, an alkyl group, an aryl group, a hetero ring group, an amino group, an acylamino group, an alkyl or arylsulfonylamino group, an alkyl or arylsulfonyl group or an acyl group, n represents 0 or 1 and, when n represents 1, $L^1$ represents a thiol, a thioether, a thioamide or a 5- to 6-membered, nitrogen-containing hetero ring. More preferred are those wherein Ch represents S or Se, $A^1$ represents O or S, $R^1$ and $R^2$ each represents a hydrogen atom, an alkyl group, an aryl group or a hetero ring, $R^3$ represents an alkyl group, an aryl group or a hetero ring group, and n represents 0 or 1. In the case where n represents 1, $L^1$ represents a thiol, a thioether or a thioamide. Still more preferred are those wherein Ch represents S, $A^1$ represents O or S, $R^1$ and $R^2$ each represents a hydrogen atom, an alkyl group or an aryl group, $R^3$ represents an alkyl group or an aryl group, and n represents 0. Particularly preferred are those wherein $R^3$ forms a ring structure of a sugar derivative together with $R^1$ or $R^2$ such as glucose, mannose, galactose, gulose, xylose, lyxose, arabinose, ribose, fucose, idose, talose, allose, altrose, rhamnose, sorbose, digitoxose, 2-deoxyglucose, 2-deoxygalactose, fructose, glucosamine, galactosamine or glucuronic acid (in the case where $A^1$ in the formula (PF1) represents O) and the sulfur analogue thereof (in the case where $A^1$ in the formula (PF1) represents S). In these sugar structures, there exist α-isomers and β-isomers which are different from each other in the 1-position steric structure and D-isomers and L-isomers which are in a relation of mirror image with each other. In the invention, however, these isomers are not discriminated from each other. In this case, examples of preferred compounds include aurothioglucose, aurothionannose, aurothiogalactose, aurothiolyxose, auroselenoglucose, auroselenomannose, auroselenogalactose, auroselenolyxose and aurotelluroglucose.

In the formula (PF2), $X^1$ preferably represents O or S, more preferably O. $Y^1$ preferably represents an alkyl group containing 1 to 30 carbon atoms, an alkenyl group, an alkynyl group, an aryl group, a 5- to 7-membered hetero ring group containing at least one of N atom, O atom and S atom, $OR^6$, $SR^7$ or $N(R^8)R^9$, preferably an alkyl group, an aryl group, a hetero ring group, $OR^6$, $SR^7$ or $N(R^8)R^9$, more preferably an alkyl group, an aryl group, a hetero ring group or $N(R^8)R^9$, still more preferably an alkyl group, an aryl group or a hetero ring group. $R^5$ to $R^9$ each represents a hydrogen atom, an alkyl group, an alkenyl group, an alkynyl group, an aryl group or a hetero ring group, preferably a hydrogen atom, an alkyl group, an aryl group or a hetero ring group, more preferably an alkyl group or an aryl group.

In the formula (PF2), $X^1$ and $Y^1$ may be bound to each other to form a ring. In this case, the ring is a 3- to 7-membered, nitrogen-containing hetero ring, and examples thereof include a pyrrole ring, an indole ring, an imidazole ring, a benzimidazole ring, a thiazole ring, a benzothiazole ring, an isoxazole ring, an oxazole ring, a benzoxazole ring, an indazole ring, a purine ring, a pyridine ring, a pyrazine ring, a pyrimidine ring, a quinoline ring and a quinazoline ring.

Of the compounds represented by the formula (PF2), preferred compounds are those wherein Ch represents S or Se, $X^1$ represents O or S, $Y^1$ represents an alkyl group, an aryl group, a hetero ring group, $OR^6$, $SR^7$ or $N(R^8)R^9$, $R^6$ to $R^9$ each represents an alkyl group, an aryl group or a hetero ring group, and n represents 0 or 1. In the case where n represents 1, $L^1$ represents a thiol, a thioether, a thioamide or a 5- to 6-membered, nitrogen-containing hetero ring. Still more preferred are those wherein Ch represents S or Se, $X^1$ represents O, $Y^1$ represents an alkyl group, an aryl group or a hetero ring group, and n represents 0 or 1. In the case where n represents 1, $L^1$ represents a thiol, a thioether or a thioamide. Most preferred are those wherein Ch represents S, $X^1$ represents O, $Y^1$ represents an alkyl group, an aryl group or a hetero ring group, and n represents 0.

In the formula (PF3), at least one of $R^{10}$ and $R^{10'}$ represents an electron attractive group. The term "electron attractive group" as used herein means a substituent having a positive Hammett's substituent constant $\sigma_p$ value, preferably a $\sigma_p$ value of 0.2 or more, with the upper limit being 1.0. Specific examples of the electron attractive group having a $\sigma_p$ value of 0.2 or more include an acyl group, a formyl group, an acyloxy group, an acylthio group, a carbamoyl group, an alkoxycarbonyl group, an aryloxycarbonyl group, a cyano group, a nitro group, a dialkylphosphono group, diarylphosphono group, a dialkylphosphinyl group, a diarylphosphinyl group, a phosphoryl group, an alkylsulfinyl group, an arylsulfinyl group, an alkylsulfonyl group, an arylsulfonyl group, a sulfonyloxy group, an acylthio group, a sulfamoyl group, a thiocyanato group, a thiocarbonyl group, an imino group, an imino group substituted by N atom, a carboxy group (or its salt), an alkyl group substituted by at least two halogen atoms, an alkoxy group substituted by at least two halogen atoms, an aryloxy group substituted by at least two halogen atoms, an acylamino group, an alkylamino group substituted by at least two halogen atoms, an alkylthio group substituted by at least two halogen atoms, an aryl group substituted by other electron attractive group having a $\sigma_p$ value of 0.2 or more, a hetero ring group, a halogen atom, an azo group and a selenocyanato group. In the invention, $W^1$ preferably represents an acyl group, a formyl group, a carbamoyl group, an alkoxycarbonyl group, an aryloxycarbonyl group, a cyano group, a dialkylphosphono group, a diarylphosphono group, a dialkylphosphinyl group, a diarylphosphinyl group, an alkylsulfinyl group, an arylsulfinyl group, an alkylsulfonyl group, an arylsulfonyl group, a sulfamoyl group, a thiocarbonyl group, an imino group, an imino group substituted by N atom, a phosphoryl group, a carboxy group (or its salt), an alkyl group substituted by at least two halogen atoms, an aryl group substituted by other electron attractive group having a $\sigma_p$ value of 0.2 or more, a hetero ring group or a halogen atom, more preferably, an acyl group, a carbamoyl group, an alkoxycarbonyl group, an aryloxycarbonyl group, a cyano group, a carboxy group, an alkyl group substituted by at least two halogen atoms, an aryl group substituted by other electron attractive group having a $\sigma_p$ value of 0.2 or more or a hetero ring group.

In the formula (PF3), both $R^{10}$ and $R^{10'}$ preferably represent electron attractive groups. $R^{11}$ preferably represents a hydrogen atom, an alkyl group, an aryl group, a hetero ring group, an alkoxy group, an aryloxy group, a hetero ring oxy group, an amino group, an acylamino group, an alkylthio group, an arylthio group, a hetero ring thio group, an alkyl or arylsulfonyl group, an acyl group, an aryloxycarbonyl group, an alkoxycarbonyl group or a carbonyl group, more preferably, a hydrogen atom, an alkyl group, an aryl group, a hetero ring group, an alkoxy group, an aryloxy group, a hetero ring oxy group, an amino group or an acylamino group.

In the formula (PF3), $R^{10}$ $R^{10'}$ and $R^{11}$ are also preferably bound to each other to form a ring. The ring to be formed is a non-aromatic carbon ring or hetero ring, and is preferably 5- to 7-membered ring. $R^{10}$ forming the ring is preferably an acyl group, a carbamoyl group, an oxycarbonyl group, a thiocarbonyl group or a sulfonyl group, $R^{10'}$ is preferably an acyl group, a carbamoyl group, an oxycarbonyl group, a thiocarbonyl group, a sulfonyl group, an imino group, animino group substituted by N atom, an acylamino group or a carbonylthio group.

Of the compounds represented by the formula (PF3), preferred are those wherein Ch represents S or Se, $R^{10}$ and $R^{10'}$ both represent electron attractive groups, $R^{11}$ represents a hydrogen atom, an alkyl group, an aryl group, a hetero ring group, an alkoxy group, an aryloxy group, a hetero ring oxy group, an amino group or an acylamino group, and n represents 0 or 1. In the case where n represents 1, $L^1$ represents a thioether, a thioamide or a 5- to 6-membered, nitrogen-containing hetero ring. More preferred are those wherein Ch represents S or Se, $R^{10}$ and $R^{10'}$ both represent electron attractive groups, $R^{11}$ represents a hydrogen atom, an alkyl group, an aryl group or a hetero ring group, and n represents 0 or 1. In the case where n represents 1, $L^1$ represents a thioether or a thioamide. Most preferred are those wherein Ch represents S, $R^{10}$ and $R^{10'}$ both represent electron attractive groups, $R^{11}$ represents a hydrogen atom, an alkyl group, an aryl group or a hetero ring group, and n represents 0.

Also, of the compounds represented by the formula (PF3), those wherein $R^{10}$ and $R^{10'}$ form a 5- to 7-membered non-aromatic ring are also preferred. In this case, Ch represents S or Se, $R^{11}$ represents a hydrogen atom, an alkyl group, an aryl group, a hetero ring group, an alkoxy group, an aryloxy group, a hetero ring oxy group, an amino group or an acylamino group, and n represents 0 or 1. In the case where n represents 1, those compounds wherein $L^1$ represents a thioether, a thioamide or a 5- to 6-membered, nitrogen-containing hetero ring are also preferred. More preferred are those wherein $R^{10}$ and $R^{10'}$ form a 5- to 7-membered non-aromatic ring, Ch represents S or Se, $R^{11}$ represents a hydrogen atom, an alkyl group, an aryl group or a hetero ring group, and n represents 0 or 1. In the case where n represents 1, $L^1$ represents a thioether or a thioamide. Most preferred are those compounds wherein Ch represents S, $R^{10}$ and $R^{10'}$ form a 5- to 7-membered non-aromatic ring, $R^{11}$ represents a hydrogen atom, an alkyl group, an aryl group or a hetero ring group, and n represents 0.

In the formula (PF4), the electron attractive group represented by $W^1$ is the same as the electron attractive group represented by the foregoing $R^{10}$ and $R^{10'}$ and its preferred scope is also the same.

In the formula (PF4), preferred examples of $R^{12}$ to $R^{14}$ include a hydrogen atom, a halogen atom, an alkyl group, an alkenyl group, an alkynyl group, an aryl group, a hetero ring group, a cyano group, a hydroxyl group, a carboxy group, an alkoxy group, an aryloxy group, a hetero ring oxy group, an acyloxy group, an amino group, an acylamino group, an alkyl or arylsulfonylamino group, an alkylthio group, an arylthio group, a hetero ring thio group, a sulfamoyl group, a sulfo group, an alkyl or arylsulfonyl group, an acyl group, an aryloxycarbonyl group, an alkoxycarbonyl group, a carbamoyl group and an imido group. More preferred examples thereof include a hydrogen atom, a halogen atom, an alkyl group, an alkenyl group, an alkynyl group, an aryl group, a hetero ring group, a cyano group, a hydroxyl group, a carboxy group, an alkoxy group, an aryloxy group, a hetero ring oxy group, an acyloxy group, an amino group, an acylamino group, an alkylthio group, an arylthio group, a hetero ring thio group, a sulfo group, an alkyl or arylsulfonyl group, an acyl group, an aryloxycarbonyl group, an alkoxycarbonyl group and a carbamoyl group.

$W^1$ and $R^{12}$ may be bound to each other to form a ring. The ring to be formed is a non-aromatic hydrocarbon ring or a hetero ring, preferably, a 5- to 7-membered ring. $W^1$ forming the ring is preferably an acyl group, a carbamoyl group, an oxycarbonyl group, a thiocarbonyl group or a sulfonyl group, and $R^{12}$ is preferably an alkyl group, an alkenyl group, an aryl group or a hetero ring group.

Of the compounds represented by the formula (PF4), preferred are those compounds wherein Ch represents S or Se, $W^1$ represents an electron attractive group, $R^{12}$ to $R^{14}$ each represents a hydrogen atom, a halogen atom, an alkyl group, an alkenyl group, an alkynyl group, an aryl group, a hetero ring group, a cyano group, a hydroxyl group, a carboxy group, an alkoxy group, an aryloxy group, a hetero ring oxy group, an acyloxy group, an amino group, an acylamino group, an alkylthio group, an arylthio group, a hetero ring thio group, a sulfo group, an alkyl or arylsulfonyl group, an acyl group, an aryloxycarbonyl group, an alkoxycarbonyl group or a carbamoyl group, and n represents 0 or 1. In the case where n represents 1, $L^1$ represents a thioether, a thioamide or a 5- to 6-membered nitrogen-containing hetero ring. More preferred are those compounds wherein Ch represents S or Se, $W^1$ represents an electron attractive group, $R^{12}$ to $R^{14}$ each represents a hydrogen atom, a halogen atom, an alkyl group, an alkenyl group, an aryl group, a hetero ring group, a cyano group, a hydroxyl group, a carboxy group, an alkoxy group, an aryloxy group, a hetero ring oxy group, an acyloxy group, an amino group, an acylamino group, an alkylthio group, an arylthio group, a hetero ring thio group, a sulfo group, an alkyl or arylsulfonyl group, an acyl group, an aryloxycarbonyl group, an alkoxycarbonyl group or a carbamoyl group, and n represents 0 or 1. In the case where n represents 1, $L^1$ represents a thioether or a thioamide. Most preferred are those compounds wherein Ch represents S or Se, $W^1$ represents an electron attractive group, $R^{12}$ to $R^{14}$ each represents a hydrogen atom, a halogen atom, an alkyl group, an alkenyl group, an alkynyl group, an aryl group, a hetero ring group, a cyano group, a hydroxyl group, a carboxy group, an alkoxy group, an aryloxy group, a hetero ring oxy group, an acyloxy group, an amino group, an acylamino group, an alkylthio group, an arylthio group, a hetero ring thio group, a sulfo group, an alkyl or arylsulfonyl group, an acyl group, an aryloxycarbonyl group, an alkoxycarbonyl group or a carbamoyl group, and n represents 0.

Also, of the compounds represented by the formula (PF4), those compounds wherein $W^1$ and $R^{12}$ are bound to each other to form a non-aromatic 5- to 7-membered ring are preferred as well. In this case, Ch represents S or Se, $R^{12}$ represents an alkyl group, an alkenyl group, an aryl group, a hetero ring group or the like, $R^{13}$ and $R^{14}$ each represents a hydrogen atom, a halogen atom, an alkyl group, an alkenyl group, an alkynyl group, an aryl group, a hetero ring group, a cyano group, a hydroxyl group, a carboxy group, an alkoxy group, an aryloxy group, a hetero ring oxy group, an acyloxy group, an amino group, an acylamino group, an alkylthio group, an arylthio group, a hetero ring thio group, a sulfo group, an alkyl or arylsulfonyl group, an acyl group, an aryloxycarbonyl group, an alkoxycarbonyl group or a carbamoyl group, and n represents 0 or 1. In the case where n represents 1, $L^1$ preferably represents a thioether, a thioamide or a 5- to 6-membered nitrogen-containing hetero ring. More preferred are those compounds wherein Ch represents S or Se, $W^1$ and $R^{12}$ are bound to each other to form a non-aromatic 5- to 7-membered ring, $R^{13}$ and $R^{14}$ each represents a hydrogen atom, a halogen atom, an alkyl group, an alkenyl group, an alkynyl group, an aryl group, a hetero ring group, a cyano group, a hydroxyl group, a carboxy group, an alkoxy group, an aryloxy group, a hetero ring oxy group, an acyloxy group, an amino group, an acylamino group, an alkylthio group, an arylthio group, a hetero ring thio group, a sulfo group, an alkyl or arylsulfonyl group, an acyl group, an aryloxycarbonyl group, an alkoxycarbonyl group or a carbamoyl group, and n represents 0 or 1. In the case where n represents 1, $L^1$ represents a thioether or a thioamide. Most preferred are those compounds wherein Ch represents S, $W^1$ and $R^{12}$ are bound to each other to form a non-aromatic 5- to 7-membered ring, $R^{13}$ and $R^{14}$ each represents a hydrogen atom, a halogen atom, an alkyl group, an alkenyl group, an alkynyl group, an aryl group, a hetero ring group, a cyano group, a hydroxyl group, a carboxy group, an alkoxy group, an aryloxy group, a hetero ring oxy group, an acyloxy group, an amino group, an acylamino group, an alkylthio group, an arylthio group, a hetero ring thio group, a sulfo group, an alkyl or arylsulfonyl group, an acyl group, an aryloxycarbonyl group, an alkoxycarbonyl group or a carbamoyl group, and n represents 0.

Of the compounds represented by the general formulae (PF1) to (PF4), preferred compounds are those represented by the general formulae (PF1), (PF2) and (PF3), more preferred are those represented by the general formulae (PF1) and (PF3), most preferred are those represented by the general formula (PF1).

Next, specific examples of the compounds represented by the general formulae (PF1) to (PF4) are shown below which, however, do not limit the invention. Also, as to compounds with which a plurality of steric isomers exist, they do not limit the steric structures thereof.

P1-1A
P1-1B
P1-1c

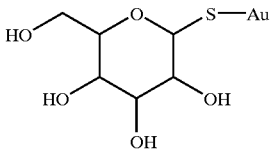

P1-2

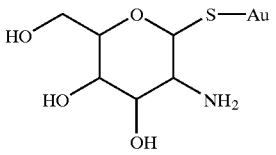

P1-3

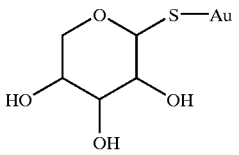

-continued

P1-4

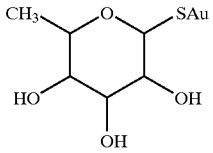

P1-5

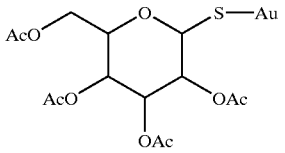

P1-6

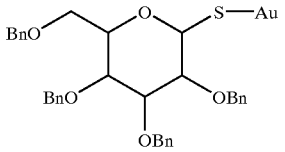

P1-7

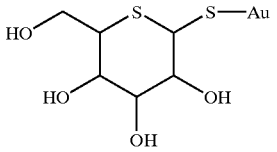

P1-8

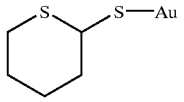

P1-9

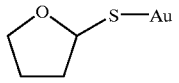

P1-10

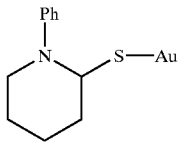

P1-11

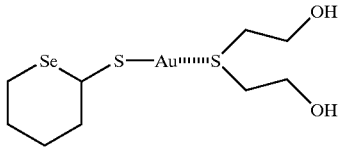

P1-12

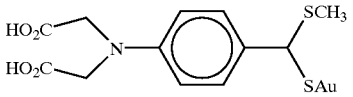

P1-13

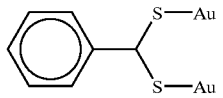

P1-14

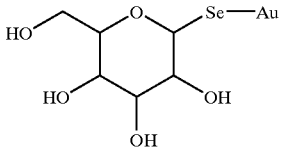

-continued
P1-15
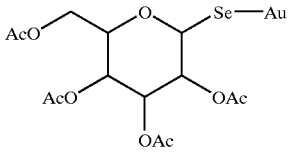
P1-16
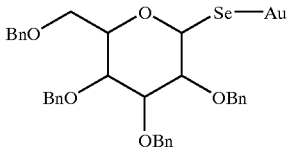
P1-17
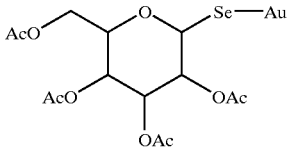
P1-18
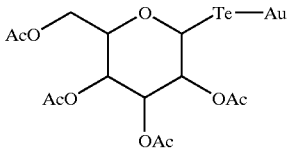
P2-1
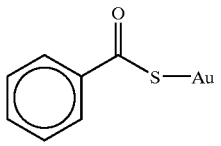
P2-2
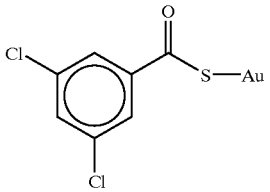
P2-3
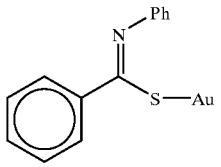
P2-4
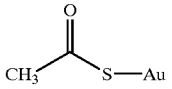
P2-5
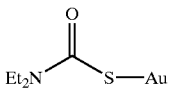
P2-6
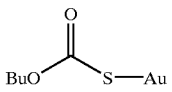
-continued
P2-7
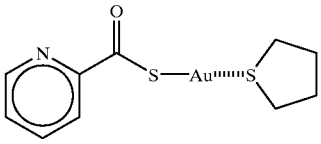
P2-8
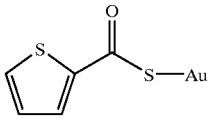
P2-9
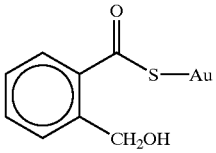
P2-10
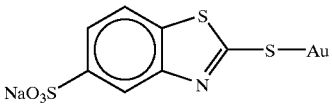
P2-11
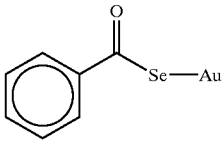
P2-12
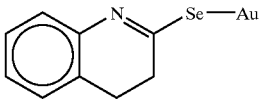
P2-13
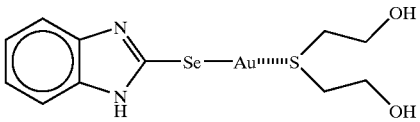
P2-14
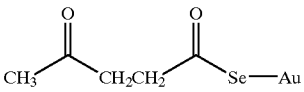
P2-15
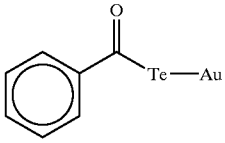
P3-1
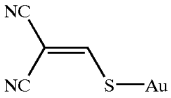
P3-2
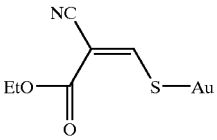

-continued
P3-3
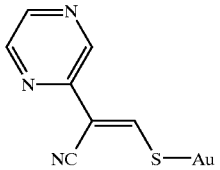
P3-4
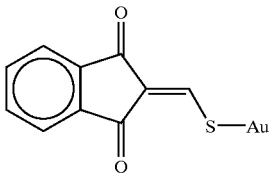
P3-5
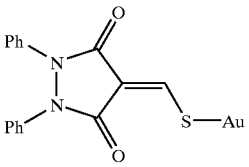
P3-6
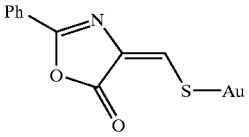
P3-7
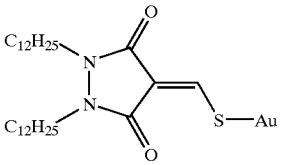
P3-8
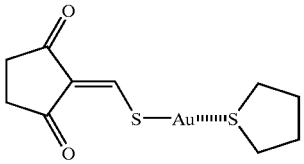
P3-9
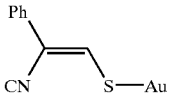
P3-10
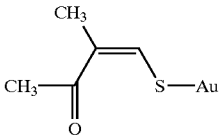
P3-11
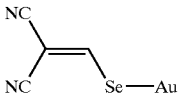
P3-12
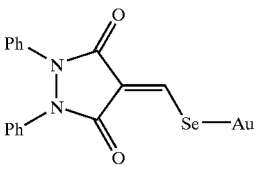
-continued
P3-13
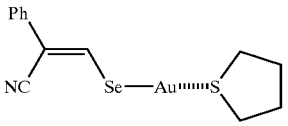
P3-14
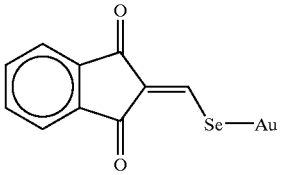
P3-15
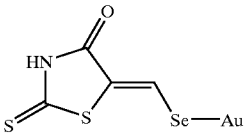
P3-16
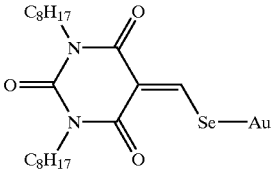
P3-17
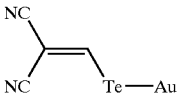
P4-1
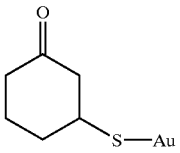
P4-3
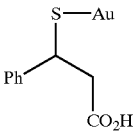
P4-5
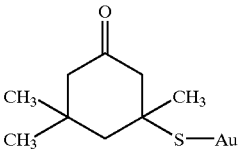
P4-6
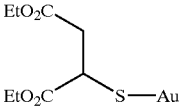
P4-7
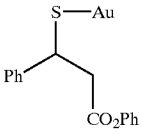

-continued

P4-8

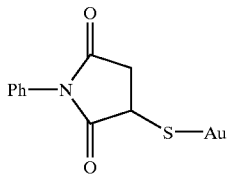

P4-9

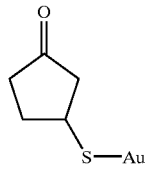

P4-10

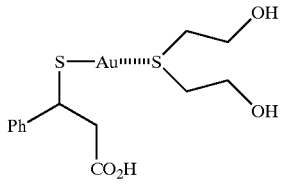

P4-12

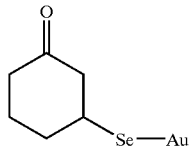

P4-13

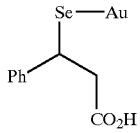

P4-14

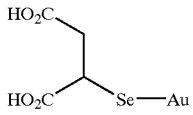

P4-15

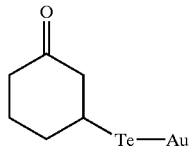

The addition amount of the gold compound to be used in the invention widely varies depending upon the cases, but is $1\times10^{-7}$ to $1\times10^{-3}$ mol, preferably $1\times10^{-6}$ to $5\times10^{-4}$ mol, more preferably $5\times10^{-6}$ to $1\times10^{-4}$, per mol of silver halide.

The compounds represented by the general formulae (PF1) to (PF4) may be dissolved in water, an alcohol (such as methanol or ethanol), a ketone (such as acetone) an amide (such as dimethylfomamide), a glycol (such as methylpropylene glycol) or an ester (such as ethyl acetate) to add, or may be added as a solid dispersion (fine crystal dispersion) prepared by a known dispersing method.

Addition of the compounds of the invention represented by the general formulae (PF1) to (PF4) may be conducted at any stage in the production of the emulsion, but is preferably conducted after formation of silver halide grains and before completion of the chemically sensitizing step.

Next, a process for synthesizing the compound to be used in the invention which can release an ion having the $Au^{I}Ch^{-}$ structure.

Synthesis of an illustrative compound P1-1A (auro-D-thioglucose) can be conducted according to the following literature. P. Lebeau and M. M. Janot, *TRAITE DE PHARMACIE CHEMIQUE,* item 661 (published in 1951). An illustrative compound P1-1B (aurothiomannose) can be synthesized according to the above-described process except for using thiomannose in place of thioglucose.

Also, an illustrative compound P1-1C (auro-(D)-α-thioglucose) can be synthesized by synthesizing 1-thio-α-D-glucose according to the following literature, followed by the conventional process for synthesizing an Au(I) salt of a mercapto compound from the mercapto compound.

Organic Letter, vol.3, No.3, p.405, published in 2001.

Carbohydrate Research, vol. 200, p.497, published in 1990.

Also, other compounds may be synthesized according to a conventional process for synthesizing an Au(I) salt of a mercapto compound. That is, in order to obtain an Au(I) salt, a corresponding mercapto compound is firstly synthesized. Then, an easily available Au(III) compound (such as $AuBr_3$ or $NaAuCl_3$) is reduced to Au(I) with, for example, 2,2'-thiodiethanol, followed by reacting it with the former mercapto compound. A corresponding Se homologue or a corresponding Te homologue can be obtained by using a Se compound or a Te compound in place of the mercapto compound. However, as is well known as properties of Se compounds and Te compounds, selenols and tellurols are liable to be oxidized to diselenides or ditellurides. Hence, a process of once obtaining diselenides or ditellurides, then reducing them, and immediately reacting with Au(I) may be utilized as well.

A specific synthesizing process is illustrated below.

(Specific Process for Synthesizing an Illustrative Compound P1-15)

The illustrative compound P1-15 (auro(peracetyl-β-D-selenoglucose)) was synthesized according to the following scheme 1.

Scheme 1:

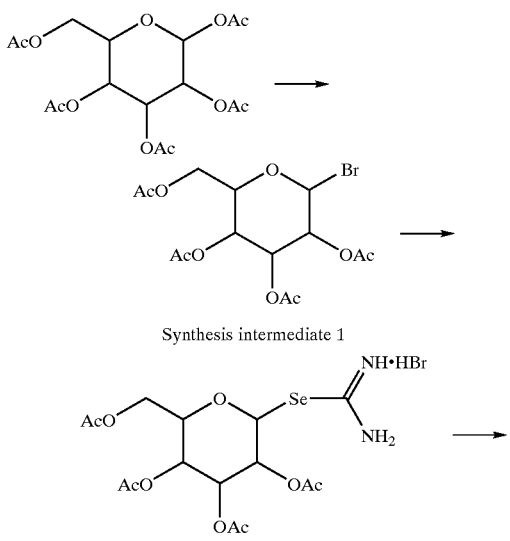

-continued

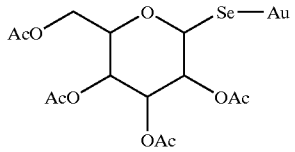

Illustrative compound P1–15

(Synthesis of Synthesis Intermediate 1)

25 g of a 30% hydrogen bromide solution in acetic acid was added to a solution of 13 g of pentaacetyl-β-D-glucose in 60 ml of methylene chloride. After stirring overnight at room temperature, 100 ml of ice water and 100 ml of methylene chloride were added thereto, followed by separation. The aqueous layer was discarded, and the organic layer was washed with 30 ml of a saturated aqueous solution of sodium hydrogencarbonate and 30 ml of a saturated aqueous solution of sodium chloride, dried over sodium sulfate, then concentrated under reduced pressure. To the thus-obtained oily product was added 60 ml of ethanol, and crystals thus precipitated were collected by filtration to obtain 11 g of a synthesis intermediate 1.

(Synthesis of Synthesis Intermediate 2)

10.5 g of the synthesis intermediate 1 and 3.1 g of selenourea were added to 100 ml of acetone, followed by refluxing under heating for 1 hour. The reaction solution was cooled with ice, and crystals thus precipitated were collected by filtration to obtain 9 g of the synthesis intermediate 2.

(Synthesis of Illustrative Compound P1-15)

20.8 g of the synthesis intermediate was dissolved in 8 ml of water and, under cooling with ice, an aqueous solution of 204 mg of potassium carbonate in 8 ml of water was dropwise added thereto. Thereafter, a solution of 474 mg of gold chloride-tetrahydrothiophene complex in 30 ml of acetone was added thereto. Crystals thus precipitated were collected by filtration to obtain 0.8 g of the illustrative compound P1-15.

In the invention, judgment whether a sample compound is a compound capable of releasing an ion having $Au^{I}Ch^{-}$ structure is conducted by using 100 mols of silver nitrate per mol of the sample compound and heating to 50° C. for 30 minutes. A sample compound giving a precipitate of AgAuS in a yield of more than 50% is judged to be the compound.

A sample compound giving a precipitate of AgAuS in a yield of more than 50% when heated with 10000 mols of silver nitrate per mol of the sample compound at 50° C. for 30 minutes is more preferred.

A sample compound giving a precipitate of AgAuS in a yield of more than 50% when heated with 1000000 mols of silver nitrate per mol of the sample compound at 50° C. for 30 minutes is still more preferred.

A sample compound giving a precipitate of AgAuS in a yield of more than 50% when heated with 100000000 mols of silver nitrate per mol of the sample compound at 50° C. for 30 minutes is most preferred.

Also, in the invention, it is preferred to use a compound capable of releasing an ion having $Au^{I}S^{-}$ structure and/or a compound capable of releasing an ion having $Au^{I}Se^{-}$ structure. It is particularly preferred to use a compound capable of releasing an ion having $Au^{I}Se^{-}$ structure.

The sensitizing method of the invention using the gold compound may be combined with other sensitizing methods such as sulfur sensitization, selenium sensitization, tellurium sensitization, reduction sensitization, or with other gold sensitization or noble metal sensitization using other compound than gold compounds.

In the invention, independent sensitization with the gold compound of the invention and sensitization combined with sulfur sensitization and selenium sensitization are preferred.

The silver halide emulsion of the invention contains specific silver halide grains. Forms of the grains are not particularly limited, but preferably comprise crystal grains of cubic or tetradecahedral form substantially having {100} faces (optionally having round gain peaks and having higher faces), crystal grains of octahedral form or tabular grains of 3 or more in aspect ratio having main surfaces of {100} faces or {111} faces. The term "aspect ratio" as used herein means a value obtained by dividing the diameter of a circle equivalent to the projected area by the thickness of the grain.

As the silver halide emulsion of the invention, an emulsion is used which contains silver halide grains of 90 mol % or more in silver chloride content. In view of rapid processing, the silver chloride content is preferably 93 mol % or more, more preferably 95 mol % or more. Since contrasty properties and excellent latent image stability are desired, silver bromide content is preferably 0.1 to 7 mol %, more preferably 0.5 to 5 mol %.

The specific silver halide grains in the silver halide emulsion of the invention have a silver iodide-containing phase in the shell portions thereof. Since high sensitivity and contrasty properties at high intensity exposure are desired, the silver iodide content is preferably 0.01 to 0.5 mol %, more preferably 0.05 to 0.50 mol %, most preferably 0.07 to 0.40 mol %. Here, the term "shell portion" means the portion 50% or more outside of grain volume when measured from inside. Also, the grains may further have a silver bromide-containing phase. Here, the term "silver bromide-containing phase" or "silver iodide-containing phase" means a portion which has a higher silver bromide or silver iodide content than other portion. The halide composition between the silver bromide- or silver iodide-containing phase and the surrounding portion may change continuously or sharply. Such silver bromide- or silver iodide-containing phase may form a layer of an almost definite concentration with a certain width in a certain position within the grains, or may be a maximum spot without an extent. The local silver bromide content of the silver bromide-containing phase is preferably 5 mol % or more, more preferably 10 to 80 mol %, most preferably 15 to 50 mol %. The local silver iodide content of the silver iodide-containing phase is preferably 0.3 mol % or more, more preferably 0.5 to 8 mol %, most preferably 1 to 5 mol %. Also, such silver bromide- or silver iodide-containing phase may exist as a plurality of layers within the grains, and the layers may different from each other in the silver bromide content or silver iodide content.

It is of importance that the silver bromide- or silver iodide-containing phase of the silver halide emulsion of the invention exists in a layer form surrounding the grains. It is one preferred embodiment that the silver bromide- or silver iodide-containing phase formed in a layer form surrounding the grains has a uniform concentration distribution in the individual phases in a surrounding direction. However, the silver bromide- or silver iodide-containing phase existing in a layer form surrounding the grains may have a concentration distribution wherein spots with the maximum or minimum concentration of silver bromide or silver iodide exist in the surrounding direction of the grains. For example, in the case where the silver iodide- or silver iodide-containing phase exists in a layer form surrounding the grains in the vicinity of the surface of the grains, the silver bromide concentration or the silver iodide concentration at grain corners or edges may sometimes becomes different from that of the main surface. Also, a silver bromide- or silver iodide-containing phase not surrounding the grains may exist in a specific portion of the surface in a completely isolated state in addition to the silver bromide- or silver iodide-containing layer in a layer form surrounding the grains.

In the case where the silver halide emulsion of the invention contains the silver bromide-containing phase, the silver bromide-containing phase is formed preferably in a layer form so that the concentration maximum of silver bromide exists in the interior of the grains. Also, the silver iodide-containing phase is formed preferably in a layer form so that the concentration maximum of silver bromide exists in the surface of the grains. Such silver bromide- or silver iodide-containing phase is preferably constituted by 3% to 30%, more preferably 3% to 15%, amount of silver based on the grain volume in view of raising local concentration of silver bromide or silver iodide using less amount thereof.

The silver halide emulsion of the invention preferably has both the silver bromide-containing phase and the silver iodide-containing phase. In this case, the silver bromide-containing phase and the silver iodide-containing phase may exist at the same position in the grains or at different positions in the grains, but existence thereof at different positions is preferred in view of facilitating control of grain formation. Also, the silver bromide-containing phase may contain silver iodide or, to the contrary, the silver iodide-containing phase may contain silver bromide. In general, an iodide added during formation of high silver chloride grains is more liable to migrate to the grain surface than a bromide, and hence silver iodide-containing phase is liable to be formed in the vicinity of the grain surface. Hence, in the case where the silver bromide-containing phase and the silver iodide-containing phase exist in different positions within the grains, it is preferred to form the silver bromide-containing phase inside the silver iodide-containing phase. In this case, it is possible to provide another silver bromide-containing phase outside the silver iodide-containing phase in the vicinity of the grain surface.

The amount of silver bromide or silver iodide necessary for obtaining the advantages of the invention such as high sensitization and contrasty properties increases as formation of the silver bromide-containing phase or the silver iodide-containing phase within the grains increases, and therefore, there is a possibility that the content of silver chloride is decreased more than is necessary, thus rapid processability being damaged. Therefore, in order to put together these functions for controlling photographic properties in the vicinity of the grain surface, it is preferred to provide the silver bromide-containing phase and the silver iodide-containing phase adjacent to each other. In view of these points, the silver bromide-containing phase is formed preferably in a position of 50% to 100% of the grain volume when measured from inside, and the silver iodide-containing phase is formed preferably in a position of 85% to 100% of the grain volume. It is more preferred to form the silver bromide-containing phase in a position of 70% to 95% of the grain volume and the silver iodide-containing phase in a position of 90% to 100% of the grain volume.

Introduction of a bromide or iodide ion for incorporating silver bromide or silver iodide into the silver halide emulsion of the invention may be conducted by independently adding a solution of a bromide salt or an iodide salt, or by adding the bromide salt solution or the iodide salt solution together with a silver salt solution and a high chloride salt solution. In the latter case, the bromide salt solution or the iodide salt solution may be added separately from the high chloride salt solution or, alternatively, the bromide salt solution or the iodide salt solution may be added as a mixed solution with the high chloride solution. The bromide salt or the iodide salt is added in the form of a soluble salt such as alkali or alkaline earth metal salt of bromide or iodide. Alternatively, it is possible to introduce by splitting bromide ion or iodide ion from an organic molecule described in U.S. Pat. No. 5,389,508. Also, as another bromide ion source or iodide ion source, fine silver bromide grains or fine silver iodide grains may be used.

Addition of the bromide salt solution or the iodide ion solution may be conducted at once at a certain stage during formation of grains, or may be conducted over a certain period of time. The position in the high chloride emulsion to which iodide ion is introduced is limited in obtaining a highly sensitive, low-fogging emulsion. A smaller increase in sensitivity results as iodide ion is introduced to a position nearer the center of emulsion grains. Therefore, the iodide salt solution is preferably added such that the iodide ion is introduced outside 50% or more of the grain volume, more preferably 70% or more of the grain volume, most preferably 85% or more of the grain volume. Also, addition of the iodide salt solution is preferably completed such that the iodide ion is introduced within 98% of the grain volume, most preferably within 96% of the grain volume. A more sensitive and less fogging emulsion can be obtained by completing the addition of the iodide salt solution when the iodide ion is introduced at a little inner position of the grain surface.

On the other hand, the bromide salt solution is preferably added such that the bromide ion is introduced outside 50% or more of the grain volume, more preferably 70% or more of the grain volume.

Distribution of bromide or iodide ion in the depthwise direction into the grains may be measured by the etching/TOF-SIMS (Time of Flight-Secondary Ion Mass Spectrometry) using, for example, TOF-SIMS of model TRIFTII made by Phi Evans Co. Detailed descriptions on the TOF-SIMS method are specifically described in *Hyomen Bunseki Gijutsu Sensho Niji Ion Shituryo Bunsekiho,* compiled by Nihon Hyomen Kagakukai, published by Maruzen K. K. (1999). Analysis of emulsion grains by the etching/TOF-SIMS method enables one to find that, even when addition of the iodide salt solution is completed inside the grains, iodide ion migrates to the grain surface. In the emulsion of the invention, according to the analysis by the etching/TOF-SIMS method, iodide ion has its concentration maximum preferably at the grain surface, with the iodide ion concentration decreasing toward the interior, whereas the bromide ion has its concentration maximum preferably within the grains. The local concentration of silver bromide can be measured by the X-ray diffractiometry when the silver bromide content is high to some extent.

In the invention, the equivalent-sphere diameter of silver halide emulsion grains is presented in terms of a diameter of a sphere having the same volume as that of each grain. The emulsion of the invention preferably comprises grains having a monodisperse grain size distribution. The coefficient of variation of the equivalent-sphere diameters of all grains of the invention must be 20% or less, more preferably 15% or less, more preferably 10% or less. The coefficient of variation of the equivalent-sphere diameter is presented in terms of a percentage of the standard deviation of equivalent-sphere diameters of individual grains based on the average equivalent-sphere diameter. In this occasion, in order to obtain a wide latitude, it is preferably conducted to blend the above-described monodisperse emulsions to use in one and the same layer or to provide a plurality of yellow, magenta or cyan image-forming layers using monodisperse emulsions different from each other in the equivalent-spherical diameter in the individual layers by coating them in layers. In the invention, the silver halide light-sensitive material may contain other silver halide grains than are defined in the invention (i.e., specific silver halide grains). However, 50% or more of the projected area of the total grains is preferably that of the silver halide grains defined in the invention, with 80% or more being more preferred.

In the invention, in order to maintain color density in the rapid processing and prevent formation of streak-like unevenness, the average equivalent-sphere diameter of silver halide grains to be contained in the silver halide light-sensitive material must be 0.70 μm to 0.20 μm, preferably 0.70 μm to 0.30 μm, more preferably 0.68 μm to 0.32 μm, with respect to silver halide grains in the yellow image-forming layer. The average equivalent-sphere diameter of silver halide grains in the magenta and cyan image-forming layers are preferably 0.40 μm to 0.20 μm, more preferably 0.38 μm to 0.22 μm.

In the invention, the total coated amount of gelatin in the silver halide light-sensitive material is preferably 6.0 g/m$^2$ to 3.0 g/m$^2$, more preferably 5.5 g/m$^2$ to 3.5 g/m$^2$.

In the invention, the total coated amount of silver in the silver halide light-sensitive material is preferably 0.50 g/m$^2$ to 0.20 g/m$^2$, more preferably 0.46 g/m$^2$ to 0.24 g/m$^2$.

The electron-releasing time of the silver halide emulsion of the invention is preferably between $10^{-5}$ sec and 10 sec. Here, the term "electron-releasing time" as used herein means the time from capture of a photo-electron, generated in silver halide crystal upon exposure of the silver halide emulsion, by an electron trap existing in the crystal to release of the photo-electron. In case where the electron-releasing time is shorter than $10^{-5}$ sec, it becomes difficult to obtain a high sensitivity and contrasty properties in high-intensity exposure whereas, in case where the time is longer than 10 seconds, there arises a problem of latent image sensitization before processing short time after the exposure. The electron-releasing time is more preferably $10^{-4}$ sec to 10 sec, most preferably $10^{-3}$ sec to 1 sec.

The electron-releasing time can be measured by a double pulse photo-conducting method. A first short-time exposure is conducted using a microwave photo-conducting method or a radio wave photo-conducting method and, after a certain period of time, a second short-time exposure is conducted. Electrons are captured in electron traps in the silver halide grains by the first exposure and, when the second short-time exposure is conducted immediately thereafter, signals for the second photo-conduction become large because the electron traps are filled. In the case where the second exposure is conducted after a sufficient period of time and electrons captured in electron traps by the first exposure are already released, signals for the second photo-conduction return to almost the former level. By examining exposure time interval dependence of the intensity of the second photo-conduction signal by changing the exposure interval of the two exposures, the state of the intensity of the second photo-conduction signal being decreased with an increase of the exposure interval can be measured. This presents the time of the photo-electron being released from the electron trap. In some cases, the phenomenon of releasing electron continues to take place for a definite period of time after exposure, but the release of electron be preferably observed between $10^{-5}$ sec and 10 sec. More preferably, the electron-releasing phenomenon be observed between $10^{-4}$ sec and 10 sec, still more preferably between $10^{-3}$ sec and 1 sec.

In the invention, the silver halide emulsion preferably contains the metal complex represented by the foregoing general formula (I).

Additionally, in the invention, when m represents, for example, −4, m means 4-, which applies to the general formulae (I), (IA) to (ID), (II) and (IIA) representing metal complexes throughout the specification.

In the foregoing general formula (I), pseudo-halide ion means an ion having similar properties to that of halide ion, and examples thereof include cyanide ion ($CN^-$), thiocyanate ion ($SCN^-$), selenocyanate ion ($SeCN^-$), tellurocyanate ion ($TeCN^-$), azidodithiocarbonate ion ($SCSN_3^-$), cyanate ion ($OCN^-$), fulminate ($ONC^-$) and azide ion ($N_3^-$).

Preferred examples of XI include fluoride ion, chloride ion, bromide ion, iodide ion, cyanide ion, isocyanate ion, thiocyanate ion, hydroxide ion, nitrate ion, nitrite ion and azide ion, with chloride ion and bromide ion being particularly preferred. $L^I$ is not particularly limited, may be an inorganic compound or an organic compound and may have a charge or have no charge, with a chargeless inorganic or organic compound being preferred.

m in the general formula (I) is preferably an integer of −4 to +1.

Of the metal complexes of the general formula (I), metal complexes represented by the general formula (IA) or (IB) are preferred, with metal complexes represented by the general formula (IB) being more preferred.

In the general formula (IA), $X^{IA}$ is the same as defined for $X^I$ in the general formula (I), and $L^{IA}$ preferably represents water, OCN, ammonia, phosphine or carbonyl, with water being particularly preferred.

In the general formula (IB), $X^{IB}$ is the same as defined for $X^I$ in the general formula (I), and $L^{IB}$ represents a ligand having a mother structure of a chained or cyclic hydrocarbon or the mother structure wherein part of the carbon atoms or hydrogen atoms is replaced by other atom or atoms, though cyanide ion being excluded. $L^{IB}$ is preferably a hetero ring compound. More preferably, the compound is a complex having a 5-membered ring compound as a ligand. Of the 5-membered ring compounds, those compounds which have at least one nitrogen atom and at least one sulfur atom in the 5-membered ring skeleton are more preferred.

Of the metal complexes of the general formula (IB), metal complexes represented by the general formula (IC) are more preferred. In the general formula (IC), $X^{IC}$ is the same as defined for $X^I$ in the general formula (I), and the substituent on the carbon atom in the ring skeleton of $L^{IC}$ is preferably a substituent having a smaller volume than that of a n-propyl group. Preferred exsamples of the substituent include an alkyl group (preferably methyl or ethyl), an alkoxy group (preferably methoxy or ethoxy), a cyano group, an isocyano group, a cyanato group, an isocyanato group, a thiocyanato group, an isothiocyanato group, a formyl group, a thioformyl group, a hydroxyl group, a mercapto group, an amino group, a hydrazine group, an azido group, a nitro group, a hydroxyamino group, a carboxyl group, a carbamoyl group, a fluorine atom, a chlorine atom, a bromine atom and an iodine atom.

Of the metal complexes of the general formula (IC), the metal complexes represented by the general formula (ID) are more preferred. In the general formula (ID), $X^{ID}$ is the same as defined for $X^I$ in the general formula (I), and $L^{IB}$ is preferably a compound having a skeleton of thiadiazole, with the carbon atom in the compound being preferably bound to a substituent other than hydrogen. Preferred examples of the substituent include a halogen atom (preferably a fluorine atom, a chlorine atom, a bromine atom or an iodine atom), an alkoxy group (preferably methoxy or ethoxy), a carboxyl group, an alkoxycarbonyl group (preferably methoxycarbonyl), an acyl group (preferably acetyl or chloroformyl), a mercapto group, an alkylthio group (preferably methylthio), a thioformyl group, a thiocarboxy group, a dithiocarboxy group, a sulfino group, a sulfo group, a sulfamoyl group, an alkylamino group (preferably methylamino), a cyano group, an isocyano group, a cyanato group, an isocyanato group, a thiocyanato group, an isothiocyanato group, a hydroxyamino group, a hydroxyimino group, a carbamoyl group, a nitroso group, a nitro group, a hydrazine group, a hydrazono group and an azido group, with a halogen atom, a chloroformyl group, a sulfino group, a sulfo group, a sulfamoyl group, an isocyano group, a cyanato group, an isocyanato group, a thiocyanato group, an isothiocyanato group, a hydroxyimino group, a nitroso group, a nitro group and an azido group being more preferred. Of these, a chlorine atom, a bromine atom, a chloroformyl group, an isocyano group, a cyanato group, an isocyanato group, a thiocyanato group and an isothiocyanato group are particularly preferred. n preferably represents 4 or 5, m preferably represents −2 or −1.

Preferred specific examples of the metal complexes represented by the general formula (I) are illustrated below which, however, do not limit the invention in any way.

$[IrCl_5(H_2O)]^{2-}$
$[IrCl_4(H_2O)_2]^{-}$
$[IrCl_5(H_2O)]^{-}$
$[IrCl_4(H_2O)_2]^{0}$
$[IrCl_5(OH)]^{3-}$
$[IrCl_4(OH)_2)]^{2-}$
$[IrCl_5(OH)]^{2-}$
$[IrCl_4(OH)_2)]^{2-}$
$[IrCl_5(O)]^{4-}$
$[IrCl_4(O)_2]^{5-}$
$[IrCl_5(O)]^{3-}$
$[IrCl_4(O)_2]^{4-}$
$[IrBr_5(H_2O)]^{2-}$
$[IrBr_4(H_2O)_2]^{-}$
$[IrBr_5(H_2O)]^{-}$
$[IrBr_4(H_2O)_2]^{0}$
$[IrBr_5(OH)]^{3-}$
$[IrBr_4(OH)_2)]^{2-}$
$[IrBr_5(OH)]^{2-}$
$[IrBr_4(OH)_2)]^{2-}$
$[IrBr_5(O)]^{4-}$
$[IrBr_4(O)_2]^{5-}$
$[IrBr_5(O)]^{3-}$
$[IrBr_4(O)_2]^{4-}$
$[IrCl_5(OCN)]^{3-}$
$[IrBr_5(OCN)]^{3-}$
$[IrCl_5(thiazole)]^{2-}$
$[IrCl_4(thiazole)_2]^{-}$
$[IrCl_3(thiazole)_3]^{0}$
$[IrBr_5(thiazole)]^{2-}$
$[IrBr_4(thiazole)_2]^{-}$
$[IrBr_3(thiazole)_3]^{0}$
$[IrCl_5(5\text{-methylthiazole})]^{2-}$
$[IrCl_4(5\text{-methylthiazole})_2]^{-}$
$[IrBr_5(5\text{-methylthiazole})]^{2-}$
$[IrBr_4(5\text{-methylthiazole})_2]^{-}$
$[IrCl_5(5\text{-chlorothiadiazole})]^{2-}$
$[IrCl_4(5\text{-chlorothiadiazole})_2]^{-}$
$[IrBr_5(5\text{-chlorothiadiazole})]^{2-}$
$[IrBr_4(5\text{-chlorothiadiazole})_2]^{-}$
$[IrCl_5(2\text{-chloro-5-fluorothiadiazole})]^{2-}$
$[IrCl_4(2\text{-chloro-5-fluorothiadiazole})_2]^{-}$
$[IrBr_5(2\text{-chloro-5-fluorothiadiazole})]^{2-}$
$[IrBr_4(2\text{-chloro-5-fluorothiadiazole})_2]^{-}$
$[IrCl_5(2\text{-bromo-5-chlorothiadiazole})]^{2-}$
$[IrCl_4(2\text{-bromo-5-chlorothiadiazole})_2]^{-}$
$[IrBr_5(2\text{-bromo-5-chlorothiadiazole})]^{2-}$
$[IrBr_4(2\text{-bromo-5-chlorothiadiazole})_2]-$ Also, in the invention, other iridium compounds than the above-described iridium compounds may further be incorporated in the silver halide grains. As the iridium compounds, hexa-ligand complexes having 6 ligands with iridium being a center metal are preferred for uniformly incorporating them in the silver halide crystals. As one embodiment of the iridium to be used in the invention, hexa-ligand complexes having Cl, Br or I as ligand with iridium being a center metal are preferred. Hexa-ligand complexes wherein all of the six ligands are composed of Cl, Br or I and Ir exists as a center metal are more preferred. In this case, Cl, Br and I may be mixed among the six ligands. It is particularly preferred for the hexa-ligand complex having Cl, Br or I as ligands with Ir being a center metal to be incorporated in the silver bromide-containing phase for the purpose of obtaining a contrasty gradation by high intensity exposure.

Specific examples of the hexa-ligand complexes wherein all of the six ligands are composed of Cl, Br or I and Ir exists as a center metal are illustrated below, but iridium compounds to be used in the invention are not limited only to them.

$[IrCl_6]^{2-}$
$[IrCl_6]^{3-}$
$[IrBr_6]^{2-}$
$[IrBr_6]^{3-}$
$[IrI_6]^{3-}$

Ther metal complexes which are represented by the general formula (II) and are to be preferably used in the invention are described below.

In the general formula (II), $X^{II}$ represents a fluoride ion, a chloride ion, a bromide ion or an iodide ion, particularly preferably a chloride ion or a bromide ion. $L^{II}$ may be an inorganic compound or an organic compound, and may have a charge or have no charge, but is preferably a chargeless inorganic compound. $L^{II}$ is preferably $H_2O$, NO or NS.

Among the metal complexes of the general formula (II), metal complexes represented by the following general formula (IIA) are preferred.

$$[M^{IIA}X^{IIA}_{n}L^{IIA}_{(6-n)}]^{m-} \quad \text{(IIA)}$$

$M^{IIA}$: Re, Ru, Os, Rh
$X^{IIA}$: halide ion
$L^{IIA}$: NO or NS when $M^{IIA}$ is Re, Ru or Os, and $H_2O$, OH or O when $M^{IIA}$ is Rh.
n: 3, 4, 5 or 6
m: an integer of from −4 to +1

$X^{IIA}$ is the same as defined for $X^{II}$ in the general formula (II), and its preferred scope is also the same as that of $X^{II}$.

Here, 3 to 6 $X^{IIA}$s may be the same or different from each other and, in the case where a plurality of $L^{IIA}$s exist, they may be the same or different from each other.

Preferred specific examples of the metal complexes represented by the general formula (II) are illustrated below which, however, do not limit the invention in any way.

$[ReCl_6]^{2-}$
$[ReCl_5(NO)]^{2-}$
$[RuCl_6]^{2-}$ $[RuCl_6]^{3-}$
$[RuCl_5(NO)]^{2-}$
$[RuCl_5(NS)]^{2-}$
$[RuBr_5(NS)]^{2-}$
$[OsCl_6]^{4-}$
$[OsCl_5(NO)]^{2-}$
$[OsBr_5(NS)]^{2-}$
$[RhCl_6]^{3-}$
$[RhCl_5(H_2O)]^{2-}$
$[RhCl_4(H_2O)_2]^{-}$
$[RhBr_6]^{3-}$
$[RhBr_5(H_2O)]^{2-}$
$[RhBr_4(H_2O)_2]^{-}$
$[PdCl_6]^{2-}$
$[PtCl_6]^{2-}$

Of the compound of the general formula (II), the compounds represented by the following formula (IIB) are more preferred. The compounds of the general formula (IIB) are described below.

$$[RhBr_nL^{IIB}_{(6-n)}]^{m-} \quad \text{(IIB)}$$

LIIB: an arbitrary ligand different from Br n: 3, 4, 5 or 6 m: an integer of from −3 to 0

$L^{IIB}$ may be an inorganic compound or an organic compound, and may or may not have an electric charge, and is preferably an inorganic compound. $L^{IIB}$ is preferably $Cl^-$, $H_2O$, NO or NS, more preferably $H_2O$. n is preferably 5 or 6, more preferably 6. m is preferably −3 or −2, more preferably −3.

Use of the compound of the general formula (IIB) imparts new merits that a latent image stability over 3 days is obtained after a long-time exposure and that, even in the case of storing the light-sensitive material containing the silver halide emulsion of the invention for a long time in an unexposed state, changes in photographic properties are small. In the case of using a recently spread apparatus wherein exposure to development are conducted, the time from exposure to processing is not long but, in a business model wherein an exposing apparatus and a color development processor are not combined, for example, in the professional print market of preparing greatly enlarged prints, the time might become long. Thus, the use of the compound is preferred in the point that it enables one to apply the light-sensitive material to a wider print market.

Preferred specific examples of the metal complexes represented by the general formula (IIB) are illustrated below which, however, do not limit the invention in any way.

$[RhBr_5Cl]^{3-}$
$[RhBr_6]^{3-}$
$[RhBr_5(H_2O)]^{2-}$
$[RhBr_4(H_2O)_2]^{-}$

The above-illustrated metal complexes are anions and, in the case of forming salts with a cation, readily water-soluble cations are preferred as the counter cations. Specifically, alkali metal ions such as sodium ion, potassium ion, rubidium ion, cesium ion and lithium ion, ammonium ion and alkylammonium ion are preferred. These metal complexes may be used by dissolving in water or a mixed solution with a proper water-miscible organic solvent (such as an alcohol, an ether, a glycol, a ketone, an ester or an amide). The metal complex represented by the general formula (I) is added in an amount of preferably $1\times10^{-10}$ mol to $1\times10^{-3}$ mol, most preferably $1\times10^{-8}$ Mol to $1\times10^{-5}$ mol, per mol of silver during formation of the grains. The metal complex represented by the general formula (II) is added in an amount of preferably $1\times10^{-11}$ mol to $1\times10^{-6}$ mol, most preferably $1\times10^{-9}$ Mol to $1\times10^{-7}$ mol. per mol of silver during formation of the grains.

In the invention, combined use of the metal complex represented by the general formula (I) and the metal complex represented by the general formula (II) is advantageous in view of the effects of the invention.

In the invention, the above-described metal complexes are incorporated within the silver halide grains preferably by directly adding to a reaction solution upon formation of silver halide grains or by adding to an aqueous solution of a halide for forming silver halide grains or other solution and adding the resultant solution to a solution for grains-forming reaction. Also, it is preferred to conduct physical ripening with fine particles in which the iridium complex has been incorporated in advance to thereby incorporate the complex in silver halide grains. Further, it is possible to incorporate the complex in the silver halide grains by a combination of these methods.

In incorporating these complexes in silver halide grains, they may be allowed to exist uniformly within the grains but, as is disclosed in JP-A-4-208936, JP-A-2-125245 and JP-A-3-188437, it is preferred for the complexes to exist only in the grain surface layer, or to exist only in the interior of the grains and provide a complex-free layer on the grain surface. Also, as is disclosed in U.S. Pat. Nos. 5,252,451 and 5,256,530, it is preferred to physically ripen the grains with fine particles having incorporated therein the complex to thereby modify the grain surface phase. Further, these methods may be applied in combination, and a plurality of the complexes may be incorporated in a single kind of silver halide grains. Halogen composition in the portion where the complex is incorporated is not particularly limited but, with the 6-ligand complexes wherein all of the six ligands comprise Cl, Br or I with Ir being the center metal, it is preferred to incorporate the ligand in the portion where the concentration of silver bromide is maximum.

In the invention, the interior and/or surface of the silver halide grains may be doped with other metal ion in addition to the aforesaid metal complexes. As the metal ion to be used, transition metal ions are preferred, with iron, ruthenium, osmium, rhodium, lead, cadmium and zinc being particularly preferred. It is more preferred to use these metal ions as 6-ligand octahedral complexes. In the case of using an inorganic compound as a ligand, it is preferred to use a cyanide ion, a halide ion, thiocyan, a hydroxide ion, a peroxide ion, an azide ion, a nitrite ion, water, ammonia, a nitrosyl ion or a thionitrosyl ion. It is also preferred to coordinate an ion of any of the iron, ruthenium, osmium, rhodium, lead, cadmium and zinc with the ligand to use, or to use plural kinds of ligands in one complex molecule. Also, an organic compound may be used as the ligand. Preferred examples of the organic compound include chained compounds containing 5 or less carbon atoms in the main chain and/or 5- or 6-membered hetero ring compounds. More preferred organic compounds are those which have within the molecule a nitrogen atom, a phosphorus atom, an oxygen atom or a sulfur atom as a ligand atom to the metal, with furan, thiophene, oxazole, isoxazole, thiazole, isothiazole, imidazole, pyrazole, triazole, furazane, pyran, pyridazine, pyrimidine and pyrazine being particularly preferred. In addition, those compounds are preferred which have these compounds as fundamental skeleton and have substituents introduced to the skeleton.

A preferred combination of the metal ion and the ligand is an iron ion or a ruthenium ion and a cyanide ion. In the invention, it is preferred to use these compounds. In these compounds, the cyanide ion preferably occupies the greater part of coordination number to the center metal of iron or ruthenium, with the rest of the coordination sites being preferably occupied by thiocyan, ammonia, water, a nitrosyl ion, dimethylsulfoxide, pyridine, pyrazine or 4,4'-bipyridyl. Most preferably, all of the 6 coordination sites are occupied by the cyanide ion to form hexacyano-iron complex or hexacyano-ruthenium complex. These complexes having the cyanide ion as ligand is added in an amount of $1\times10^{-8}$ mol to $1\times10^{-2}$ mol, most preferably $1\times10^{-6}$ mol to $5\times10^{-4}$ mol, per mol of silver during formation of the grains. In the case of using ruthenium or osmium as a center metal, it is also preferred to use as the ligand a nitrosyl ion, a thionitrosyl ion or water molecule together with a chloride ion. It is more preferred to form a pentachloronitrosyl complex, a pentachlorothionitrosyl complex or a pentachloroaqua complex. Formation of a hexachloro complex is preferred as well. These complexes are added in an amount of preferably $1\times10^{-10}$ mol to $1\times10^{-6}$ mol, more preferably $1\times10^{-9}$ mol to $1\times10^{-6}$ mol, per mol of silver during formation of the grains.

To the silver halide emulsion to be used in the invention may be added various compounds or the precursors thereof for the purpose of preventing fog or stabilizing photographic properties during steps for producing a light-sensitive material, during storage or during photographic processing. As specific examples of these compounds, those described in JP-A-62-215272, pp. 39 to 72 may preferably be used. Further, 5-arylamino-1,2,3,4-thiatriazole compounds (having at least one electron attractive group in the aryl moiety) described in EP 0447647 may preferably be used as well.

In order to enhance preservation properties of the silver halide emulsion, hydroxamic acid derivatives described in JP-A-11-109576, cyclic ketones having a double bond, adjacent to the carbonyl group, substituted by an amino group or a hydroxyl group at its both ends (particularly those represented by the general formula (S1), with the descriptions of paragraph Nos. 0036 to 0071 being incorporated in the specification of the invention), sulfo-substituted catechols or hydjroquinones described in JP-A-11-143011 (such as 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid and the salts thereof), hydroxylamines represented by the general formula (A) in U.S. Pat. No. 5,556,741 (descriptions in col. 4, line 56 to col. 11, line 22 of U.S. Pat. No. 5,556,741 being preferably applied to the invention and incorporated as part of the specification of the invention), and water-soluble reducing agents represented by the general formulae (I) to (III) in JP-A-11-102045 are preferably used in the invention as well.

Spectral sensitization is conducted for the purpose of imparting spectral sensitivity in a desired light wavelength region to each emulsion of the light-sensitive material of the invention.

In the light-sensitive material of the invention, examples of spectrally sensitizing dyes to be used for spectral sensitization in the blue, green or red region include those described in Heterocyclic compounds-Cyanine dyes and related compounds written by F. M. Harmer (published by John Wiley & Sons [New York, London] in 1964). As specific examples of the compounds and methods for spectral sensitization, those described in the foregoing JP-A-62-215272, p. 22, right and upper column to p. 38 are preferably used. As red-sensitive spectrally sensitizing dyes for silver halide emulsion grains having silver chloride in a high content, the spectrally sensitizing dyes described in JP-A-3-123340 are particularly preferred in view of stability, adsorption strength and temperature dependence of exposure.

The amounts of these spectrally sensitizing dyes vary in a wide range depending upon cases, and are preferably in a range of from $0.5\times10^{-6}$ mol to $1.0\times10^{-2}$ mol, more preferably $1.0\times10^{-6}$ mol to $5.0\times10^{-3}$ mol, per mol of silver halide.

The silver halide emulsion to be used in the invention is a gold-sensitized emulsion. Because, gold sensitization serves to enhance sensitivity of the emulsion and minimize variation of photographic properties upon scanning exposure using a laser light. As has already been described, a conventionally known gold sensitization method may be used in combination with the method of the invention.

In order to conduct the conventionally known gold sensitization, various inorganic gold compounds, gold(I) complexes having inorganic ligands, and gold(I) compounds having organic ligands may be utilized. As the inorganic gold compounds, chloroauric acid or its salts may for example be used and, as the gold(I) complexes having inorganic ligands, gold(I) dithiocyanates such as potassium gold(I) dithiocyanate and gold dithiosulfates such as trisodium gold dithiosulfate may for example be used.

As the gold(I) compounds having organic ligands (organic compounds), there may be used bis-gold(I) mesoion hetero rings such as bis(1,4,5-trimethyl-1,2,4-triazolium-3-thiolato)aurate(I) tetrafluoroborate described in JP-A-4-267249, organic mercapto gold(I) complexes such as potassium bis(1-[3-(2-sulfonatobenzamido)phenyl]-5-mercaptotetrazole potassium salt)aurate(I) 5 hydrate described in JP-A-11-218870, and gold(I) compounds coordinated with a nitrogen compound anion such as bis(1-methylhydantoinato) gold(I) sodium salt tetrahydrate described in JP-A-4-268550 may be used. As these gold(I) compounds having the organic ligands, those which have previously been synthesized and isolated may be used and, in addition, it is also possible that the organic ligand and the Au compound (such as chloroauric acid or its salt) are mixed with each other to form the gold(I) compound, followed by adding the product to an emulsion without isolation. Further, it is also possible to add the organic ligand and the Au compound (such as chloroauric acid or its salt) separately to an emulsion to thereby generate the gold(I) compound having the organic ligand in the emulsion.

Also, gold(I) thiorate compounds described in U.S. Pat. No. 3,503,794, gold compounds described in JP-A-8-69074, JP-A-8-69075 and JP-A-9-269554, and compounds described in U.S. Pat. Nos. 5,620,841, 5,912,112, 5,620,841, 5,939,245 and 5,912,111 may be used.

The addition amounts of these compounds may vary in a wide range depending upon cases, and is generally $5\times10^{-7}$ to $5\times10^{-3}$ mol, preferably $5\times10^{-6}$ to $5\times10^{-4}$ mol, per mol of silver halide.

Also, it is possible to use colloidal gold sulfide. Processes for its preparation are described in Research Disclosure, 37154; Solid State Ionics, vol. 79, pp. 60 to 66, published in 1955; and Compt. Rend. Hebt. Seances Acad. Sci. Sect. B vol. 263, p. 1328 published in 1966. A method of using a thiocyanate ion upon preparation of colloidal gold sulfide is described in the above Research Disclosure, but a thioether compound such as methionine or thiodiethanol may be used in place of the thiocyanate ion.

As the colloidal gold sulfide, colloids of various sizes may be utilized, with colloids of 50 nm or less in average particle size being preferred, 10 nm or less being more preferred and 3 nm or less being further more preferred. This particle size can be measured from a TEM photograph. As to composition of the colloidal gold sulfide, $Au_2S_1$ suffices, and compositions containing an excess amount of sulfur such as $Au_2S_1$ to $Au_2S_2$ may be used, with compositions containing an excess amount of sulfur being preferred. Compositions of $Au_2S_{1.1}$ to $Au_2S_{1.8}$ are more preferred.

Analysis of the composition of the colloidal gold sulfide may be conducted by, for example, taking out gold sulfide particles and determining the contents of gold and sulfur respectively utilizing an analyzing method such as an ICP or iodometry. Existence of a gold ion and a sulfur ion (including hydrogen sulfide or its salt) exerts influence on analysis of the gold sulfide colloid particles, and hence the analysis is conducted after isolating gold sulfide particles by ultrafiltration. The addition amount of the gold sulfide colloid varies in a wide range depending upon cases, but is $5\times10^{-7}$ to $5\times10^{-3}$ mol, preferably $5\times10^{-6}$ to $5\times10^{-4}$ mol, as gold atom per mol of silver halide.

In the invention, the gold sensitization may be combined with other sensitization methods such as sulfur sensitization, selenium sensitization, tellurium sensitization, reduction sensitization or noble metal sensitization using other noble metal compounds than gold compounds.

Conventionally known photographic materials or additives may be used in the silver halide photographic light-sensitive material of the invention.

For example, as a photographic support, a transparent support or a reflective support may be used. As the transparent support, a transparent film such as a cellulose nitrate film or a polyethylene terephthalate film and, further, those which are obtained by providing an information-recording layer such as a magnetic layer on a polyester between 2,6-naphthalenedicarboxylic acid (NDCA) and ethylene glycol (EG) or a polyester between NDCA, terephthalic acid and EG are preferably used. As the reflective support, those reflective supports which are obtained by laminating a plurality of polyethylene layers or polyester layers having a white pigment such as titanium oxide in at least one of such water-resistant resin layers (laminate layers) are preferred.

As a more preferred support in the invention, there are illustrated those which comprise a paper substrate having a polyolefin layer containing microvoids provided on the side on which the silver halide emulsion layer is to be provided. The polyolefin layer may be composed of a plurality of layers. In this case, those supports are more preferred wherein the polyolefin layer to be adjacent to the gelatin layer of the silver halide emulsion layer does not have the microvoids (such as polypropylene or polyethylene) and a layer composed of polyolefin (such as polypropylene or polyethylene) containing the microvoids is provided on the side near the paper substrate. The density of the polyolefin multi-layers or single layer existing between the paper substrate and the photograph-constituting layer is preferably 0.40 to 1.0 g/ml, more preferably 0.50 to 0.70 g/ml. Also, the thickness of the polyolefin multi-layers or single layer existing between the paper substrate and the photograph-constituting layer is preferably 10 to 100 $\mu$m, more preferably 15 to 70 $\mu$m. The ratio of the thickness of the polyolefin layer to the thickness of the paper substrate is preferably 0.05 to 0.2, more preferably 0.1 to 0.5.

In view of enhancing rigidity of the reflective support, it is also preferred to provide a polyolefin layer on the reverse side (back side) to the photograph-constituting layer of the paper substrate. In this case, the polyolefin layer on the back surface is preferably a polyethylene or polypropylene layer whose surface has been matted, with matted polypropylene being more preferred. The polyolefin layer on the back surface is preferably 5 to 50 $\mu$m, more preferably 10 to 30 $\mu$m in thickness, and preferably 0.7 to 1.1 g/ml in density. Examples of preferred embodiments relating to the polyolefin layer to be provided on the paper substrate for the reflective support of the invention include those which are described in JP-A-10-333277, JP-A-10-333278, JP-A-11-52513, JP-A-11-65024, EP 0880065 and EP 0880066.

Further, the water-resistant resin layer preferably contains a fluorescent brightening agent. The fluorescent brightening agent may be dispersed in a hydrophilic colloidal layer of the light-sensitive material. Examples of the fluorescent brightening agent to be preferably used include benzoxazole-based ones, coumarin-based ones, and pyrazoline-based ones, with benzoxazolylnaphthalene-based ones and benzoxazolylstylbene-based ones being preferred. The amount thereof is not particularly limited, but is preferably 1 to 100 mg/m$^2$. The mixing ratio in the case of mixing into the water-resistant resin is preferably 0.0005 to 3% by weight, more preferably 0.001 to 0.5% by weight, based on the resin.

As the reflective support, those which are obtained by providing a hydrophilic colloidal layer containing a white pigment on the transparent support or on the reflective support as described above.

Also, the reflective support may be a support having a metallic surface having mirror reflection properties or second diffused reflection properties.

Also, as a support to be used for the light-sensitive material of the invention for use in display, there may be used a white polyester-based support or a support having a white pigment-containing layer provided on the side on which the silver halide emulsion layers are to be provided. Further, in order to improve sharpness, it is preferred to coat an antihalation layer on the silver halide emulsion-coated side or the back side of the support. In particular, in order to enable one to view a display under reflected light or transmitted light, it is preferred to set the transmission density of the support to a range of 0.35 to 0.8.

It is preferred in the light-sensitive material of the invention to add, to a hydrophilic colloidal layer thereof, a dye capable of being decolored by some processing (above all, oxonol-based dye) described in EP 0337490A2, pp. 27 to 76 in such amount that an optical reflective density at 680 nm of the light-sensitive material becomes 0.70 or more, or to incorporate 12% by weight or more (preferably 14% by weight or more) of titanium oxide having been surface-treated with a di- to tetra-hydric alcohol (such as trimethylolethane) in the water-resistant resin layer of the support for the purpose of improving sharpness of images.

It is preferred in the light-sensitive material in accordance with the invention to add, to a hydrophilic colloidal layer thereof, a dye capable of being decolored by some processing (above all, oxonol dye and cyanine dye) described in EP 0337490A2, pp. 27 to 76 for the purpose of preventing irradiation or halation or improving safe light stability. Further, dyes described in EP 0819977 are also preferably added in the invention.

Among these water-soluble dyes are those which deteriorate color separation or safe light safety when used in an increased amount. As dyes usable without deteriorating color separation, those water-soluble dyes are preferred which are described in JP-A-5-127324, JP-A-5-127325 and JP-A-5-216185.

In the invention, a colored layer capable of being decolored by some processing is used in place of the water-soluble dyes or in combination with the water-soluble dyes. The colored layer decolorable by some processing to be employed may be provided in a direct contact with an emulsion layer or may be provided in contact with the emulsion layer via an interlayer containing gelatin or an agent for preventing color mixing upon processing such as hydroquinone. This colored layer is preferably provided under (support side) an emulsion layer which forms the same kind of the primary color of the colored layer. It is possible to provide individual colored layers corresponding the primary colors or to select any part of them to provide. Also, it is possible to provide a colored layer having a color corresponding to a plurality of primary color regions. The optical reflective density of the colored layer is preferably 0.2 to 3.0, more preferably 0.5 to 2.5, particularly preferably 0.8 to 2.0, in terms of the optical density at a wavelength at which the optical density is maximal in the wavelength region used for exposure (400 nm to 700 nm in usual exposure in a printer, or a wavelength region of a light source for scanning exposure in the case of using scanning exposure).

In order to form the colored layer, conventionally known methods may be applied. For example, there are a method of incorporating a dye in the form of a solid fine dispersion in a hydrophilic colloidal layer, as with dyes described in JP-A-2-282244, p. 3, right and upper column to p. 8 and JP-A-3-7931, p. 3, right and upper column to p. 11, left and lower column; a method of mordanting a cationic polymer with an anionic dye; a method of adsorbing a dye to fine grains such as silver halide grains to thereby fix the dye in the layer; and a method of using colloidal silver as described in JP-A-1-239544. As a method for dispersing fine powder of a dye in the form of a solid, JP-A-2-308244 describes at PP. 4 to 13 a method of incorporating a fine powder dye which is substantially water-insoluble at a pH of 6 or less and is substantially water-soluble at a pH of 8 or more. Also, as a method of mordanting a cation polymer with an anionic dye, description is given in JP-A-2-84637, pp. 18 to 26. A method for preparing colloidal silver functioning as a light absorbent is described in U.S. Pat. Nos. 2,688,601 and 3,459,563. Of these methods, the method of incorporating a fine powder dye and the method of using colloidal silver are preferred.

The silver halide photographic light-sensitive material of the invention is used for color negative films, color positive films, color reversal films, color reversal photographic papers and color photographic printing papers, and is particularly preferably used for color photographic papers.

The color photographic paper preferably has at least one yellow color-forming silver halide emulsion layer, at least one magenta color-forming silver halide emulsion layer and at least one cyan color-forming silver halide emulsion layer and, in general, these silver halide emulsion layers are provided in the order of the yellow color-forming silver halide emulsion layer, the magenta color-forming silver halide emulsion layer and the cyan color-forming silver halide emulsion layer from the support side.

However, a layer configuration different from this may be employed.

A silver halide emulsion layer containing a yellow coupler may be provided at any position on the support but, in the case where silver halide tabular grains are contained in the yellow coupler-containing layer, it is preferably provided more apart from the support than at least one of a magenta coupler-containing silver halide emulsion layer and a cyan coupler-containing silver halide emulsion layer. Also, in view of acceleration of color development, acceleration of silver removal and reduction of residual color due to sensitizing dyes, the yellow coupler-containing silver halide emulsion layer is preferably provided at a position more spaced from the support than any other silver halide emulsion layer. Further, in view of reduction of Blix fading, the cyan coupler-containing silver halide emulsion layer is preferably provided at a central position between other silver halide emulsion layers and, in view of reduction of photo fading, the cyan coupler-containing silver halide emulsion layer is preferably provided as the lowermost layer. Also, each of the yellow color-, magenta color- and cyan color-forming layers may be composed of two or three layers. It is also preferred to provide a coupler layer not containing a silver halide emulsion adjacent to the silver halide emulsion layer to function as a color-forming layer as described in, for example, JP-A-4-75055, JP-A-9-114035, JP-A-10-246940 and U.S. Pat. No. 5,576,159.

As the silver halide emulsion and other materials (such as additives), photograph-constituting layers (such as layer configuration) to be applied in the invention, and processing and additives to be employed for processing the light-sensitive material, those which are described in JP-A-62-215272, JP-A-2-33144 and EP 0355660A2 are preferably employed, with those described in EP 0355660A2 being particularly preferred. Further, silver halide color photographic light-sensitive materials and methods for their processing described in JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641, EP 0520457A2 are also preferred.

In particular, in the invention, as the reflective supports, silver halide emulsion, different metal ions to be doped in silver halide grains, storage stability-imparting agents for silver halide emulsions or antifogging agents, chemically sensitizing methods (sensitizing agents), spectrally sensitizing methods (spectrally sensitizing agents), cyan couplers, magenta couplers, yellow couplers, methods for emulsifying and dispersing them, color image preservability-improving agents (stain-preventing agents and anti-fading agents), dyes (colored layers), gelatins, layer configuration of light-sensitive materials, and pH of films of light-sensitive materials, those described in the patents shown in the following Table 1 at positions also shown therein may particularly preferably be employed.

TABLE 1

| Element | JP-A-7-104448 | JP-A-7-77775 | JP-A-7-301895 |
|---|---|---|---|
| Reflective support | col.7, l.12 to col.12, l.19 | col.35, l.43 to col.44, l.1 | col.5, l.40 to col.9, l.26 |
| Silver halide emulsion | col.72, l.29 to col.74, l.18 | col.44, l.36 to col.46, l.29 | col.77, l.48 to col.80, l.28 |
| Different metal ion | col.74, l.19 to col.74, l.44 | col.46, l.30 to col.47, l.5 | col.80, l.29 to col.81, l.6 |
| Storage stability-imparting agent or anti-fogging agent | col.79, l.9 to col.75, l.18 | col.47, l.20 to col.47, l.29 | col.18, l.11 to col.31, l.37 (particularly mercapto heterocyclic compounds) |

TABLE 1-continued

| Element | JP-A-7-104448 | JP-A-7-77775 | JP-A-7-301895 |
|---|---|---|---|
| Chemical sensitization (chemically sensitizing agents) | col.74, l.45 to col.75, l.6 | col.47, l.7 to col.47, l.17 | col.81, l.9 to col.81 l.17 |
| Spectral sensitization (spectrally sensitizing agents) | col.75, l.19 to col.76, l.45 | col.47, l.30 to col.49, l.6 | col.81, l.21 to col.82, l.48 |
| Cyan couplers | col.12, l.20 to col.39, l.49 | col.62, l.50 to col.63, l.16 | col.88, l.49 to col.89, l.16 |
| Yellow couplers | col.87, l.40 to col.88, l.3 | col.63, l.17 to col.63, l.30 | col.89, l.17 to col.89, l.30 |
| Magenta couplers | col.88, l.4 to col.88, l.18 | col.63, l.3 to col.64, l.11 | col.31, l.34 to col.77, l.44 & col.88, l.32 to col.88, l.46 |
| Methods for emulsifying and dispersing couplers | col.71, l.3 to col.72, l.11 | col.61, l.36 to col.61, l.49 | col.87, l.35 to col.87, l.48 |
| Color image preservability-improving agents (stain-preventing agents) | col.39, l.50 to col.70, l.9 | col.61, l.50 to col.62, l.49 | col.87, l.49 to col.88, l.48 |
| Antifading agents | col.70, l.10 to col.71, l.2 | | |
| Dyes | col.77, l.42 to col.78, l.41 | col.7, l.14 to col.19, l.42 & col.50, l.3 to col.51, l.14 | col.9, l.27 to col.18, l.10 |
| Gelatins | col.78, l.42 to col.78, l.48 | col.51, l.15 to col.51, l.20 | col.83, l.13 to col.83, l.19 |
| Layer configuration of light-sensitive materials | col.39, l.11 to col.39, l.26 | col.44, l.2 to col.44, l.35 | col.31, l.38 to col.32, l.33 |
| pH of coating films of light-sensitive materials | col.72, l.12 to col.72, l.28 | | |
| Scanning exposure | col.76, l.6 to col.77, l.41 | col.49, l.7 to col.50, l.2 | col.82, l.49 to col.83, l.12 |
| Preservatives in developer | col.88, l.19 to col.89, l.22 | | |

As the cyan couplers, magenta couplers and yellow couplers to be used in the invention, those couplers are also useful which are described in JP-A-62-215272, p. 91, right and upper column, line 4 to p. 121, left and upper column, line 6, JP-A-2-33144, p. 3, right and upper column, line 14 to p. 18, left and upper column, bottom line and p. 30, right and upper column, line 6 to p. 35, right and lower column, line 11, and EP 0355660A2, p. 4, lines 15 to 27, p. 5, line 30 to p. 28, bottom line, p. 45, lines 29 to 31, and p. 47, line 23 to p. 63, line 50.

Also, in the invention, compounds represented by the general formulae (II) and (III) in WO-98/33760 and the general formula (D) in JP-A-10-221825 may preferably be added.

As cyan dye-forming couplers (hereinafter, also referred to merely as "cyan couplers") to be used in the invention, pyrrolotriazole-based couplers are preferably used, and couplers represented by the general formula (I) or (II) in JP-A-5-313324, couplers represented by the general formula (I) in JP-A-6-347960, and illustrative couplers described in these patents are particularly preferred. Also, phenolic and naphtholic cyan couplers are also preferred. For example, cyan couplers represented by the general formula (ADF) described in JP-A-10-333297 are preferred. As cyan couplers other than the above-described couplers, pyrroloazole-based cyan couplers described in EP 0488248 and EP 0491197A1, 2,5-diacylaminophenol couplers described in U.S. Pat. No. 5,888,716, pyrazoloazole-based cyan couplers having an electron attractive group or a hydrogen-bonding group in 6-position, described in U.S. Pat. Nos. 4,873,183 and 4,916,051 and, particularly, pyrazoloazole-based cyan couplers having a carbamoyl group in 6-position, described in JP-A-8-171185, JP-A-8-311360 and JP-A-8-339060 are preferred as well.

Also, diphenylimidazole-based cyan couplers described in JP-A-2-33144, 3-hydroxypyridine-based cyan couplers described in EP 0333185A2 (above all, a 2-equivalent coupler prepared by introducing a chlorine elimination group into a 4-equivalent coupler (42) specifically illustrated as a specific example, and couplers (6) and (9) being particularly preferred), cyclic active methylene cyan couplers described in JP-A-64-32260 (above all, coupler examples 3, 8 and 34 illustrated as specific examples being particularly preferred), pyrrolopyrazole-based cyan couplers described in EP 0456226A1, and pyrroloimidazole-based cyan couplers described in EP 0484909 may be used.

Additionally, of these cyan couplers, pyrroloazole-based cyan couplers represented by the general formula (I) described in JP-A-11-282138 are particularly preferred, and descriptions in paragraphs 0012 to 0059 in the patent including illustrative cyan couplers (1) to (47) may be applied as such to the invention and are incorporated as part of the specification of the invention.

As the magenta dye-forming couplers (hereinafter also referred to merely as "magenta couplers") to be used in the invention, 5-pyrazolone-based magenta couplers or pyrazoloazole-based magenta couplers as described in the known literature given in the foregoing table may be used. Among them, those pyrazolotriazole couplers wherein a secondary or tertiary alkyl group is directly bound to 2-, 3- or 6-position of the pyrazolotriazole ring as described in JP-A-61-65245, those pyrazoloazole couplers which have a sulfonamide group within the molecule as described in JP-A-61-65246, those pyrazoloazole couplers which have an alkoxyphenylsulfonamido ballast group as described in JP-A-61-147254, and pyrazoloazole couplers which have an alkoxy group or an aryloxy group in 6-position as described in EP 226849A and 294785A are preferably used in view of color forming property and the like. In particular, pyrazoloazole couplers represented by the general formula (M-I) described in JP-A-8-122984 are preferred as magenta couplers, and descriptions in paragraphs 0009 to 0026 in the patent are applicable as such to the invention and are incorporated in the specification as part thereof. In addition to these, pyrazoloazole couplers having a steric hindrance group in both 3- and 6-positions as described in EP 854384 and 884640 may preferably be used as well.

Also, as the yellow dye-forming couplers (also referred to merely as "yellow couplers"), acylacetamide type yellow couplers having a 3- to 5-membered ring structure in the acyl group described in EP 0447969A1, malondianilide type yellow couplers having a cyclic structure described in EP 0482552A1, pyrrol-2- or 3-yl or indol-2- or 3-ylcarbonylacetic acid anilide type couplers described in EP 953870A1, EP 953871A1, 953872A1, 953873A1, 953874A1 and EP 953875A1, and acylacetamide type yellow couplers having a dioxane structure described in U.S. Pat. No. 5,118,599 are preferably used in addition to the compounds deswcribed in the foregoing table. Of these, use of acylacetamide type yellow couplers wherein the acyl group is 1-alkylcyclopropane-1-carboxyl group, and malondianilide type yellow couplers wherein one of the anilide constitutes an indoline ring is particularly preferred. These couplers may be used alone or in combination thereof.

The couplers to be used in the invention are preferably impregnated in a loadable latex polymer (described in, for example, U.S. Pat. No. 4,203,716) in the presence (or absence) of a high-boiling organic solvent described in the foregoing table, or dissolving together with a water-insoluble and organic solvent-soluble polymer, then emulsifying and dispersing in a hydrophilic colloid aqueous solution. Examples of the water-insoluble and organic solvent-soluble polymers to be preferably used include those homopolymers or copolymers which are described in U.S. Pat. No. 4,857,449, col. 7 to col. 15 and WO88/00723, pp. 12 to 30. Use of methacrylate-based or acylamide-based polymers, in particular acrylamide-based polymers, is more preferred in view of color image stability.

In the invention, known color mixing inhibitors may be used, with those described in the following patents being preferred.

For example, high molecular redox compounds described in JP-A-5-333501, phenidone or hydrazine compounds described in WO98/33760 and U.S. Pat. No. 4,923,787, and white couplers describged in JP-A-5-249637, JP-A-10-282615 and German Patent No. 1962914A1 may be used. Also, particularly in the case of conducting rapid development by raising pH of a developing solution, it is preferred to use those redox compounds which are described in German Patent No. 19618786A1, EP 839623A1, EP 842975A1, German Patent No. 19806846A1 and French Patent No. 2760460A1.

In the invention, it is preferred to use a compound having a triazine skeletone with a high molar extinction coefficient as a UV ray absorbent. Examples of usable compounds are described in the following patents. These are added preferably to a light-sensitive layer and/or light-insensitive layer.

Examples thereof are described in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent No. 19739797A, EP 711804A and JP-W-8-501291 (the term "JP-W" as used herein means a published Japanese translation of a PCT patent application).

As the binder or protective colloid to be used in the light-sensitive material in accordance with the invention, gelatin is advantageously used, but other hydrophilic colloids may be used alone or in combination with gelatin. Such gelatins contain preferably 5 ppm or less, more preferably 3 ppm or less, heavy metals such as iron, copper, zinc and manganese as impurities. Also, the content of calcium contained in the light-sensitive material is preferably 20 mg/m$^2$ or less, more preferably 10 mg/m$^2$ or less, most preferably 5 mg/m$^2$ or less. In the invention, it is preferred to add to the hydrophilic colloidal layer antibacterial and antifungal agents as described in JP-A-63-271247 in order to control fungi or bacteria which propagate in the hydrophilic layer to deteriorate image.

Further, pH of the coating layers of the light-sensitive material is preferably 4.0 to 7.0, more preferably 4.0 to 6.5.

The total coated gelatin amount in the photograph-constituting layers to be used in the invention is preferably 3 g/m$^2$ to 6 g/m$^2$, more preferably 3 g/m$^2$ to 5 g/m$^2$. Also, in order to attain sufficient development speed, bleach-fixing properties and prevention of residual color even in the case of super-rapid processing, the thickness of the total photograph-constituting layers is preferably 3 $\mu$m to 7.5 $\mu$m, more preferably 3 $\mu$m to 6.5 $\mu$m. The dry thickness of the film can be evaluated by observing change in film thickness before and after peeling the dried film or cross section thereof under an optical microscope or an electron microscope. In the invention, in order to raise both developing speed and drying speed, the thickness of swollen film is preferably 8 $\mu$m to 19 $\mu$m, more preferably 9 $\mu$m to 18 $\mu$m. The thickness of the swollen film can be measured by dipping a dried light-sensitive film in a 35° C. aqueous solution and, after a sufficient equilibrium is reached, measuring through a dotting method. The coated silver amount in the invention is preferably 0.2 g/m$^2$ to 0.5 g/m$^2$, more preferably 0.2 g/m$^2$ to 0.45 g/m$^2$, most preferably 0.2 g/m$^2$ to 0.40 g/m$^2$.

In the invention, a surfactant may be added to the light-sensitive material in view of improvement of coating stability of the light-sensitive material, prevention of generation of static electricity and control of an electric charge amount. Examples of the surfactant include anionic surfactants, cationic surfactants, betaine-based surfactants and nonionic surfactants, described in JP-A-5-333492. As the surfactant to be used in the invention, fluorine atom-containing surfactants are preferred. These fluorine atom-containing surfactants may be used alone or in combination with other conventionally known surfactants, with the combined use with other conventionally known surfactants being preferred. The amount of the surfactant to the light-sensitive material is not particularly limited but is, in general, $1\times10^{-5}$ to 1 g/m$^2$, preferably $1\times10^{-4}$ to $1\times10^{-1}$ g/m$^2$, more preferably $1\times10^{-3}$ to $1\times10^{-2}$ gm$^2$.

The light-sensitive material of the invention is subjected to an exposing step of irradiating it with light according to image information and a developing step of developing the light-irradiated light-sensitive material to thereby form an image.

The light-sensitive material of the invention is adapted for a print system using a common negative printer and for a scan-exposing system using a cathode ray tube (CRT). The CRT exposing apparatus is simpler, more compact and less expensive than an apparatus using a laser light. In addition, it facilitates adjustment of optical axis and color. In the cathode ray tube for use in the imagewise exposure, various light-emitting bodies capable of emitting light in a necessary spectral region are used. For example, one of a red color-emitting body, a green color-emitting body and blue light-emitting body or a mixture of two or more of them are used. The spectral regions are not limited to the above-described red, green and red regions, and fluorescent bodies capable of emitting light in a yellow region, an orange region, a violet region or an infrared region may also be used. In particular, white light-emitting cathode ray tubes containing a mixture of these light-emitting bodies are often employed.

In the case where the light-sensitive material has a plurality of light-sensitive layers respectively having different spectral sensitivity distributions and the cathode ray tube has a fluorescent body capable of emitting light of a plurality of spectral regions, a plurality of colors may be exposed at once, that is, image signals for a plurality of colors may be inputted to the cathode ray tube to emit light from the tube surface. It is also possible to employ an exposing method (sequential surface exposure) wherein image signals for respective colors are input in sequence to conduct light emission in sequence and the emitted light is passed through a film which passes only the emitted light and cuts other lights. In general, the sequential surface exposure is preferred for obtaining higher image quality since it permits to use a cathode ray tube with a high resolution.

In exposing the light-sensitive material of the invention, a digital scanning exposure system is preferably employed wherein a monocolor high-density light is used which is emitted from, for example, a secondary higher harmonics light-emitting source (SHG) wherein a gas laser, a light-emitting diode, a semiconductor laser or a solid-state laser using a semiconductor laser as an exciting light source is combined with a non-linear optical crystal. In order to make the system compact and inexpensive, it is preferred to use the second higher harmonics light-emitting source (SHG) wherein a semiconductor laser or a solid-state laser is combined with a non-linear optical crystal. In particular, in order to design a compact, inexpensive, long-life, stable apparatus, the use of a semiconductor laser is preferred. Thus, at least one of exposing light-sources to be used is preferably the semiconductor laser.

In the case of using such scan-exposing light-sources, the maximum spectral sensitivity wavelength of the light-sensitive material of the invention may be determined freely by selecting wavelength of a scan-exposing light source to be used. With the SHG light source obtained by combining a solid-state laser using a semiconductor laser as an exciting light source or a semiconductor laser with a non-linear optical crystal, oscillating wavelength of the laser can be made half, thus a blue light and a green light being obtained. Therefore, it is possible for the light-sensitive material to have the spectral sensitivity maximum in the common three regions of blue, green and red. The exposure time in such scanning exposure defined as a time for exposing a pixel size with an image density of 400 dpi is preferably $10^{-4}$ second or less, more preferably $10^{-6}$ second or less.

The silver halide color photographic light-sensitive material of the invention exhibits its effects in the case of imagewise exposing with a coherent light of a blue laser of 420 nm to 460 nm in light-emitting wavelength. Of blue lasers, a blue light-emitting semiconductor is particularly preferred to use. The wavelength of emitted light is preferably 430 nm to 450 nm in view of obtaining marked advantages of the invention. Specific preferably usable examples of the laser light source include a blue light-emitting semiconductor laser of 430 to 460 nm in wavelength of emitted light (presented by Nichia Kagaku at $48^{th}$ Oyo Butsurigaku Kankei Rengo Koenkai, March 2001), a green color laser of about 530 nm taken out by wave-converting a semiconductor laser (oscillation wavelength: about 1060 nm) through a $LiNbO_3$ SHG crystal having a waveguide-shaped reversal domain structure, a red color laser of about 685 nm in wavelength (Hitachi type No. HL6738MG), and a red color laser of about 650 nm in wavelength (Hitachi type No. HL6501MG).

So-called latent image period of from the above-described exposure to initiation of color development may be as short as within 9 seconds, or may be several ten minutes or longer in a system wherein an exposing apparatus and a processor are separately and independently provided. A printer wherein the exposing apparatus and the processor are combined is preferred in that total printing period can be made shorter.

The silver halide color photographic light-sensitive material of the invention can preferably be used in combination with the exposing and developing systems described in the following known documents. Examples of the developing system include an automatic printing and developing system described in JP-A-10-333253, a light-sensitive material-conveying apparatus described in JP-A-2000-10206, a recording system containing an image-reading apparatus described in JP-A-11-215312, an exposing system composed of color image-recording system described in JP-A-11-88619 and JP-A-10-202950, a digital photo printing system involving a remote diagnosing system described in JP-A-10-210206, and a photo printing system involving an image-recording apparatus described in JP-A-10-159187.

Preferred scan-exposing systems applicable to the invention are described in detail in the patents shown in the foregoing table.

In the invention, it is also possible to pre-expose in advance a yellow microdot pattern prior to imparting image information to prevent copying as described in EP 0789270A1 and EP 00789480A1.

As to processing of the light-sensitive material of the invention, those processing materials and processing methods are preferably employed which are described in JP-A-2-207250, p. 26, right and lower column, line 1 to p. 34, right and upper column, line 9, and JP-A-4-97355, p. 5, left and upper column, line 17 to p. 18, right and lower column, line 20. Also, as preservatives for use in the developing solution, those compounds which are described in the patents shown in the foregoing table are preferably used.

The invention is applied as a light-sensitive material adapted for rapid processing. The period for color development is 28 seconds or less, preferably 25 seconds or less and 6 seconds or more, more preferably 20 seconds or less and 6 seconds or more. Likewise, the bleach-fixing period is preferably 30 seconds or less, more preferably 25 seconds or less and 6 seconds or more, still more preferably 20 seconds or less and 6 seconds or more. Also, water-washing or stabilizing period is preferably 60 seconds or less, more preferably 40 seconds or less and 6 seconds or more. Additionally, the color-developing period means a period of from introduction of a light-sensitive material into a color developing solution to the introduction thereof into a bleach-fixing solution of the subsequent processing step. For example, in the case of processing in an automatic processor, the sum of the time during which the light-sensitive material is dipped in the color-forming developing solution (so-called in-solution period) and the period during which the light-sensitive material is conveyed in the air from its release out of the color-developing solution toward the bleach-fixing bath of the subsequent bleach-fixing step (so-called in-air period) is referred to as the color-developing period. Likewise, the bleach-fixing period means the time of from introduction of the light-sensitive material into a bleach-fixing solution to introduction thereof into the subsequent water-washing or stabilizing bath. Also, the water-washing or stabilizing period means the period starting from introduction of the light-sensitive material into a stabilizing solution till the drying step during which the light-sensitive material is in the solution (so-called in-solution period).

As a method for developing the exposed light-sensitive material of the invention, there may be employed a thermally developing system using no processing solutions as well as wet methods such as a conventional method of developing in a developing solution containing an alkali agent and a developing agent and a method of incorporating a developing agent in the light-sensitive material and developing in an activator solution of an alkali solution not containing the developing agent. In particular, the activator method is a preferred method in view of control or handling of processing solutions since a developing agent is not contained in the processing solution and in view of environmental preservation due to a small load upon treating waste liquor. As a developing agent or its precursor to be incorporated in the light-sensitive material adapted for the activator method, for example, those hydrazine compounds are preferred which are described in JP-A-8-234388, JP-A-9-152686, JP-A-9-152693, JP-A-9-211814 and JP-A-9-160193.

Also, there may preferably be employed a developing method of conducting an image-amplifying processing (intensifying processing) of a light-sensitive material containing a reduced amount of coated silver using hydrogen peroxide. It is particularly preferred to apply this method to the activator method. Specifically, there may preferably be employed an image-forming method using a hydrogen peroxide-containing activator solution described in JP-A-8-297354 and JP-A-9-152695. In the activator method, the light-sensitive material having been processed in an activator solution is usually subjected to silver-removing processing and, in the image-amplifying processing using a light-sensitive material containing a reduced amount of silver, a simple method of conducting water-washing or stabilizing processing with omitting the silver-removing processing may be employed. Also, in a system of reading image information from a light-sensitive material by means of a scanner, a processing embodiment may be employed which eliminates the necessity of the silver-removing processing even when a high-silver-content light-sensitive material such as a light-sensitive material for photographing use is used.

As processing materials for the activator solution, a silver-removing solution (bleach/fixing solution), a water-washing and stabilizing solution and processing methods, conventionally known ones may be employed. Preferably, those described in Research Disclosure, Item 36544 (September 1994), pp. 536 to 541 and JP-A-8-234388 may be used.

The silver halide color photographic light-sensitive material of the invention exhibits excellent advantages of forming a high-quality image, showing an excellent processing stability and being adapted for rapid processing.

The invention is described by reference to the following Examples which, however, do not limit the invention in any way.

EXAMPLE 1

(Preparation of Emulsion A to be Used in Blue-Sensitive Emulsion Layer)

A 1:1 mixture (molar ratio of silver) of a large-sized emulsion A1 of cubic grains having an average grain size of 0.70 $\mu$m and a small-sized emulsion A2 of grains having an average grain size of 0.50 $\mu$m was prepared, which was referred to as emulsion A.

Variation coefficients of grain size distribution of the emulsion A1 and emulsion A2 were 0.09 and 0.11, respectively. In respective emulsions, 0.5 mol % of silver bromide was localized on part of the surface of the grains mainly composed of silver chloride. In a position 10% by volume from the outermost surface was allowed to exist 0.1 mol % of iodide ion based on the total halide, and $1\times10^{-6}$ mol of $K_4Ru(CN)_6$ per mol of silver halide, $1\times10^{-7}$ mol % of yellow prussiate of potash per mol of silver halide, and $1\times10^{-8}$ mol % of $K_2IrCl_5(H_2O)$ per mol of silver halide were allowed to exist.

The following blue-sensitive sensitizing dyes A and B were added to the emulsion Al in an amount of $3.2\times10^{-4}$ mol per mol of silver and to the emulsion A2 in an amount of $4.4\times10^{-4}$ mol per mol of silver to conduct spectral sensitization.

(Sensitizing dye A)

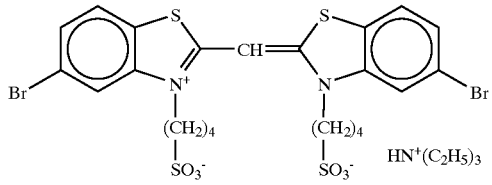

(Sensitizing dye B)

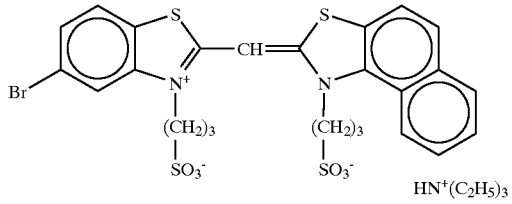

(Preparation of Emulsions C1-B and I-B for Use in Green-sensitive Emulsion Layer)

An emulsion C1-B of cubic grains having an average size of 0.40 $\mu$m and having no silver iodochloride phase in the shell portion thereof was prepared. The variation constant of the grain size distribution was 0.09. 0.4 mol % of silver bromide was localized on the grain surface. Also, similarly to the emulsion A, $K_4Ru(CN)_6$, yellow prussiate of potash, and $K_2IrCl_5(H_2O)$ were allowed to exist. Thus, there was prepared an emulsion C1-B.

Also, an emulsion I-B having a silver iodochloride phase in the shell portion thereof was prepared in the same manner as with the emulsion C1-B except for incorporating 0.1 mol % of silver iodide in the vicinity of the grain surface.

Also, an emulsion TT-B containing silver iodide uniformly from the interior to the surface layer of grains was prepared by simultaneously adding a sodium chloride aqueous solution containing potassium iodide and a silver nitrate aqueous solution. The silver iodide content was 0.1 mol %.

To the emulsions were added a sensitizing dye D in an amount of $3.3\times10^{-4}$ mol per mol of silver halide, a sensitizing dye E in an amount of $5\times10^{-5}$ mol per mol of silver halide and a sensitizing dye F in an amount of $2.3\times10^{-4}$ mol per mol of silver halide.

(Sensitizing dye D)

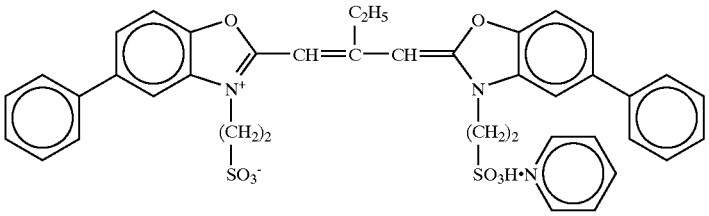

(Sensitizing dye E)

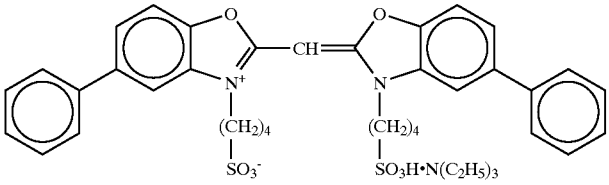

(Sensitizing dye F)

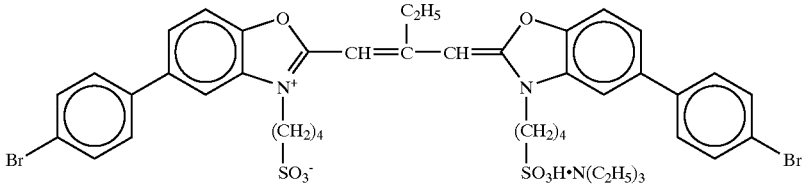

(Preparation of Emulsion C for Use in Red-sensitive Emulsion Layer)

A 1:1 mixture (molar ratio of silver) of a large-sized emulsion C1 of cubic grains having an average grain size of 0.40 $\mu$m and a small-sized emulsion C2 of grains having an average grain size of 0.30 $\mu$m was prepared.

Variation coefficients of grain size distribution of the emulsion C1 and emulsion C2 were 0.09 and 0.11, respectively. In respective emulsions, 0.1 mol % of silver iodide was incorporated in the vicinity of the surface of the grains, and 0.8 mol % of silver bromide was localized on the surface of the grains. Also, similarly to the emulsion A, $K_4Ru(CN)_6$, yellow prussiate of potash, and $K_2IrCl_5(H_2O)$ were allowed to exist.

A sensitizing dyes G and H were added to the large-sized emulsion in an amount of $8.0\times10^{-5}$ mol per mol of silver and to the small-sized emulsion in an amount of $10.7\times10^{-5}$ mol per mol of silver. Further, the following compound I was added to the red-sensitive emulsion layer in an amount of $3.0\times10^{-3}$ mol per mol of silver halide.

(Sensitizing dye G)

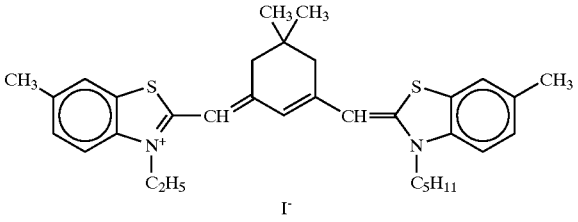

-continued (Sensitizing dye H)

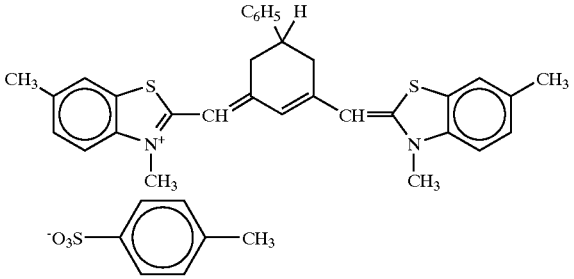

(Compound I)

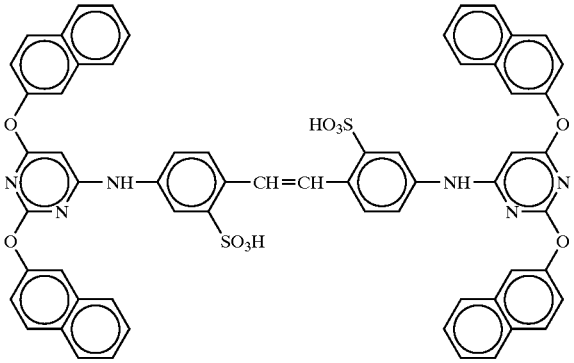

(Preparation of Color Photographic Light-sensitive Material and Coated Sample)

The surface of a support comprising paper having coated with a polyethylene resin on both sides was subjected to corona discharge treatment, a gelatin undercoating layer containing sodium dodecylbenzene-sulfonate was provided thereon, and a photograph-constituting layers of the first layer to the seventh layer were provided in order by coating to thereby prepare a sample (001) of a silver halide color photographic material having the layer configuration shown below. Coating solutions for the respective photograph-constituting layers were prepared in the following manner.

Preparation of a Coating Solution for the First Layer:

57 g of a yellow coupler (ExY), 7 g of a color image-stabilizing agent (Cpd-1), 4 g of a color image-stabilizing agent (Cpd-2), 7 g of a color image-stabilizing agent (Cpd-3) and 2 g of a color image-stabilizing agent (Cpd-8) were dissolved in 21 g of a solvent (Solv-1) and 80 ml of ethyl acetate, and emulsifying and dispersing this solution in 220 g of a 23.5% by weight of gelatin aqueous solution containing 4 g of sodium dodecylbenzenesulfonate using a high-speed stirring emulsifier (dissolver), followed by adding thereto water to prepare 900 g of an emulsion dispersion A.

On the other hand, the emulsion dispersion A and the emulsion A were mixed to dissolve, thus a first layer coating solution having the following formulation being prepared. The amount of coated emulsion was presented in terms of the amount of silver.

Coating solutions for the second to the seventh layers, were prepared in the same manner as with the first layer-coating solution. As hardening agents for gelatin in respective layers, sodium (2,4-dichloro-6-oxide-1,3,5-triazine) (H-1), (H-2) and (H-3) were used. Also, to the respective layers were added Ab-1, Ab-2, Ab-3 and Ab-4 in total amounts of 15.0 mg/m$^2$, 60.0 mg/m$^2$, 5.0 mg/m$^2$ and 10.0 mg/m$^2$, respectively.

(H-1) Hardening agent

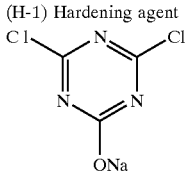

(used in an amount of 1.4% by weight based on gelatin)

(H-2) Hardening agent $CH_2{=}CHSO_2CH_2CONHCH_2$ $CH_2{=}CHSO_2CH_2CONHCH_2$ (H-3) Hardening agent $CH_2{=}CHSO_2CH_2CONHCH_2$ $CH_2$ $CH_2{=}CHSO_2CH_2CONHCH_2$ (Ab-1) Antiseptic

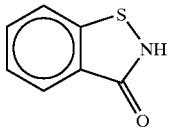

(Ab-2) Antiseptic

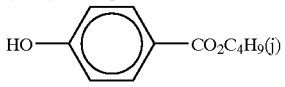

(Ab-3) Antiseptic

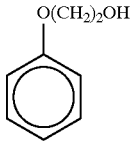

-continued (Ab-4) Antiseptic

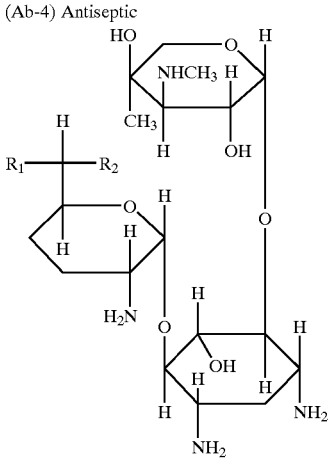

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A 1:1:1:1 Mixture of a, b, c and d (Molar Ratio)

Next, chemically sensitizing step is described below. The aforesaid emulsions were heated to 40° C., chloroautic acid and an optimal amount of sodium thiosulfate pentahydrate was added thereto and, after heating at 60° C. for 40 minutes, the aforesaid sensitizing dyes were added thereto and, after cooling to 40° C., 1-(3-methylureidophenyl)-5-mercaptotetrazole was added to the emulsions in amounts of $3.3\times10^{-4}$ mol, $1.0\times10^{-3}$ mol and $5.9\times10^{-4}$ mol, respectively, per mol of silver halide. The emulsions of the invention were prepared by conducting chemical sensitization with changing chloroauric acid to gold sulfide as shown in the following Table 2.

Also, 1-(3-methylureidophenyl)-5-mercpatotetrazole was added to the second, fourth, sixth and seventh layers in amounts of 0.2 mg/m$^2$,0.2 mg/m$^2$, 0.6 mg/m$^2$ and 0.1 mg/m$^2$ respectively.

Also, to the blue-sensitive emulsion layer and the green-sensitive emulsion layer was added 4-hydroxy-6-methyl-1,3,3a,7-tetrazaindene in amounts of $1\times10^{-4}$ mol and $2\times10^{-4}$ mol, respectively, per mol of silver halide.

Also, to the red-sensitive emulsion layer was added a methacrylic acid/butyl acrylate copolymer latex (1:1 by weight; average molecular weight:200000 to 400000) in an amount of 0.05 g/m$^2$.

Also, to the second, fourth, and sixth layers was added disodium cathecol-3,5-disulfonate in amounts of 6 mg/m$^2$, 6 mg/m$^2$ and 18 mg/m$^2$, respectively.

Also, in order to prevent irradiation, the following dyes were added. (Amounts within the parentheses represent coated amounts.)

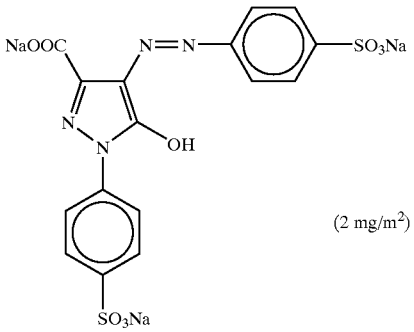

(2 mg/m$^2$)

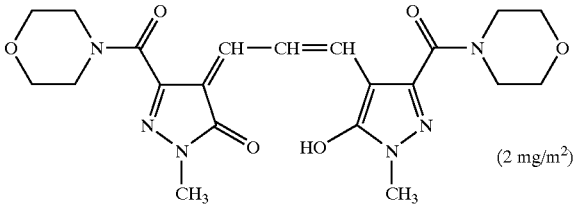

(2 mg/m$^2$)

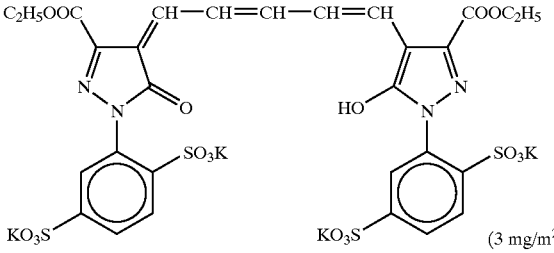

(3 mg/m$^2$)

-continued

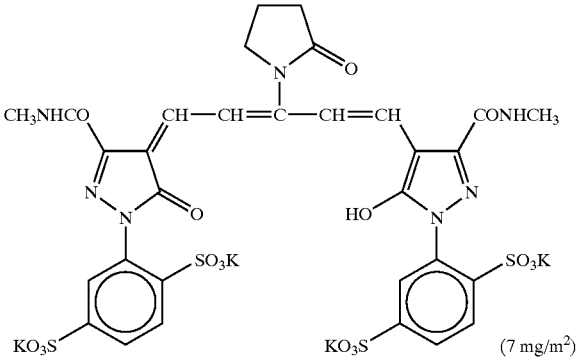

(7 mg/m$^2$)

(Layer Configuration)

Configuration of each layer is shown below. Numerals designate coated amounts (g/m$^2$) Numerals for silver halide emulsions designate coated amounts in terms of silver amount.

Support: Polyethylene Resin-laminated Paper

[containing on the first layer side a white pigment ($TiO_2$; content: 16% by weight; ZnO: content: 4% by weight and a fluorescent brightening agent (4,4'-bis(5-methylbenzoxazolyl)stilbene; content: 0.03% by weight), and a bluing dye (ultramarine)]

| | |
|---|---|
| First layer (blue-sensitive emulsion layer): | |
| Emulsion A | 0.24 |
| Gelatin | 1.25 |
| Yellow coupler (ExY) | 0.57 |
| Color image-stabilizing agent (Cpd-1) | 0.07 |
| Color image-stabilizing agent (Cpd-2) | 0.04 |
| Color image-stabilizing agent (Cpd-3) | 0.07 |
| Color image-stabilizing agent (Cpd-8) | 0.02 |
| Solvent (Solv-1) | 0.21 |
| Second layer (color mixing-inhibiting layer) | |
| Gelatin | 0.99 |
| Color mixing inhibitor (Cpd-4) | 0.09 |
| Color image-stabilizing agent (Cpd-5) | 0.018 |
| Color image-stabilizing agent (Cpd-6) | 0.13 |
| Color image-stabilizing agent (Cpd-7) | 0.01 |
| Solvent (Solv-1) | 0.06 |
| Solvent (Solv-2) | 0.22 |
| Third layer (green-sensitive emulsion layer) | |
| Emulsion C1-B | 0.14 |
| Gelatin | 1.36 |
| Magenta coupler (ExM) | 0.15 |
| UV ray absorbent (UV-A) | 0.14 |
| Color image-stabilizing agent (Cpd-2) | 0.02 |
| Color image-stabilizing agent (Cpd-4) | 0.002 |
| Color image-stabilizing agent (Cpd-6) | 0.09 |
| Color image-stabilizing agent (Cpd-8) | 0.02 |
| Color image-stabilizing agent (Cpd-9) | 0.03 |
| Color image-stabilizing agent (Cpd-10) | 0.01 |
| Color image-stabilizing agent (Cpd-11) | 0.0001 |
| Solvent (Solv-3) | 0.11 |
| Solvent (Solv-4) | 0.22 |
| Solvent (Solv-5) | 0.20 |

-continued

| | |
|---|---|
| **Fourth layer (color mixing-inhibiting layer)** | |
| Gelatin | 0.71 |
| Color mixing inhibitor (Cpd-4) | 0.06 |
| Color image-stabilizing agent (Cpd-5) | 0.013 |
| Color image-stabilizing agent (Cpd-6) | 0.10 |
| Color image-stabilizing agent (Cpd-7) | 0.007 |
| Solvent (Solv-1) | 0.04 |
| Solvent (Solv-2) | 0.16 |
| **Fifth layer (red-sensitive emulsion layer)** | |
| Emulsion C | 0.12 |
| Gelatin | 1.11 |
| Cyan coupler (ExC-2) | 0.13 |
| Cyan coupler (ExC-3) | 0.03 |
| Color image-stabilizing agent (Cpd-1) | 0.05 |
| Color image-stabilizing agent (Cpd-6) | 0.06 |
| Color image-stabilizing agent (Cpd-7) | 0.02 |
| Color image-stabilizing agent (Cpd-9) | 0.04 |
| Color image-stabilizing agent (Cpd-10) | 0.01 |
| Color image-stabilizing agent (Cpd-14) | 0.01 |
| Color image-stabilizing agent (Cpd-15) | 0.12 |
| Color image-stabilizing agent (Cpd-16) | 0.03 |
| Color image-stabilizing agent (Cpd-17) | 0.09 |
| Color image-stabilizing agent (Cpd-18) | 0.07 |
| Solvent (Solv-5) | 0.15 |
| Solvent (Solv-8) | 0.05 |
| **Sixth layer (UV ray-absorbing layer)** | |
| Gelatin | 0.46 |
| UV ray absorbent (UV-B) | 0.45 |
| Compound (S1-4) | 0.0015 |
| Solvent (Solv-7) | 0.25 |
| **Seventh layer (protective layer)** | |
| Gelatin | 1.00 |
| Acryl-modified copolymer of polyvinyl alcohol (modification degree: 17%) | 0.04 |
| Liquid paraffin | 0.02 |
| Surfactant (Cpd-13) | 0.01 |

(ExY) Yellow coupler
a 70:30 (molar ratio) of

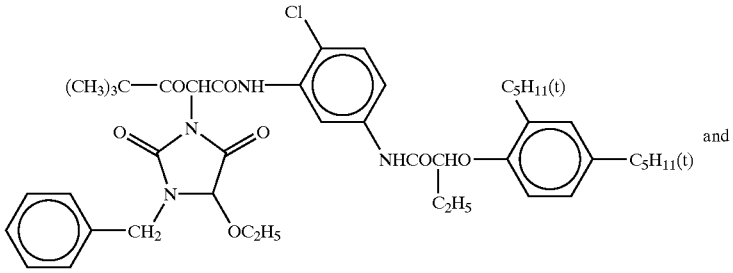

and

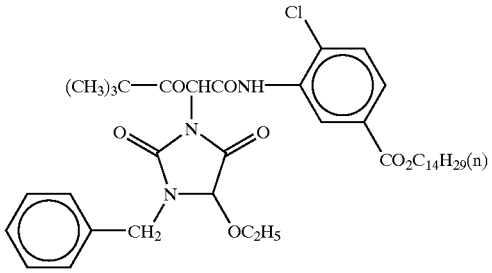

(ExM) Magenta coupler
a 40:40:20 (molar ratio) mixture of

-continued
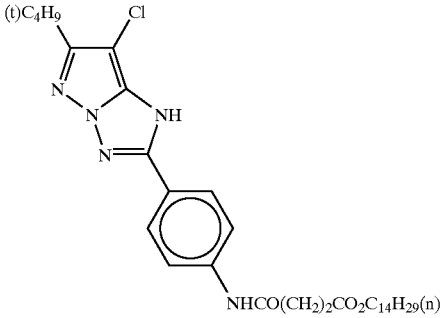
and
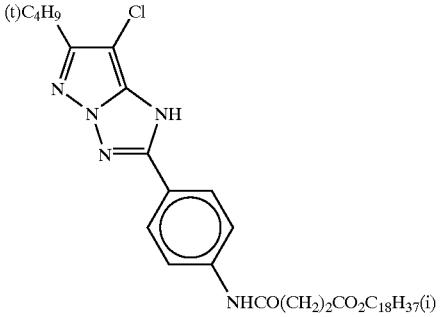
and
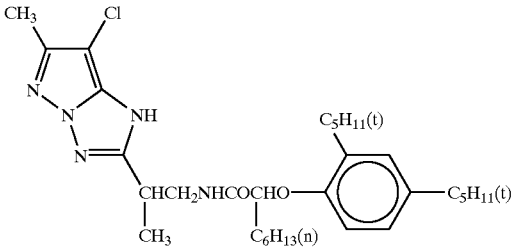
(ExC-2) Cyan coupler
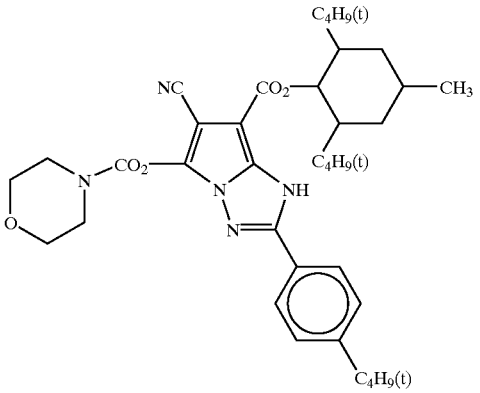
(ExC-3) Cyan coupler
a 50:25:25 (molar ratio) mixture of
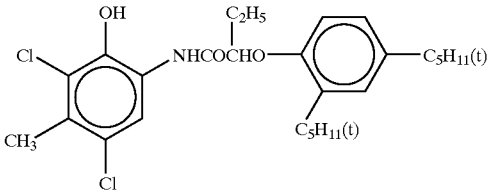
and -continued
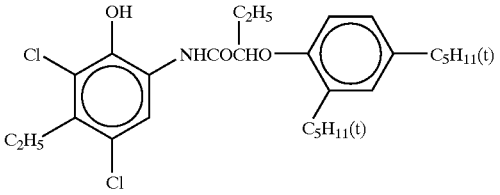
and
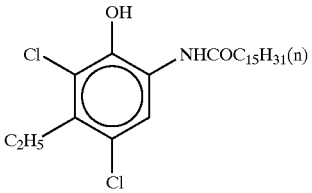
(Cpd-1) Color image-stabilizing agent
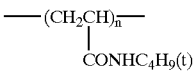
number-average molecular weight: 60,000
(Cpd-2) Color image-stabilizing agent
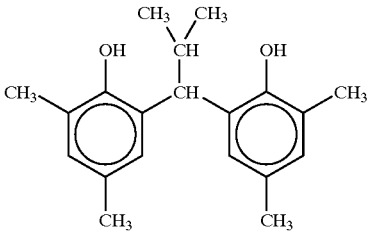
(Cpd-3) Color image-stabilizing agent
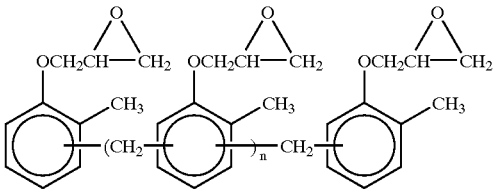
n = 7 to 8 (average value)
(Cpd-4) Color mixing inhibitor
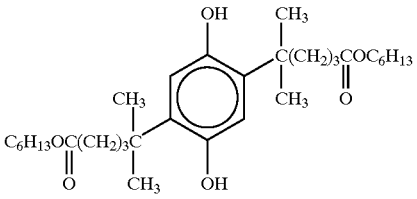
(Cpd-5) Color image-stabilizing agent
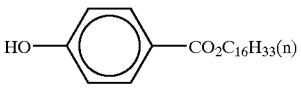
(Cpd-6) Color image-stabilizing agent
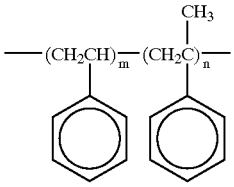
number average molecular weight: 600; m/n = 10/90
(Cpd-7) Color image-stabilizing agent -continued
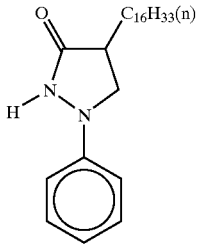
(Cpd-8) Color image-stabilizing agent
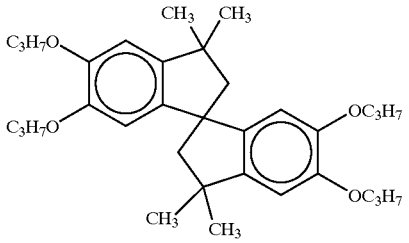
(Cpd-9) Color image-stabilizing agent
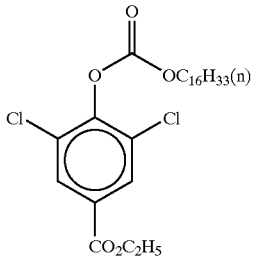
(Cpd-10) Color image-stabilizing agent
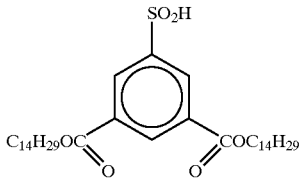
(Cpd-11)
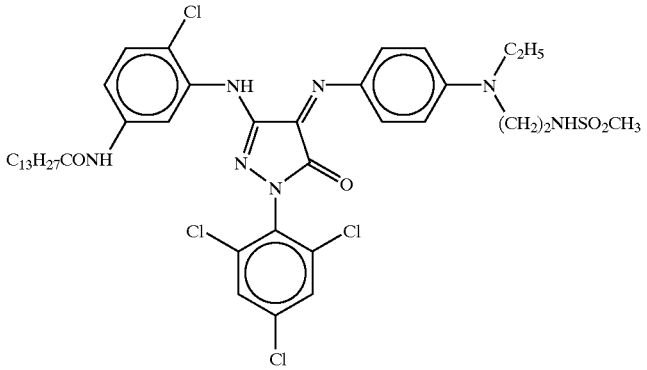
(Cpd-13) Surfactant
a 7:3 (molar ratio) mixture of
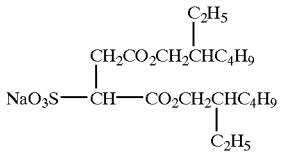
and -continued
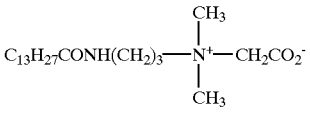
(Cpd-14)
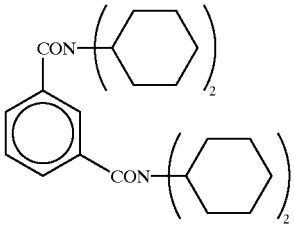
(Cpd-15)
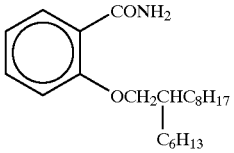
(Cpd-16)
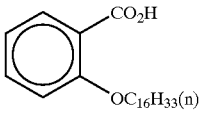
(Cpd-17)
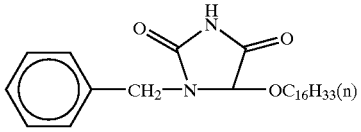
(Cpd-18)
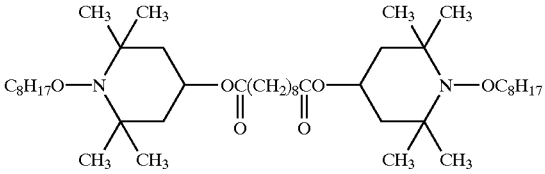
(Cpd-19) Color mixing inhibitor
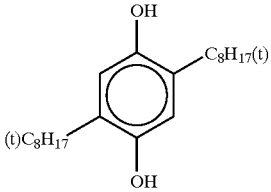
(UV-1) UV ray absorbent
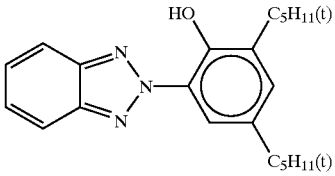
(UV-2) UV ray absorbent
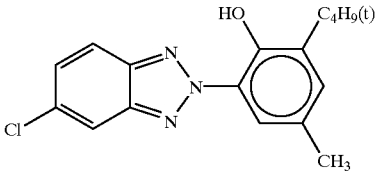
(UV-3) UV ray absorbent -continued
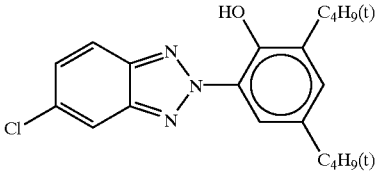
(UV-4) UV ray absorbent
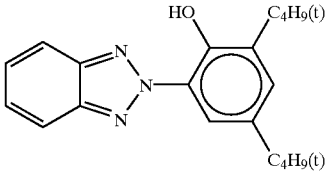
(UV-5) UV ray absorbent
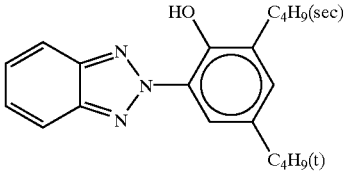
(UV-6) UV ray absorbent
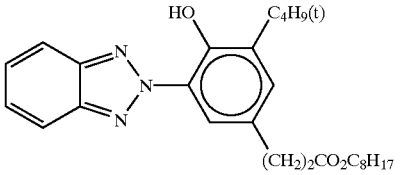
(UV-7) UV ray absorbent
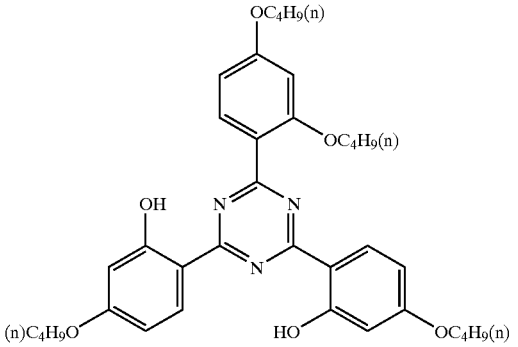
UV-A: a mixture of UV-1/UV-2/UV-3/UV-4 = 4/2/2/3 (weight ratio)
UV-B: a mixture of UV-1/UV-2/UV-3/UV-4/UV-5/-UV-6 = 9/3/3/4/5/3 (weight ratio)
UV-C: a mixture of UV-2/UV-3/UV-6/UV-7 = 1/1/1/2 (weight ratio)
(Solv-1)
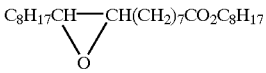
(Solv-2)
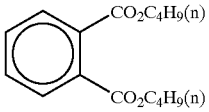
(Solv-3)
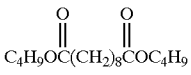
(Solv-4)
$O{=}P(OC_6H_{13}(n))_3$
(Solv-5)

-continued

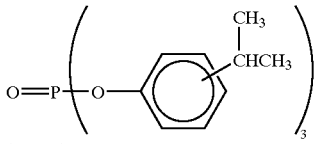

(Solv-7)

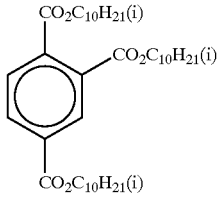

(Solv-8)

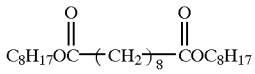

(S1-4)

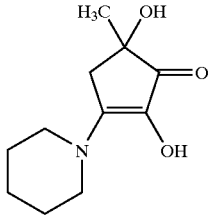

Other samples were prepared in the same manner as with the sample (001) except for changing the emulsion C1-B for the sample (001) to those described in Table 2. The emulsions described in Table 2 each was chemically sensitized with the sensitizer described in Table 2.

In order to examine photographic properties of these samples, the following experiments were conducted.

Experiment 1 Sensitometry (Low Intensity and High Intensity)

A gradated exposure for sensitometry was given to each of the coated samples using a sensitometer (model FWH; made by Fuji Photo Film Co., Ltd.). A low-intensity exposure was given with an exposure amount of 200 lx·sec for 10 seconds through an SP-2 filter.

Also, a gradated exposure for sensitometry was given using a sensitometer for high-intensity exposure (model HIE; made by Yamashita Denso K.K.). A high-intensity exposure was conducted for $10^{-4}$ second through the SP-2 filter.

After the exposure, color development processing A described hereinafter was conducted.

The density of the formed magenta color of each of the processed samples was measured to determine a low intensity sensitivity for the 10-second exposure and a high intensity sensitivity for the $10^{-4}$-second exposure. The sensitivity was determined as a reciprocal of an exposure amount giving a color density higher than the minimum color density by 1.5, and a relative value taking the sensitivity of the development-processed sample (001) as 100 was referred to as a relative sensitivity. Also, gradation was determined based on the inclination of a straight line between a point for said sensitivity and a sensitivity point at 1.5 in density.

Experiment 2 Exposure Humidity Dependence of Sensitivity

The relative sensitivity (RH) upon exposing each sample was set to 55% and 80%. Each sample was exposed for 1/10 second, then subjected to the processing A, followed by measuring the magenta color density of each sample. The sensitivity was determined as a reciprocal of an exposure amount giving a color density higher than the minimum color density by 0.5, and a relative value taking the sensitivity of the development-processed sample (001) as 100 was referred to as a relative sensitivity. A difference obtained by subtracting the relative sensitivity for the exposure at a humidity of 80% from the relative sensitivity for the exposure at a humidity of 55% (hereinafter referred to as "dS") was determined.

Results of the Experiments 1 and 2 are tabulated in Table 2.

TABLE 2

| Sample No. | Emulsion | Content of AgI (mol %) (position) | Gold Sensitizer | Amount of gold in gold sensitizer in the left column (mol (Au)/mol Ag) | Sensitivity (10 sec) | Sensitivity ($10^{-4}$ sec) | dS (Difference in sensitivity due to difference in Rh) | Note |
|---|---|---|---|---|---|---|---|---|
| 001 | C1-B | 0 | Chloroauric acid | 17 | 90 | 82 | 10 | Comparative Ex.. |
| 002 | C1-D | " | Comparative compound A | " | 96 | 90 | 8 | " |

TABLE 2-continued

| Sample No. | Emulsion | Content of AgI (mol %) (position) | Gold Sensitizer | Amount of gold in gold sensitizer in the left column (mol (Au)/mol Ag) | Sensitivity (10 sec) | Sensitivity ($10^{-4}$ sec) | dS (Difference in sensitivity due to difference in Rh) | Note |
|---|---|---|---|---|---|---|---|---|
| 003 | C1-E | " | Comparative compound B | " | 93 | 84 | 9 | " |
| 004 | C1-F | " | P1-1C | " | 100 | 95 | 6 | " |
| 005 | C1-G | " | P1-5 | " | 100 | 98 | 6 | " |
| 006 | C1-H | " | P1-15 | " | 103 | 102 | 5 | " |
| 007 | I-B | 0.1 (shell) | Chloroauric acid | 17 | 100 | 100 | 12 | " |
| 008 | I-D | " | Comparative compound A | " | 107 | 110 | 10 | " |
| 009 | I-E | " | Comparative compound B | " | 103 | 103 | 11 | " |
| 010 | I-F | " | P1-1C | " | 115 | 122 | 4 | Example |
| 011 | I-G | " | P1-5 | " | 116 | 125 | 4 | " |
| 012 | I-H | " | P1-15 | " | 122 | 131 | 3 | " |
| 013 | IT-B | 0.1 (uniform) | Chloroauric acid | 17 | 92 | 83 | 11 | Comparative Ex. |
| 014 | IT-D | " | Comparative compound A | " | 97 | 93 | 9 | " |
| 015 | IT-E | " | Comparative compound B | " | 95 | 85 | 10 | " |
| 016 | IT-F | " | P1-1C | " | 102 | 96 | 7 | " |

Comparative compound A: bis (1,4,5-trimethyl-1,2,4-triazolium-3-thiolato) aurous tetrafluoroborate (compound described in JP-A-4-267249)

Comparative compound B: potassium bis (1-[3-(2-sulfonatobenzamido)phenyl]-5-mercaptotetrazole potassium salt) aurate (I) 5 hydrate (compound described in JP-A-11-218870)

Table 2 reveals the following.

The emulsions of the invention using the compound capable of releasing $AuS^-$ ion are more sensitive than the conventional emulsions having been subjected to the gold-sulfur sensitization using chloroauric acid and the emulsion having been subjected to the gold-sulfur sensitization using meso-ion gold. The emulsions of the invention are highly sensitive even upon the $10^{-4}$ exposure (high-intensity exposure), and show excellent reciprocity law properties. In addition, it is seen that, while the conventional gold-sulfur-sensitized emulsions involve the problem that they are liable to undergo change in sensitivity due to change in humidity upon exposure, the emulsions of the invention have the advantage that they undergo an extremely small change in sensitivity. Such advantages were not obtained by using the comparative compound B not releasing an ion having the $AuS^-$ structure and the meso-ion gold (comparative compound A) not releasing an ion having the $AuS^-$ structure.

The above-described difference due to difference in sensitizing method is particularly more remarkable with silver halide grains containing silver iodide in the shell portion thereof than with silver halide grains not containing silver iodide in the shell portion thereof.

Processing steps are shown below.

[Processing A]

A continuous processing (running test) was conducted in the following processing steps till the replenishing amount reached two times the volume of a color-developing tank. The processing with the running solution is designated "Processing A".

| Processing step | Temperature | Period | Replenished amount* |
|---|---|---|---|
| Color development | 38.5° C. | 45 sec | 45 ml |
| Bleach-fixing | 38.0° C. | 45 sec | 35 ml |
| Rinsing (1) | 38.0° C. | 20 sec | — |

-continued

| Processing step | Temperature | Period | Replenished amount* |
|---|---|---|---|
| Rinsing (2) | 38.0° C. | 20 sec | — |
| Rinsing (3)** | 38.0° C. | 20 sec | — |
| Rinsing (4)** | 38.0° C. | 30 sec | 121 ml |

*Replenished amount per $m^2$ of the light-sensitive material

**Rinse-cleaning system RC50D made by Fuji Photo Film Co., Ltd. was installed in the rinsing step (3), and the rinsing solution was taken out of the rinsing (3), then fed to a reverse osmosis membrane module (RC50D) using a pump. The osmosed water from the tank was fed to the rinsing step (4), and the concentrated water was returned to the rinsing step (3). The pressure of the pump was adjusted so that the amount of the osmosed water from the revere osmosis module was kept at a level of 50 to 300 ml/min, and the circulation was conducted for 10 hours a day with controlling the temperature. (Rinsing was conducted in a tank-countercurrent manner of from (1) to (4)).

Formulation of each of the processing solutions is as follows.

| | [Tank solution] | [Replenishing solution] |
|---|---|---|
| [Color developing solution] | | |
| Water | 800 ml | 800 ml |
| Dimethylpolysilocane-based surfactant (Silicone KF351A; made by Sin-etsu Kagaku kogyo K. K.) | 0.1 g | 0.1 g |
| Tri(isopropanol)amine | 8.8 g | 8.8 g |
| Ethylenediaminetetraacetic acid | 4.0 g | 4.0 g |
| Polyethylene glycol (Mw: 300) | 10.0 g | 10.0 g |
| Sodium 4,5-Dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-based fluorscent brightening agent (Hakkol FWA-SF; made by Showa Kagaku K. K.) | 2.5 g | 5.0 g |
| Sodium sulfite | 0.1 g | 0.1 g |
| Disodium N,N-bis(sulfonatoethyl) hydroxylamine | 8.5 g | 11.1 g |
| N-Ethyl-N-(β-methanesulfonamidoethyl)-3-methyl-4-amino-4-amino-aniline 3/2 sulfate monohydrate | 5.0 g | 15.7 g |

-continued

| | [Tank solution] | [Replenishing solution] |
|---|---|---|
| Potassium carbonate | 26.3 g | 26.3 g |
| Water to make | 1000 ml | 1000 ml |
| pH (at 25° C.; adjusted by using potassium hydroxide) | 10.15 | 12.50 |
| [Bleach-fixing solution] | | |
| Water | 700 ml | 600 ml |
| Ammonium iron(III) ethylenediaminetetraacetate | 47.0 g | 94.0 g |
| Ethylenediaminetetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/l) | 107.0 ml | 214.0 ml |
| Ammonium sulfite | 16.0 g | 32.0 g |
| Ammonium bisulfite | 23.1 g | 46.2 g |
| Water to make | 1000 ml | 1000 ml |
| pH (at 25° C.; adjusted with ammonia) | 6.0 | 6.0 |
| [Rinsing solution] | | |
| Sodium chlorinated isocyanurate | 0.02 g | 0.02 g |
| Deionized water (5 μS/cm or less in electric conductivity) | 1000 ml | 1000 ml |
| pH | 6.5 | 6.5 |

EXAMPLE 2

(Preparation of Emulsion B-1)

1000 ml of a 3% aqueous solution of lime-processed gelatin was adjusted to 3.5 in pH and 11.5 in pCl, and an aqueous solution containing 2.12 mols of silver nitrate and an aqueous solution containing 2.2 mols of sodium chloride were simultaneously added thereto at 50° C. under vigorous stirring. Potassium bromide was added from the point where 80% of addition of silver nitrate was finished to the point where 90% of addition of silver nitrate was finished so that the amount of the bromide became 3 mol % per mol of formed silver halide. Likewise, an aqueous solution of $K_4[Fe(CN)_6]$ was added from the point where 80% of addition of silver nitrate was finished to the point where 90% of addition of silver nitrate was finished so that the amount of Fe became $2.5\times10^{-5}$ mol per mol of formed silver halide. An aqueous solution of $K_2[IrCl_6]$ was added from the point where 82% of addition of silver nitrate was finished to the point where 88% of addition of silver nitrate was finished so that the amount of Ir became $5.3\times10^{-8}$ mol per mol of formed silver halide. At a point where 90% of the addition of silver nitrate was finished, an aqueous solution of potassium iodide was added thereto so that the amount of I became 0.25 mol % per mol of the formed silver halide and an aqueous solution of $K_2[Ir(H_2O)Cl_5]$ so that the amount of Ir became $8.0\times10^{-7}$ mol per mol of the formed silver halide. After subjecting the emulsion to desalting treatment at 40° C., 150 g of lime-processed gelatin was added thereto to adjust pH to 5.5 and pCl to 1.9. The resultant grains were cubic silver chlorobromoiodide grains having a sphere-equivalent diameter of 0.73 μm and a variation coefficient of 8.5%.

This emulsion was dissolved at 40° C., and sodium benzenethiosulfonate was added thereto in an amount of $1.5\times10^{-5}$ mol per mol of silver halide, followed by optimally ripening at 60° C. using sodium thiosulfate pentahydrate as a sulfur sensitizer and bis(1,4,5-trimethyl-1,2,4-triazolium-3-thiolato) aurate(I) tetra-fluoroborate as a gold sensitizer. After decreasing the temperature to 40° C., the sensitizing dye A' was added in an amount of $1.9\times10^{-4}$ mol per mol of silver halide, the sensitizing dye B' was added in an amount of $1.0\times10^{-4}$ mol per mol of silver halide, 1-phenyl-5-meraptotetrazole was added in an amount of $2.0\times10^{-4}$ mol per mol of silver halide, 1-(5-methylureidophenyl)-5-mercaptotetrazole was added in an amount of $2.0\times10^{-4}$ mol per mol of silver halide, and potassium bromide was added in an amount of $1.8\times10^{-3}$ mol per mol of silver halide. The thus-obtained emulsion was referred to as emulsion B-1.

(Sensitizing dye A')

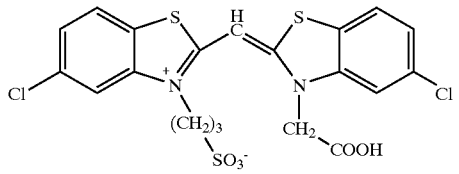

(Sensitizing dye B')

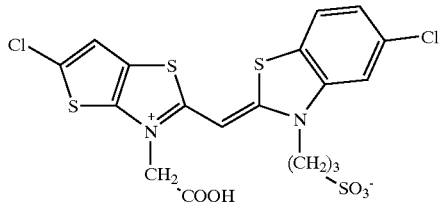

(Preparation of Emulsions B-2 and B-3)

Emulsions B-2 and B-3 were obtained in the same manner as with the emulsion B-1 except for changing the rate of simultaneously adding silver nitrate and sodium chloride and changing the amounts of $K_4[Fe(CN)_6]$, $K_2[IrCl_6]$ and $K_2[Ir(H_2O)Cl_5]$ and various compounds to be added after the desalting treatment. The emulsions B-2 and B-3 were emulsions containing cubic silver chlorobromoiodide grains of 0.68 μm and 0.17 μm, respectively, in equivalent-sphere diameter and 8.3% and 10.3%, respectively, in variation coefficient.

(Preparation of Emulsion G-1)

The same procedures as with the emulsion B-1 were conducted except for changing the rate and temperature of simultaneously adding silver nitrate and sodium chloride, changing the period of addition of the aqueous solution of $K_4[Fe(CN)_6]$ to a period from a point where 75% of the addition of silver nitrate was finished to a point where 90% of the addition of silver nitrate was finished, changing the period of addition of the aqueous solution of $K_2[IrCl_6]$ to a period from a point where 77% of the addition of silver nitrate was finished to a point where 88% of the addition of silver nitrate was finished, changing the amounts of $K_4[Fe(CN)_6]$, $K_2[IrCl_6]$ and $K_2[Ir(H_2O)Cl_5]$ and, after desalting treatment at 40° C., adding 150 g of lime-processed gelatin to adjust pH to 5.5 and pCl to 11.9. The thus-obtained grains were cubic silver chlorobromoiodide grains having an equivalent-sphere diameter of 0.44 μm and a variation coefficient of 9.3%.

This emulsion was dissolved at 40° C. and sodium benzenethiosulfonate was added thereto in an amount of $2\times10^{-5}$ mol per mol of silver halide, followed by optimally ripening at 60° C. using sodium thiosulfate pentahydrate as a sulfur sensitizer and bis(1,4,5-trimethyl-1,2,4-triazolium-3-thiolato) aurate(I) tetrafluoroborate as a gold sensitizer. After decreasing the temperature to 40° C., the sensitizing dye C was added in an amount of $7.2\times10^{-4}$ mol per mol of silver halide, 1-phenyl-5-meraptotetrazole was added in an amount of $2.2\times10^{-4}$ mol per mol of silver halide, 1-(5-methylureidophenyl)-5-mercaptotetrazole was added in an amount of $9\times10^{-4}$ mol per mol of silver halide, and potassium bromide was added in an amount of $1.8\times10^{-3}$ mol per mol of silver halide. The thus-obtained emulsion was referred to as emulsion G-1.

(Sensitizing dye C)

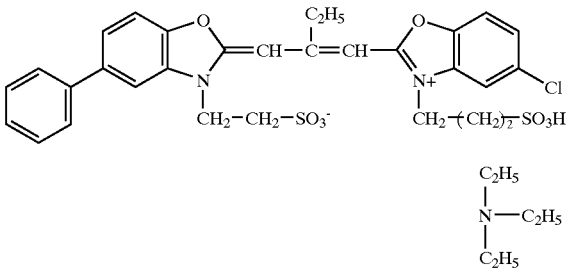

(Preparation of Emulsions G-2 and G-3)

Emulsions G-2 and G-3 were obtained in the same manner as with the emulsion G-1 except for changing the rate of simultaneously adding silver nitrate and sodium chloride, changing the amounts of $K_4[Fe(CN)_6]$, $K_2[IrCl_6]$ and $K_2[Ir(H_2O)Cl_5]$ to be added and the amounts of various compounds to be added after the desalting treatment. The thus-obtained emulsions G-2 and G-3 were cubic silver chlorobromoiodide emulsions containing grains having equivalent-sphere diameters of 0.38 μm and 0.19 μm, respectively, and variation coefficients of 9.0% and 11.0%, respectively.

(Preparation of Emulsions R-1 to R-3)

Emulsions R-1 to R-3 were obtained in the same manner as with the emulsions G-1 to G-3, respectively, except for using the sensitizing dye G used in Example 1 and compound I in place of the sensitizing dyes used in the emulsions G-1 to G-3. The resultant emulsions R-1 to R-3 were cubic silver chlorobromoiodide emulsions containing grains having equivalent-sphere diameters of 0.44 μm, 0.38 μm and 0.19 μm, respectively, and variation coefficients of 9.7%, 9.1% and 12.5%, respectively.

A sample (101) having a reduced thickness was prepared by using the above-prepared emulsions and changing the layer configuration from that of the sample (001) to that shown below.

(Layer Configuration)

Configurations of respective layers are shown below. Numerals designate coated amounts ($g/m^2$). With emulsions, numerals designate coated amounts in terms of silver amount.

Suport Polyethylene Resin-laminated Paper

[containing on the first layer side a white pigment ($TiO_2$; content: 16% by weight; ZnO: content: 4% by weight and a fluorescent brightening agent (4,4'-bis(5-methylbenzoxazolyl)stilbene; content: 0.03% by weight), and a bluing dye (ultramarine)]

| First layer (yellow image-forming blue-sensitive emulsion layer): | |
|---|---|
| Emulsion B-1 | 0.24 |
| Gelatin | 1.08 |
| Yellow coupler (ExY) | 0.46 |
| Color image-stabilizing agent (Cpd-1) | 0.06 |

-continued

| | |
|---|---|
| Color image-stabilizing agent (Cpd-2) | 0.03 |
| Color image-stabilizing agent (Cpd-3) | 0.06 |
| Color image-stabilizing agent (Cpd-8) | 0.02 |
| Solvent (Solv-1) | 0.17 |
| Second layer (color mixing-inhibiting layer) | |
| Gelatin | 0.55 |
| Color mixing inhibitor (Cpd-4) | 0.05 |
| Color image-stabilizing agent (Cpd-5) | 0.01 |
| Color image-stabilizing agent (Cpd-6) | 0.06 |
| Color image-stabilizing agent (Cpd-7) | 0.01 |
| Solvent (Solv-1) | 0.03 |
| Solvent (Solv-2) | 0.11 |
| Third layer (magenta image-forming green-sensitive emulsion layer) | |
| Emulsion G-1 | 0.15 |
| Gelatin | 1.42 |
| Magenta coupler (ExM) | 0.15 |
| UV ray absorbent (UV-A) | 0.14 |
| Color image-stabilizing agent (Cpd-2) | 0.02 |
| Color image-stabilizing agent (Cpd-4) | 0.002 |
| Color image-stabilizing agent (Cpd-6) | 0.09 |
| Color image-stabilizing agent (Cpd-8) | 0.02 |
| Color image-stabilizing agent (Cpd-9) | 0.03 |
| Color image-stabilizing agent (Cpd-10) | 0.01 |
| Color image-stabilizing agent (Cpd-11) | 0.0001 |
| Solvent (Solv-3) | 0.11 |
| Solvent (Solv-4) | 0.22 |
| Solvent (Solv-5) | 0.20 |
| Fourth layer (color mixing-inhibiting layer) | |
| Gelatin | 0.40 |
| Color mixing inhibitor (Cpd-4) | 0.03 |
| Color image-stabilizing agent (Cpd-5) | 0.006 |
| Color image-stabilizing agent (Cpd-6) | 0.05 |
| Color image-stabilizing agent (Cpd-7) | 0.004 |
| Solvent (Solv-1) | 0.02 |
| Solvent (Solv-2) | 0.08 |
| Fifth layer (cyan image-forming red-sensitive emulsion layer) | |
| Emulsion R-1 | 0.13 |
| Gelatin | 1.20 |
| Cyan coupler (ExC-2) | 0.13 |
| Cyan coupler (ExC-3) | 0.03 |
| Color image-stabilizing agent (Cpd-1) | 0.05 |
| Color image-stabilizing agent (Cpd-6) | 0.06 |
| Color image-stabilizing agent (Cpd-7) | 0.02 |
| Color image-stabilizing agent (Cpd-9) | 0.04 |
| Color image-stabilizing agent (Cpd-10) | 0.01 |
| Color image-stabilizing agent (Cpd-14) | 0.01 |
| Color image-stabilizing agent (Cpd-15) | 0.12 |
| Color image-stabilizing agent (Cpd-16) | 0.03 |
| Color image-stabilizing agent (Cpd-17) | 0.09 |
| Color image-stabilizing agent (Cpd-18) | 0.07 |
| Solvent (Solv-5) | 0.15 |
| Solvent (Solv-8) | 0.05 |
| Sixth layer (UV ray-absorbing layer) | |
| Gelatin | 0.46 |
| UV ray absorbent (UV-B) | 0.45 |
| Compound (S1-4) | 0.0015 |
| Solvent (Solv-7) | 0.25 |
| Seventh layer (protective layer) | |
| Gelatin | 1.00 |
| Acryl-modified copolymer of polyvinyl alcohol (modification degree: 17%) | 0.04 |
| Liquid paraffin | 0.02 |
| Surfactant (Cpd-13) | 0.01 |

The thus-obtained sample was referred to as sample 101. Samples 102 to 108 as shown in Table 4 were also similarly prepared by changing the emulsions of the yellow, magenta and/or cyan image-forming layer used in sample 101 to those as shown in Table 3.

TABLE 3

| Emulsion | Gold sensitizer | Amount of added gold sensitizer μmol/mol Ag | Avdrage sphere diameter of silver halide grains | Content of AgCl (%) |
|---|---|---|---|---|
| B-1 | Bis(1,4,5-trimethyl-1,2,4-triazolium-3-thiolato) aurate (I) tetrafluoroborate | 17 | 0.73 | 96.75 |
| B-2 | Bis(1,4,5-trimethyl-1,2,4-triazolium-3-thiolato) aurate (I) tetrafluoroborate | " | 0.68 | 96.75 |
| B-3 | Bis(1,4,5-trimethyl-1,2,4-triazolium-3-thiolato) aurate (I) tetrafluoroborate | " | 0.17 | 96.75 |
| B-1* | P1-15 | " | 0.73 | 96.75 |
| B-2* | " | " | 0.68 | 96.75 |
| B-3* | " | " | 0.17 | 96.75 |
| G-1 | Bis(1,4,5-trimethyl-1,2,4-triazolium-3-thiolato) aurate (I) tetrafluoroborate | " | 0.44 | 96.75 |
| G-2 | Bis(1,4,5-trimethyl-1,2,4-triazolium-3-thiolato) aurate (I) tetrafluoroborate | " | 0.38 | 96.75 |
| G-3 | Bis(1,4,5-trimethyl-1,2,4-triazolium-3-thiolato) aurate (I) tetrafluoroborate | " | 0.19 | 96.75 |
| G-1* | P1-15 | " | 0.44 | 96.75 |
| G-2* | " | " | 0.38 | 96.75 |
| G-3* | " | " | 0.19 | 96.75 |
| R-1 | Bis(1,4,5-trimethyl-1,2,4-triazolium-3-thiolato) aurate (I) tetrafluoroborate | " | 0.44 | 96.75 |
| R-2 | Bis(1,4,5-trimethyl-1,2,4-triazolium-3-thiolato) aurate (I) tetrafluoroborate | " | 0.38 | 96.75 |
| R-3 | Bis(1,4,5-trimethyl-1,2,4-triazolium-3-thiolato) aurate (I) tetrafluoroborate | " | 0.19 | 96.75 |
| R-1* | P1-15 | " | 0.44 | 96.75 |
| R-2* | " | " | 0.38 | 96.75 |
| R-3* | " | " | 0.19 | 96.75 |

TABLE 4

| Sample | BL Emulsion | GL Emulsion | RL Emulsion | Note |
|---|---|---|---|---|
| 101 | B-1 (0.73 μm) | G-1 (0.44 μm) | R-1 (0.44 μm) | Com. Ex. |
| 102 | B-1* (0.73 μm) | G-1* (0.44 μm) | R-1* (0.44 μm) | Example |
| 103 | B-1 (0.73 μm) | G-2 (0.38 μm) | R-2 (0.38 μm) | Com. Ex. |
| 104 | B-1* (0.73 μm) | G-2* (0.38 μm) | R-2* (0.38 μm) | Example |
| 105 | B-2 (0.68 μm) | G-2 (0.38 μm) | R-2 (0.38 μm) | Com. Ex. |
| 106 | B-2* (0.68 μm) | G-2* (0.38 μm) | R-2* (0.38 μm) | Example |
| 107 | B-3 (0.17 μm) | G-3 (0.19 μm) | R-3 (0.19 μm) | Com. Ex. |
| 108 | B-3* (0.17 μm) | G-3* (0.19 μm) | R-3* (0.19 μm) | Example |

(Sample 106 is a Particularly Preferred Embodiment.)

(BL, GL and RL Represent a Blue-sensitive Layer, a Green-sensitive Layer and a Red-sensitive Layer, Respectively.)

In order to examine rapid processing adaptability of these samples for the digital exposure and the processing system, the following experiments were conducted.

As exposure light sources for a digital exposure apparatus, a blue color semiconductor laser of about 440 nm in wavelength (presented by Nichia Kagaku K. K. in the $48^{th}$ Oyo Butsurigaku Kankei Rengo Koenkai, March 2001), a green laser of about 530 nm obtained by converting wave length of a semiconductor laser light (oscillation wavelength: about 1060 nm) by means of SHG crystals of LiNbO3 having a waveguide-like reversal domain structure to take out, and a red color semiconductor laser of about 650 nm in wavelength (Hitachi Type No. HL6501MG) were used. Each of the three color laser lights migrated in a vertical direction with respect to the scanning direction by means of a polygon mirror to thereby sequentially conduct scanning exposure of each sample. The change in exposure amount due to change in temperature of the semiconductor laser was depressed by keeping the temperature at a definite level utilizing a Peltier element. The effective beam diameter was 80 μm, scanning pitch was 42.3 μm (600 dpi), and the average exposure period per pixel was $1.7\times10^{-7}$ second. After giving a gray color gradation exposure to each of the samples of a size of 12×8.9 cm so that the color densities of yellow, magenta and cyan became almost equal, processing A conducted in Example 1 and the following color development processing B were conducted.

Processing step B is shown below.

[Processing B]

A continuous processing (running test) was conducted in the following processing steps till the volume of used replenishing solution for color development reached 0.5 times the volume of a color-developing tank.

| Processing step | Temperature | Period | Replenished amount* |
|---|---|---|---|
| Color development | 42.0° C. | 27 sec | 45 ml |

*Replenished amount per $m^2$ of the light-sensitive material.
**Rinse-cleaning system RC50D made by Fuji Photo Film Co., Ltd. was installed in the rinsing step (3), and the rinsing solution was taken out of the rinsing (3), then fed to a reverse osmosis membrane module (RC50D) using a pump. The osmosed water from the tank was fed to the rinsing step (4), and the concentrated water was returned to the rinsing step (3). The pressure of the pump was adjustedso that the amount of the osmosed water from the revere osmosis module was kept at a level of 50 to 300ml/min, and the circulation was conducted for 10 hours a day with controlling the temperature. Rinsing was conducted in a tank-countercurrent manner of from (1) to (4).

The bleach-fixing and the subsequent processing were the same as with the processing A including formulations of the processing solutions, temperatures, periods and replenishing amounts for respective steps.

Formulation of each of the processing solutions is as follows.

| [Color developing solution] | [Tank solution] | [Replenishing solution] |
|---|---|---|
| Water | 800 ml | 600 ml |
| Fluorescent brightening agent (FL-1) | 4.0 g | 6.8 g |
| Tri(isopropanol)amine | 8.8 g | 8.8 g |
| Sodium p-toluenesulfonate | 20.0 g | 20.0 g |
| Ethylenediaminetetraacetic acid | 4.0 g | 4.0 g |
| Sodium sulfite | 0.10 g | 0.50 g |
| Potassium chloride | 8.0 g | — |
| Sodium 4,5-Dihydroxybenzene-1,3-disulfonate | 0.50 g | 0.50 g |
| Dosodium N,N-bis(sulfonatoethyl)-hydroxylamine | 8.5 g | 14.5 g |
| 4-Amino-3-methyl-N-ethyl-N-(β-methanesulfonamidoethyl)aniline 3/2 sulfate monohydrate | 7.5 g | 16.5 g |
| Potassium carbonate | 26.3 g | 26.3 g |
| Water to make | 1000 ml | 1000 ml |
| pH (at 25° C.; adjusted by using sulfuric acid and KOH) | 10.35 | 12.6 |

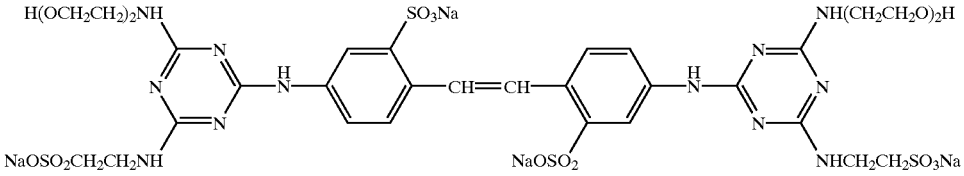

FL-1

In order to examine photographic properties of these samples, the following experiments were conducted. A period from exposure of each sample to introduction thereof into the processing solution was set to 9 seconds by adjusting the conveying speed for the exposed samples.

Yellow, magenta and cyan densities of each of the thus-processed samples were measured to obtain characteristic curves. An exposure amount (E1) giving a color density of 0.7 was determined on each sample. Also, a color density (D2) at an exposure amount (E2) 10 times as large as E1 was determined on each sample. In the processing A and processing B, similar exposure and processing were conducted by adding 0.3 ml of the bleach-fixing solution per 1000 ml of the color-developing solution, and the color density (D1) for the formerly determined exposure amount (E1) was determined. Thus, a value of change in density in the case where the bleach-fixing solution came into the color-developing solution ((D1)-0.7) was determined. The smaller this value, the better the processing stability. That is, the smaller value shows that, even when the bleach-fixing solution comes into the color-developing solution, there arise a less change in photographic property, thus such samples being excellent.

Next, each sample was exposed using the aforesaid exposing apparatus based on digital information recorded by a digital camera, and was subjected to the processing A or B to prepare color prints. The period from the exposure of the sample to the introduction of the sample into the processing solution was similarly set to 60 seconds, 9 seconds or 3 seconds. 10 color prints were prepared for each condition, and streak-like unevenness was visually observed according to the following standard:

A: extremely good with no streak-like unevenness

B: slight streak-like unevenness being observed with 1 to 3 samples out of 10 samples C: clear streak-like unevenness being observed with 1 to 3 samples out of 10 samples, thus being inferior as color print quality D: clear streak-like unevenness being observed with almost all samples, thus not being acceptable as color print quality Next, in order to examine reciprocity law properties, a gradated exposure for sensitometry was given to each of the coated samples using a sensitometer (model FWH; made by Fuji Photo Film Co., Ltd.). A low-intensity exposure was given for 10 seconds with an exposure amount of 200 lx·sec through an SP-2 filter.

Also, a gradated exposure for sensitometry was given using a sensitometer for high-intensity exposure (model HIE; made by Yamashita Denso K. K.). A high-intensity exposure was conducted for $10^{-4}$ second through the SP-2 filter.

After the exposure, the color development processing A or B was conducted.

The density of the formed yellow, magenta and cyan color of each of the processed samples was measured to determine a low intensity sensitivity for the 10-second exposure and a high intensity sensitivity for the $10^{-4}$-second exposure. The sensitivity was defined as a reciprocal of an exposure amount giving a color density higher than the minimum color density by 1.5, and a relative value taking the sensitivity of the development-processed sample (101) as 100 was referred to as a relative sensitivity. Also, gradation was determined based on the inclination of a straight line between a point for said sensitivity and a sensitivity point of 1.5 in density.

In order to examine dependence of sensitivity upon exposure humidity, the following experiments were conducted.

The relative sensitivity upon exposing each sample was set to 55% and 80%. Each sample was exposed for 1/10 second using the semsitometer used for examining the reciprocity law properties, then subjected to the processing A or B, followed by measuring the yellow, magenta and cyan color density of each sample. The sensitivity was defined as a reciprocal of an exposure amount giving a color density higher than the minimum color density by 0.5, and a relative value taking the sensitivity of the development-processed sample (101) as 100 was referred to as a relative sensitivity. A difference obtained by subtracting the relative sensitivity for the exposure at a humidity of 80% from the relative sensitivity for the exposure at a humidity of 55% (hereinafter referred to as "dS") was determined.

Experimental results are tabulated in Table 5.

TABLE 5

| Example | Processing | (D1)-0.7 | | | D2 | | | Sensitivity (10 sec) | | | Sensitivity ($10^{-4}$ sec) | | | dS | | | Streak-like | Note |
|---|---|---|---|---|---|---|---|---|---|---|---|---|---|---|---|---|---|---|
| | | Y | M | C | Y | M | C | Y | M | C | Y | M | C | Y | M | C | unevenness | |
| 101 | A | 0.04 | 0.06 | 0.01 | 2.30 | 2.30 | 2.30 | 100 | 100 | 100 | 100 | 100 | 100 | 12 | 10 | 11 | C | Comparative |
| | B | 0.04 | −0.02 | 0.03 | 2.05 | 2.08 | 2.27 | 92 | 93 | 91 | 93 | 93 | 92 | 14 | 12 | 12 | D | Ex. |
| 102 | A | 0.04 | 0.05 | 0.01 | 2.31 | 2.31 | 2.31 | 122 | 125 | 124 | 131 | 130 | 133 | 6 | 5 | 5 | C | Example |
| | B | 0.03 | −0.02 | 0.02 | 2.18 | 2.22 | 2.24 | 114 | 116 | 112 | 118 | 119 | 115 | 7 | 6 | 5 | D | |
| 103 | A | 0.09 | 0.35 | 0.14 | 2.29 | 2.30 | 2.30 | 99 | 77 | 76 | 98 | 76 | 76 | 12 | 8 | 7 | A | Comparative |
| | B | 0.04 | 0.02 | 0.07 | 1.95 | 2.30 | 2.28 | 78 | 75 | 73 | 77 | 75 | 74 | 14 | 10 | 11 | B | Ex. |
| 104 | A | 0.08 | 0.33 | 0.13 | 2.31 | 2.31 | 2.31 | 119 | 92 | 93 | 121 | 95 | 94 | 6 | 4 | 4 | A | Example |
| | B | 0.05 | 0.03 | 0.06 | 2.08 | 2.32 | 2.30 | 95 | 96 | 95 | 99 | 93 | 92 | 7 | 6 | 5 | B | |
| 105 | A | 0.18 | 0.30 | 0.16 | 2.30 | 2.34 | 2.30 | 87 | 77 | 76 | 86 | 75 | 76 | 9 | 8 | 7 | A | Comparative |
| | B | 0.04 | 0.04 | 0.03 | 2.28 | 2.28 | 2.29 | 86 | 75 | 75 | 85 | 76 | 75 | 10 | 10 | 11 | A | Ex. |
| 106 | A | 0.17 | 0.30 | 0.15 | 2.31 | 2.35 | 2.33 | 104 | 102 | 104 | 108 | 107 | 108 | 4 | 3 | 4 | A | Example* |
| | B | 0.05 | 0.04 | 0.03 | 2.30 | 2.29 | 2.30 | 102 | 101 | 103 | 105 | 104 | 104 | 3 | 3 | 4 | A | |
| 107 | A | 0.43 | 0.44 | 0.30 | 2.27 | 2.30 | 2.28 | 54 | 43 | 42 | 52 | 45 | 44 | 6 | 5 | 5 | A | Comparative |
| | B | 0.17 | 0.30 | 0.19 | 2.27 | 2.31 | 2.29 | 48 | 38 | 36 | 49 | 39 | 38 | 6 | 6 | 6 | A | Ex. |
| 108 | A | 0.41 | 0.42 | 0.29 | 2.28 | 2.31 | 2.29 | 66 | 58 | 59 | 68 | 59 | 61 | 4 | 3 | 3 | A | Example |
| | B | 0.18 | 0.29 | 0.20 | 2.29 | 2.32 | 2.30 | 59 | 49 | 51 | 60 | 52 | 53 | 4 | 4 | 4 | A | |

*particularly preferred embodiments

Table 5 reveals the following.

Emulsions using the gold compound of the invention are more sensitive than the conventional gold-sulfur-sensitized emulsions using meso-ion gold. They are similarly highly sensitive even upon a $10^{-4}$-second exposure (high-intensity exposure), and are excellent in reciprocity law properties. Also, while the conventional gold-sulfur-sensitized emulsions involve the problem that they are liable to suffer change in sensitivity due to change in humidity upon exposure, the emulsions of the invention have been proved to have the advantage that they suffer an extremely small change in sensitivity.

The test results using the sample 101 and other samaples revealed that, in order to prevent streak-like unevenness, attain processing stability and keep the color density (D2) in high-density areas upon high-intensity exposure, it is necessary to acquire the silver halide grain size of a preferred embodiment of the invention. Additionally, every sample of the invention is confirmed to show a contrasty gradation even in the $10^{-4}$-second exposure.

EXAMPLE 3

Samples 201 and 202 were prepared in the same manner as with the sample 106 except for changing the amounts of gelatin and coated silver as shown in Table 6.

TABLE 6

| | Amount of coated gelatin g/m$^2$ | | | | | | | | Amount of coated silver g/m$^2$ | | | |
|---|---|---|---|---|---|---|---|---|---|---|---|---|
| Sample | First Layer | Second Layer | Third Layer | Fourth Layer | Fifth Layer | Sixth Layer | Seventh Layer | Total | First Layer | Third Layer | Fifth Layer | Total |
| 101* | 1.08 | 0.55 | 1.42 | 0.40 | 1.20 | 0.46 | 1.00 | 6.11 | 0.24 | 0.15 | 0.13 | 0.52 |
| 105* | 1.08 | 0.55 | 1.42 | 0.40 | 1.20 | 0.46 | 1.00 | 6.11 | 0.24 | 0.15 | 0.13 | 0.52 |
| 106** | 1.08 | 0.55 | 1.42 | 0.40 | 1.20 | 0.46 | 1.00 | 6.11 | 0.24 | 0.15 | 0.13 | 0.52 |
| 201** | 0.95 | 0.50 | 1.36 | 0.36 | 1.11 | 0.46 | 1.00 | 5.74 | 0.24 | 0.15 | 0.13 | 0.52 |
| 202** | 0.95 | 0.50 | 1.36 | 0.36 | 1.11 | 0.46 | 1.00 | 5.74 | 0.19 | 0.12 | 0.10 | 0.41 |

*comparative example
**example of the invention

The samples shown in Table 6 were subjected to the same exposure with the same period from exposure to color development and the same evaluating methods as in Example 2 except for changing the processing steps to the following processing C.

Processing steps are shown below.

[Processing C]

A continuous processing was conducted in the following processing steps till the volume of the used replenishing solution reached 0.5 times the volume of a color-developing tank.

| Processing step | Temperature | Period | Replenished amount* |
|---|---|---|---|
| Color development | 45.0° C. | 16 sec | 45 ml |
| Bleach-fixing | 40.0° C. | 16 sec | 35 ml |
| Rinsing (1) | 40.0° C. | 8 sec | — |
| Rinsing (2) | 40.0° C. | 8 sec | — |
| Rinsing (3)** | 40.0° C. | 8 sec | — |
| Rinsing (4)** | 38.0° C. | 8 sec | 121 ml |
| Drying | 80.0° C. | 16 sec | |

Notes)
*Replenished amount per m$^2$ of the light-sensitive material
**Rinse-cleaning system RC50D made by Fuji Photo Film Co., Ltd. was installed in the rinsing step (3), and the rinsing solution was taken out of the rinsing (3), then fed to a reverse osmosis membrane module (RC50D) using a pump. The osmosed water from the tank was fed to the rinsing step (4), and the concentrated water was returned to the rinsing step (3). The pressure of the pump was adjustedso that the amount of the osmosed water from the revere osmosis module was kept at a level of 50 to 300ml/min, and the circulation was conducted for 10 hours a day with controlling the temperature. Rinsing was conducted in a tank-countercurrent manner of from (1) to (4).

Formulation of each of the processing solutions is as follows.

| | [Tank solution] | [Replenishing solution] |
|---|---|---|
| [Color developing solution] | | |
| Water | 800 ml | 600 ml |
| Fluorescent brightening agent(foregoing FL-1) | 5.0 g | 8.5 g |
| Tri(isopropanol)amine | 8.8 g | 8.8 g |
| Sodium p-toluenesulfonate | 20.0 g | 20.0 g |
| Ethylenediaminetetraacetic acid | 4.0 g | 4.0 g |
| Sodium sulfite | 0.10 g | 0.50 g |
| Potassium chloride | 10.0 g | — |
| Sodium 4,5-dihydroxybenzene-1,3-disulfonate | 0.50 g | 0.50 g |
| Disodium N,N-bis(sulfonatoethyl)-hydjroxylamine | 8.5 g | 14.5 g |
| 4-Amino-3-methyl-N-ethyl-N-(β-methanesulfonamidoethyl)-aniline 3/2 sulfate monohydrate | 10.0 g | 22.0 g |
| Potassium carbonate | 26.3 g | 26.3 g |
| Water to make | 1000 ml | 1000 ml |
| pH (at 25° C.; adjusted by using sulfuric acid and KOH) | 10.35 | 12.6 |
| [Bleach-fixing solution] | | |
| Water | 800 ml | 800 ml |
| Ammonium thiosulfate (750 g/l) | 107 ml | 214 ml |
| Succinic acid | 29.5 g | 59.0 g |
| Iron(III) ammonium ethylene-diaminetetraacetate | 47.0 g | 94.0 g |
| Ethylenediaminetetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 ml | 1000 ml |
| PH (at 25° C.; adjusted with nitric acid and aqueous ammonia) | 6.0 | 6.0 |
| [Rinsing solution] | | |
| Sodium chlorinated isocyanurate | 0.02 g | 0.02 g |
| Deionized water (5 μS/cm or less in electric conductivity) | 1000 ml | 1000 ml |
| PH (25° C.) | 6.5 | 6.5 |

TABLE 7

| | | (D1)-0.7 | | | D2 | | | Sensitivity (10 sec) | | | Sensitivity ($10^{-4}$ sec) | | | Streak-like | |
|---|---|---|---|---|---|---|---|---|---|---|---|---|---|---|---|
| Sample | Processing | Y | M | C | Y | M | C | Y | M | C | Y | M | C | unevenness | Note |
| 101 | C | 0.01 | 0.08 | 0.03 | 1.70 | 1.89 | 2.20 | 100 | 100 | 100 | 100 | 100 | 100 | D | Comparative |
| 105 | C | 0.04 | 0.05 | 0.05 | 2.21 | 2.31 | 2.37 | 88 | 77 | 77 | 87 | 78 | 79 | A | Ex. |
| 106 | C | 0.04 | 0.05 | 0.05 | 2.28 | 2.33 | 2.38 | 106 | 104 | 104 | 109 | 110 | 110 | A | Example |
| 201 | C | 0.05 | 0.05 | 0.04 | 2.27 | 2.34 | 2.37 | 105 | 105 | 103 | 110 | 112 | 109 | B | |
| 202 | C | 0 | 0.02 | 0.03 | 2.25 | 2.32 | 2.35 | 99 | 101 | 100 | 101 | 100 | 99 | A | |

As is apparent from the results in Table 7, it is seen that the samples 106, 201 and 202 using the gold compound of the invention and containing a silver halide emulsion of grains having a preferred grain size in the invention showed good properties even in the processing C wherein the color-developing period was more shortened. Comparison of the samples 106, 201 and 202 reveals that good properties are obtained even when the amounts of gelatin and silver coated in them were decreased, thus production cost being advantageously reduced. Also, the sample 101 containing the silver halide emulsion wherein size of the silver halide grains is outside the scope of the invention failed to exhibit the aforesaid effects, thus it being apparent that specifically good properties are obtained within the scope of the invention.

EXAMPLE 4

Procedures for the samples 106, 201 and 202 in Examples 2 and 3 were conducted except for replacing all P1-15 in the silver halide emulsions by equimolar amounts of P1-1C or by replacing by equimolar amounts of P1-5 to prepare respective samples. As a result of conducting the same evaluations as in Examples 2 and 3, excellent effects were confirmed with every sample.

While the invention has been described in detail and with reference to specific embodiments thereof, it will be apparent to one skilled in the art that various changes and modifications can be made therein without departing from the spirit and scope thereof.

What is claimed is:

1. A silver halide emulsion having a silver chloride content of 90 mol % or more which has been chemically sensitized with a compound capable of releasing an $Au^{I}Ch^{-}$ ion, wherein grains of the silver halide contain in the shell portion thereof 0.01 to 0.50 mol % of silver iodide per mol of the total silver, with Ch representing S, Se or Te.

2. A silver halide emulsion having silver chloride content of 90 mol % or more which has been chemically sensitized with at least one compound selected from the group consisting of the gold-chalcogen compounds represented by the following general formula (PF1), (PF2), (PF3) or (PF4), wherein grains of the silver halide contain in the shell portion thereof 0.01 to 0.50 mol % of silver iodide per mol of the total silver:

(PF1)

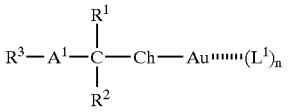

-continued (PF2)

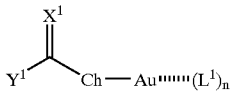

(PF3)

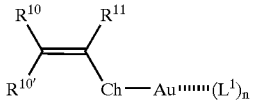

(PF4)

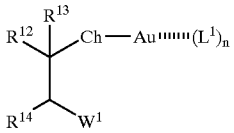

wherein Ch represents an S atom, an Se atom or a Te atom, $L^1$ represents a compound capable of coordinating with gold via an N atom, an S atom, an Se atom or a Te atom, n represents 0 or 1, $A^1$ represents O, S or $NR^4$, $R^1$ to $R^4$ each represents a hydrogen atom or a substituent, or $R^3$ may form a 5- to 7-membered ring together with $R^1$ or $R^2$, $X^1$ represents O, S or $NR^5$, $Y^1$ represents an alkyl group, an alkenyl group, an alkynyl group, an aryl group, a hetero ring group, $OR^6$, $SR^7$, or $N(R^8)R^9$, $R^5$ to $R^9$ each represents a hydrogen atom, an alkyl group, an alkenyl group, an alkynyl group, an aryl group or a hetero ring group, $X^1$ and $Y^1$ may be bound to each other to form a ring, $R^{10}$, $R^{10'}$ and $R^{11}$ each independently represents a hydrogen atom or a substituent, with at least one of $R^{10}$ and $R^{10'}$ representing an electron attractive group, $W^1$ represents an electron attractive group, and $R^{12}$ to $R^{14}$ each represents a hydrogen atom or a substituent, with $W^1$ and $R^{12}$ optionally being bound to each other to form a cyclic structure.

3. The silver halide emulsion as claimed in claim 1, wherein the compound capable of releasing $Au^{I}Ch^{-}$ ion is a compound selected from the group consisting of the compounds represented by the following general formula (PF1), (PF2), (PF3) or (PF4):

(PF1)

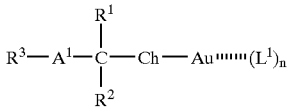

(PF2)

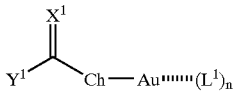

-continued (PF3)

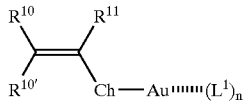

(PF4)

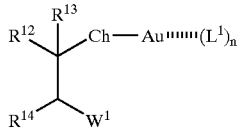

wherein Ch represents an S atom, an Se atom or a Te atom, $L^1$ represents a compound capable of coordinating with gold via an N atom, an S atom, an Se atom or a Te atom, n represents 0 or 1, $A^1$ represents O, S or $NR^4$, $R^1$ to $R^4$ each represents a hydrogen atom or a substituent, or $R^3$ may form a 5- to 7-membered ring together with $R^1$ or $R^2$, $X^1$ represents O, S or $NR^5$, $Y^1$ represents an alkyl group, an alkenyl group, an alkynyl group, an aryl group, a hetero ring group, $OR^6$, $SR^7$, or $N(R^8)R^9$, $R^5$ to $R^9$ each represents a hydrogen atom, an alkyl group, an alkenyl group, an alkynyl group, an aryl group or a hetero ring group, $X^1$ and $Y^1$ may be bound to each other to form a ring, $R^{10}$, $R^{10'}$ and $R^{11}$ each independently represents a hydrogen atom or a substituent, with at least one of $R^{10}$ and $R^{10'}$ representing an electron attractive group, $W^1$ represents an electron attractive group, and $R^{12}$ to $R^{14}$ each represents a hydrogen atom or a substituent, with $W^1$ and $R^{12}$ optionally being bound to each other to form a cyclic structure.

4. The silver halide emulsion as claimed in claim 1, which contains a complex represented by the following general formula (I):

$$[IrX^I_nL^I_{(6-n)}]^m \quad (I)$$

wherein $X^I$ represents a halide ion or a pseudo-halide ion, $L^I$ represents an arbitrary ligand different from $X^I$, n represents 3, 4 or 5, and m represents an integer of from −5 to +1.

5. The silver halide emulsion as claimed in claim 1, which contains a complex represented by the following general formula (II):

$$[MX^{II}_nL^{II}_{(6-n)}]^m \quad (II)$$

wherein M represents Cr, Mo, Re, Fe, Ru, Os, Co, Rh, Pd or Pt, $X^{II}$ represents a halide ion, $L^{II}$ represents an arbitrary ligand different from $X^{II}$, n represents 3, 4, 5 or 6, and m represents an integer of from −4 to +1.

6. The silver halide emulsion as claimed in claim 5, wherein in the complex represented by the general formula (II), M represents Rh and X represents Br.

7. The silver halide emulsion as claimed in claim 1, which has been chemically sensitized with a selenium compound.

8. A silver halide color photographic light-sensitive material comprising a support having provided thereon photograph-constituting layers containing at least one yellow image-forming silver halide emulsion layer, at least one magenta image-forming silver halide emulsion layer, at least one cyan image-forming silver halide emulsion layer and at least one light-insensitive hydrophilic colloid layer, wherein the silver halide emulsion in at least one of the silver halide emulsion layers is a silver halide emulsion having a silver chloride content of 90 mol % or more which has been chemically sensitized with a compound capable of releasing an $Au^ICh^-$ ion, wherein grains of the silver halide contain in the shell portion thereof 0.01 to 0.50 mol % of silver iodide per mol of the total silver, with Ch representing S, Se or Te.

9. The silver halide color photographic light-sensitive material as claimed in claim 8, wherein grains of the silver halide in the yellow image-forming silver halide emulsion layer has an average equivalent-sphere diameter of 0.70 to 0.20 μm.

10. The silver halide color photographic light-sensitive material as claimed in claim 8, wherein grains of the silver halide in the magenta image-forming silver halide emulsion layer and the cyan image-forming silver halide emulsion have an average equivalent-sphere diameter of 0.40 to 0.20 μm.

11. The silver halide color photographic light-sensitive material as claimed in claim 8, wherein the total amount of coated gelatin of the silver halide color photographic light-sensitive material is 6.0 to 3.0 g/m$^2$.

12. The silver halide color photographic light-sensitive material as claimed in claim 8, wherein the total amount of coated silver of the silver halide color photographic light-sensitive material is 0.50 to 0.20 g/m$^2$.

13. An image-forming method which comprises conducting scanning exposure of a silver halide color photographic light-sensitive material by a laser light beam modulated based on image information with an exposure period per pixel of shorter than $10^{-4}$ second, then conducting development processing, said silver halide color photographic light-sensitive material comprising a support having provided thereon at least one blue-sensitive silver halide emulsion layer, at least one green-sensitive silver halide emulsion layer and at least one red-sensitive silver halide emulsion layer, wherein at least one of the blue-sensitive silver halide emulsion layer, the green-sensitive silver halide emulsion layer and the red-sensitive silver halide emulsion layer contains a silver halide emulsion having a silver chloride content of 90 mol % or more which has been chemically sensitized with a compound capable of releasing an $Au^ICh^-$ ion, wherein grains of the silver halide contain in the shell portion thereof 0.01 to 0.50 mol % of silver iodide per mol of the total silver, with Ch representing S, Se or Te.

* * * * *